US010582329B2

(12) United States Patent
Magariyachi et al.

(10) Patent No.: US 10,582,329 B2
(45) Date of Patent: Mar. 3, 2020

(54) AUDIO PROCESSING DEVICE AND METHOD

(71) Applicant: SONY CORPORATION, Tokyo (JP)

(72) Inventors: Tetsu Magariyachi, Kanagawa (JP); Yuhki Mitsufuji, Tokyo (JP); Yu Maeno, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/064,139

(22) PCT Filed: Dec. 22, 2016

(86) PCT No.: PCT/JP2016/088381
§ 371 (c)(1),
(2) Date: Jun. 20, 2018

(87) PCT Pub. No.: WO2017/119320
PCT Pub. Date: Jul. 13, 2017

(65) Prior Publication Data
US 2019/0007783 A1 Jan. 3, 2019

(30) Foreign Application Priority Data
Jan. 8, 2016 (JP) ..... 2016-002168

(51) Int. Cl.
*H04S 7/00* (2006.01)
*H04S 3/00* (2006.01)

(52) U.S. Cl.
CPC ..... *H04S 7/304* (2013.01); *H04S 3/008* (2013.01); *H04S 2400/01* (2013.01);
(Continued)

(58) Field of Classification Search
CPC ..... H04S 2400/11; H04S 2400/15; H04S 2420/01; H04S 2420/11; H04S 7/304;
(Continued)

(56) References Cited

U.S. PATENT DOCUMENTS

2006/0045275 A1* 3/2006 Daniel ..... G10H 1/0091 381/17
2010/0329466 A1* 12/2010 Berge ..... H04R 3/12 381/22
(Continued)

FOREIGN PATENT DOCUMENTS

CN 1735922 A 2/2006
CN 102823277 A 12/2012
(Continued)

OTHER PUBLICATIONS

International Search Report and Written Opinion of PCT Application No. PCT/JP2016/088381, dated Mar. 14, 2017, 08 pages of ISRWO.
(Continued)

*Primary Examiner* — Yogeshkumar Patel
(74) *Attorney, Agent, or Firm* — Chip Law Group

(57) ABSTRACT

Provided is an audio processing device and method, in which sound can be more efficiently reproduced. An audio processing device includes a matrix generation unit which generates a vector for each time-frequency with a head-related transfer function obtained by spherical harmonic transform by spherical harmonics as an element by using only the element corresponding to a degree of the spherical harmonics determined for the time-frequency or on the basis of the element common to all users and the element dependent on an individual user, and a head-related transfer function synthesis unit which generates a headphone drive signal of a time-frequency domain by synthesizing an input signal of a spherical harmonic domain and the generated vector.

11 Claims, 35 Drawing Sheets

(52) U.S. Cl.
CPC ..... *H04S 2400/11* (2013.01); *H04S 2400/15* (2013.01); *H04S 2420/01* (2013.01); *H04S 2420/11* (2013.01)

(58) Field of Classification Search
CPC ..... H04S 7/305; H04S 7/303; H04S 5/005; H04S 1/002; H04S 3/002; H04S 5/00; H04S 3/008; H04S 3/004; H04S 7/306; H04S 2400/01; G10L 19/008; G06F 3/012; H04R 5/033
USPC ..... 381/303
See application file for complete search history.

(56) References Cited

U.S. PATENT DOCUMENTS

| | | | | |
|---|---|---|---|---|
| 2014/0355766 | A1* | 12/2014 | Morrell | G10L 19/008 381/18 |
| 2015/0156599 | A1* | 6/2015 | Romigh | H04S 5/005 381/17 |
| 2015/0294672 | A1 | 10/2015 | Batke et al. | |

FOREIGN PATENT DOCUMENTS

| | | | |
|---|---|---|---|
| EP | 1563485 | A1 | 8/2005 |
| EP | 2268064 | A1 | 12/2010 |
| EP | 2285139 | A2 | 2/2011 |
| EP | 2553947 | A1 | 2/2013 |
| FR | 2847376 | A1 | 5/2004 |
| JP | 2006-506918 | A | 2/2006 |
| JP | 2015-159598 | A | 9/2015 |
| KR | 10-2005-0083928 | A | 8/2005 |
| KR | 10-2013-0031823 | A | 3/2013 |
| WO | 2004/049299 | A1 | 6/2004 |
| WO | 2011/117399 | A1 | 9/2011 |

OTHER PUBLICATIONS

Daniel, et al., "Further Investigations of High Order Ambisonics and Wavefield Synthesis for Holophonic Sound Imaging", Audio Engineering Society Convention Paper 5788, 18 pages.

* cited by examiner

FIG. 23

| DEGREE J OF SPHERICAL HARMONICS | 0 | 1 | 2 | 3 | 4 | 5 |
|---|---|---|---|---|---|---|
| NUMBER OF NECESSARY VIRTUAL SPEAKERS (K,L) | 1 | 4 | 9 | 16 | 25 | 36 |
| OPERATION AMOUNT (GENERAL TECHNIQUE) | 3 | 24 | 99 | 288 | 675 | 1368 |
| OPERATION AMOUNT (FIRST PROPOSED TECHNIQUE) | 2 | 8 | 18 | 32 | 50 | 72 |
| OPERATION AMOUNT (SECOND PROPOSED TECHNIQUE) | 3 | 18 | 53 | 116 | 215 | 358 |
| OPERATION AMOUNT (THIRD PROPOSED TECHNIQUE) | 3 | 18.2 | 53.7 | 117.7 | 218.3 | 363.7 |
| OPERATION AMOUNT (THIRD PROPOSED TECHNIQUE DEGREE −2 TRUNCATED) | 3 ** | 3.2 ** | 3.7 | 19.7 | 56.3 | 121.7 |
| MEMORY (GENERAL TECHNIQUE) | 200001 | 800016 | 1800081 | 3200256 | 5000625 | 7201296 |
| MEMORY (FIRST PROPOSED TECHNIQUE) | 200000 | 800000 | 1800000 | 3200000 | 5000000 | 7200000 |
| MEMORY (SECOND PROPOSED TECHNIQUE) | 1200 | 10800 | 36800 | 87200 | 170000 | 293200 |
| MEMORY (THIRD PROPOSED TECHNIQUE) | 220 | 940 | 2240 | 4200 | 6900 | 10420 |

AUDIO PROCESSING DEVICE AND METHOD

CROSS REFERENCE TO RELATED APPLICATIONS

This application is a U.S. National Phase of International Patent Application No. PCT/JP2016/088381 filed on Dec. 22, 2016, which claims priority benefit of Japanese Patent Application No. JP 2016-002168 filed in the Japan Patent Office on Jan. 8, 2016. Each of the above-referenced applications is hereby incorporated herein by reference in its entirety.

TECHNICAL FIELD

The present technology relates to an audio processing device and method and a program, and, in particular, relates to an audio processing device and method and a program, in which sound can be more efficiently reproduced.

BACKGROUND ART

In recent years, the development and dissemination of systems, which record, transmit, and reproduce spatial information from the entire environment, have been progressing in the field of sound. For example, in Super Hi-Vision, broadcasting is being planned with three-dimensional multi-channel acoustics of 22.2 ch.

Also in the field of virtual reality, ones which reproduce signals surrounding the entire environment for sound in addition to pictures surrounding the entire environment have started to be spread.

Among them, there is a technique called Ambisonics, which expresses three-dimensional audio information flexibly adaptable to an arbitrary recording/reproducing system and is attracting attention. In particular, Ambisonics which has degrees equal to or higher than the second-order is called higher order Ambisonics (HOA) (e.g., see Non-Patent Document 1).

In the three-dimensional multi-channel acoustics, sound information spreads along the spatial axis in addition to the time axis. And in Ambisonics, information is kept by performing frequency transform, that is, spherical harmonic transform on the angular direction of three-dimensional polar coordinates. The spherical harmonic transform can be considered to be equivalent to time-frequency transform on the audio signal about the time axis.

An advantage of this method is that information can be encoded and decoded from an arbitrary microphone array to an arbitrary speaker array without limiting the number of microphones or the number of speakers.

On the other hand, the factors that impede the spread of Ambisonics include the need for a speaker array including a large number of speakers in the reproduction environment, and the narrow range of reproducing the sound space (sweet spot).

For example, to try to increase the spatial resolution of sound, a speaker array including more speakers is necessary, but it is unrealistic to create such a system at home or the like. In addition, in a space like a movie theater, the area where the sound space can be reproduced is narrow, and it is difficult to give desired effects to all the audience.

CITATION LIST

Non-Patent Document

Non-Patent Document 1: Jerome Daniel, Rozenn Nicol, Sebastien Moreau, "Further Investigations of High Order Ambisonics and Wavefield Synthesis for Holophonic Sound Imaging," AES 114th Convention, Amsterdam, Netherlands, 2003

SUMMARY OF THE INVENTION

Problems to be Solved by the Invention

Therefore, it is conceivable to combine Ambisonics and binaural reproduction technology. The binaural reproduction technology is generally called a virtual auditory display (VAD) and is realized by using head-related transfer functions (HRTF).

Herein, the head-related transfer functions express information regarding how sounds are transmitted from every direction surrounding the human head to the binaural eardrums as functions of frequencies and directions of arrival.

In a case of presenting one obtained by synthesizing a target sound and a head-related transfer function from a certain direction with headphones, a listener senses the sound as if the sound comes from the direction of the head-related transfer function used, rather than from the headphones. VAD is a system that utilizes such a principle.

If a plurality of virtual loudspeakers are reproduced by using VAD, it is possible to realize, by headphone presentation, the same effects as Ambisonics in the speaker array system including a large number of speakers, which are difficult in reality.

However, with such a system, the sound cannot be reproduced sufficiently efficiently. For example, in a case where Ambisonics and the binaural reproduction technology are combined, not only the operation amount, such as the convolution operation of the head-related transfer functions, increases, but also the usage amount of the memory used for the operation and the like increases.

The present technology has been made in light of such a situation and can reproduce sound more efficiently.

Solutions to Problems

An audio processing device according to one aspect of the present technology includes: a matrix generation unit which generates a vector for each time-frequency with a head-related transfer function obtained by spherical harmonic transform by spherical harmonics as an element by using only the element corresponding to a degree of the spherical harmonics determined for the time-frequency or on the basis of the element common to all users and the element dependent on an individual user; and a head-related transfer function synthesis unit which generates a headphone drive signal of a time-frequency domain by synthesizing an input signal of a spherical harmonic domain and the generated vector.

The matrix generation unit can be caused to generate the vector on the basis of the element common to all the users and the element dependent on the individual user, which are determined for each time-frequency.

The matrix generation unit can be caused to generate the vector including only the element corresponding to the degree determined for the time-frequency on the basis of the element common to all the users and the element dependent on the individual user.

The audio processing device can be further provided with a head direction acquisition unit which acquires a head direction of a user who listens to sound, and the matrix generation unit can be caused to generate, as the vector, a row corresponding to the head direction in a head-related transfer function matrix including the head-related transfer function for each of a plurality of directions.

The audio processing device can be further provided with a head direction acquisition unit which acquires a head direction of a user who listens to sound, and the head-related transfer function synthesis unit can be caused to generate the headphone drive signal by synthesizing a rotation matrix determined by the head direction, the input signal, and the vector.

The head-related transfer function synthesis unit can be caused to generate the headphone drive signal by obtaining a product of the rotation matrix and the input signal and then obtaining a product of the product and the vector.

The head-related transfer function synthesis unit can be caused to generate the headphone drive signal by obtaining a product of the rotation matrix and the vector and then obtaining a product of the product and the input signal.

The audio processing device can be further provided with a rotation matrix generation unit which generates the rotation matrix on the basis of the head direction.

The audio processing device can be further provided with a head direction sensor unit which detects rotation of a head of the user, and the head direction acquisition unit can be caused to acquire the head direction of the user by acquiring a detection result by the head direction sensor unit.

The audio processing device can be further provided with a time-frequency inverse transform unit which performs time-frequency inverse transform on the headphone drive signal.

An audio processing method or a program according to one aspect of the present technology includes steps of: generating a vector for each time-frequency with a head-related transfer function obtained by spherical harmonic transform by spherical harmonics as an element by using only the element corresponding to a degree of the spherical harmonics determined for the time-frequency or on the basis of the element common to all users and the element dependent on an individual user; and generating a headphone drive signal of a time-frequency domain by synthesizing an input signal of a spherical harmonic domain and the generated vector.

According to one aspect of the present technology, a vector for each time-frequency with a head-related transfer function obtained by spherical harmonic transform by spherical harmonics as an element is generated by using only the element corresponding to a degree of the spherical harmonics determined for the time-frequency or on the basis of the element common to all users and the element dependent on an individual user, and a headphone drive signal of a time-frequency domain is generated by synthesizing an input signal of a spherical harmonic domain and the generated vector.

Effects of the Invention

According to one aspect of the present technology, it is possible to reproduce sound more efficiently.

Note that the effects described herein are not necessarily limited, and any of the effects described in the present disclosure may be applied.

BRIEF DESCRIPTION OF THE DRAWINGS

FIG. 23 is a diagram for explaining the operation amounts and necessary memory amounts of each proposed technique and the general technique.

MODE FOR CARRYING OUT THE INVENTION

Figure 1:
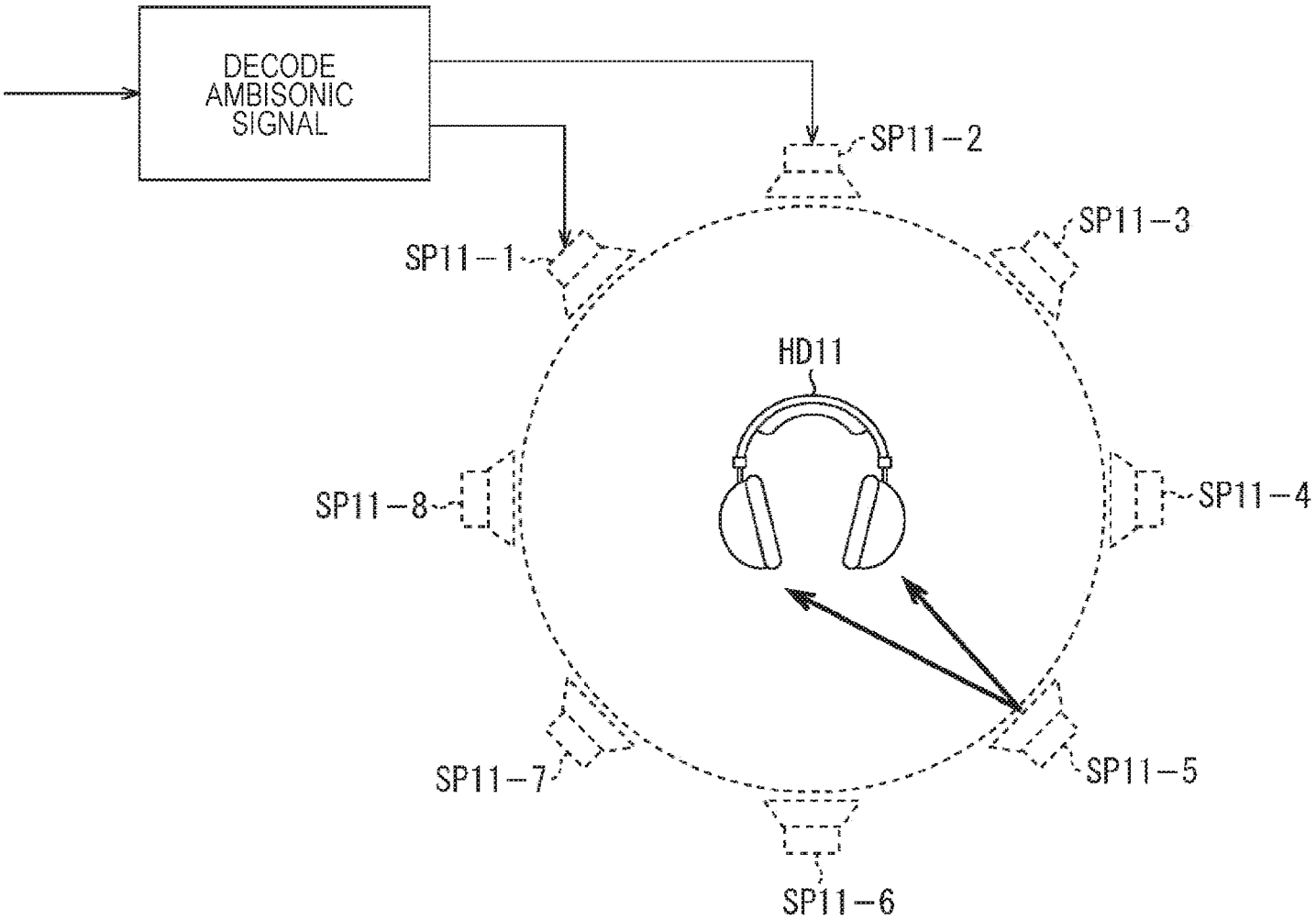
FIG. 1 is a diagram for explaining simulation of stereophony using head-related transfer functions.

Hereinafter, embodiments, to which the present technology is applied, will be described with reference to the drawings.

First Embodiment

<About Present Technology>

According to the present technology, a head-related transfer function itself is taken as a function of the spherical coordinates, similarly spherical harmonic transform is performed to synthesize an input signal, which is the audio signal, and the head-related transfer function in a spherical harmonic domain without decoding the input signal into a speaker array signal, thereby realizing a reproduction system more efficient in the operation amount and memory usage amount.

For example, the spherical harmonic transform on the function f(θ, φ) on the spherical coordinates is expressed by the following Expression (1).

[Expression 1]

$$F_n^m = \int_0^{\pi}\int^{2\pi} f(\theta,\phi)\overline{Y_n^m}(\theta,\phi)\,d\theta\,d\phi \tag{1}$$

In Expression (1), θ and φ are the elevation angle and the horizontal angle in the spherical coordinates, respectively, and $Y_n^m(\theta, \varphi)$ is the spherical harmonics. In addition, one marked with "-" at the top of the spherical harmonics $Y_n^m(\theta, \varphi)$ is the complex conjugate of the spherical harmonics $Y_n^m(\theta, \varphi)$.

Herein, the spherical harmonics $Y_n^m(\theta, \varphi)$ is expressed by the following Expression (2).

[Expression 2]

$$Y_n^m(\theta, \phi) = (-1)^m \sqrt{\frac{2n+1(n-m)!}{4\pi(n+m)!}}\, P_n^m(\cos\theta)e^{jm\phi} \tag{2}$$

In Expression (2), n and m are the degrees of the spherical harmonics $Y_n^m(\theta, \varphi)$, and $-n \le m \le n$. In addition, j is a pure imaginary number, and $P_n^m(x)$ is an associated Legendre function.

This associated Legendre function $P_n^m(x)$ is expressed by the following Expression (3) or (4) when $n \ge 0$ and $0 \le m \le n$. Note that Expression (3) is for a case where m=0.

[Expression 3]

$$P_n^0(x) = \frac{1}{2^n n!}\frac{d^n}{dx^n}(x^2-1)^n \tag{3}$$

[Expression 4]

$$P_n^m(x) = (1-x^2)^{m/2}\frac{d^n}{dx^n}P_m^0(x) \tag{4}$$

Moreover, in a case where $-n \le m \le 0$, the associated Legendre function $P_n^m(x)$ is expressed by the following Expression (5).

[Expression 5]

$$P_n^m(x) = (-1)^{-m}\frac{(n+m)!}{(n-m)!}P_n^{-m}(x) \tag{5}$$

Furthermore, the inverse transform from the function $F_n^m$ obtained by the spherical harmonic transform into the function f(θ, φ) on the spherical coordinates is as shown in the following Expression (6).

[Expression 6]

$$f(\theta, \phi) = \sum_{n=0}^{\infty}\sum_{m=-n}^{n} F_n^m Y_n^m(\theta, \phi) \tag{6}$$

From the above, the transform from the input signal $D'n^m(\omega)$ of the sound after the correction in the radial direction, which is kept in the spherical harmonic domain, into a speaker drive signal $S(x_i, \omega)$ of each of L number of speakers arranged on the spherical surface of the radius R is as shown in the following Expression (7).

[Expression 7]

$$S(x_i, \omega) = \sum_{n=0}^{N}\sum_{m=-n}^{n} D_n'^m(\omega)Y_n^m(\beta_i, \alpha_i) \tag{7}$$

Note that, in Expression (7), $x_i$ is the position of the speaker, and ω is the time-frequency of the sound signal. The input signal $D'_n{}^m(\omega)$ is an audio signal corresponding to each degree n and degree m of the spherical harmonics for the predetermined time-frequency ω.

In addition, $x_i$=(R sin $\beta_i$ cos $\alpha_i$, R sin $\beta_i$ sin $\alpha_i$, R cos $\beta_i$), and i is the speaker index for specifying the speaker. Herein, i=1, 2, . . . , L, and $\beta_i$ and $\alpha_i$ are the elevation angle and the horizontal angle indicating the position of the i-th speaker, respectively.

Such transform shown by Expression (7) is the spherical harmonic inverse transform for Expression (6). In addition, in a case of obtaining the speaker drive signal $S(x_i, \omega)$ according to Expression (7), the L number of speakers, which is the number of regenerating speakers, and the degree N of the spherical harmonics, that is, the maximum value N of the degree n must meet the relationship shown by the following Expression (8).

[Expression 8]

$$L > (N+1)^2 \tag{8}$$

Incidentally, a general technique for simulating stereophony at the ears by headphone presentation is, for example, a method using head-related transfer functions as shown in FIG. 1.

In the example shown in FIG. 1, an inputted Ambisonic signal is decoded, and a speaker drive signal of each of virtual speakers SP11-1 to SP11-8, which are a plurality of virtual speakers, is generated. The signal decoded at this time corresponds to, for example, the aforementioned input signal $D'_n{}^m(\omega)$.

Herein, each of the virtual speakers SP11-1 to virtual speakers SP11-8 is annularly disposed and virtually arranged, and the speaker drive signal of each of the virtual speakers is obtained by the calculation of the aforementioned Expression (7). Note that the virtual speakers are simply referred to as the virtual speakers SP11 hereinafter in a case where it is unnecessary to particularly distinguish the virtual speakers SP11-1 to SP11-8.

When the speaker drive signals of the respective virtual speakers SP11 are thus obtained, for each of the virtual speakers SP11, the left and right drive signals (binaural signals) of headphones HD11 which actually reproduce the sound are generated by the convolution operation using the head-related transfer functions. Then, the sum of each of the drive signals of the headphones HD 11 obtained for each of the virtual speakers SP11 is the final drive signal.

Note that such a technique is described in detail in, for example, "ADVANCED SYSTEM OPTIONS FOR BINAURAL RENDERING OF AMBISONIC FORMAT (Gerald Enzner et. al. ICASSP 2013)" and the like.

The head-related transfer function $H(x, \omega)$ used to generate the left and right drive signals of the headphones HD11 is obtained by normalizing the transfer characteristic $H_1(X, \omega)$ from the sound source position x in the state in which the head of the user, who is a listener, exists in the free space to the positions of the eardrums of the user by the transfer characteristic $H_0(x, \omega)$ from the sound source position x in the state in which the head does not exit to the head center O. That is, the head-related transfer function $H(x, \omega)$ for the sound source position x is obtained by the following Expression (9).

[Expression 9]

$$H(x, \omega) = \frac{H_1(x, \omega)}{H_0(x, \omega)} \tag{9}$$

Herein, by convolving the head-related transfer function $H(x, \omega)$ with an arbitrary audio signal and presenting the result by headphones or the like, an illusion as if the sound is heard from the direction of the head-related transfer function $H(x, \omega)$ convolved, that is, the direction of the sound source position x can be given to the listener.

In the example shown in FIG. 1, such a principle is used to generate the left and right drive signals of the headphones HD11.

Specifically, the position of each of the virtual speakers SP11 is set as a position $x_i$, and the speaker drive signals of these virtual speakers SP11 are set as $S(x_i, \omega)$.

In addition, the number of virtual speakers SP11 is set as L (herein, L=8), and the final left and right drive signals of the headphones HD11 are set as $P_l$ and $P_r$, respectively.

In this case, when the speaker drive signals $S(x_i, \omega)$ are simulated by the presentation of the headphones HD11, the left and right drive signals $P_l$ and $P_r$ of the headphones HD11 can be obtained by calculating the following Expression (10).

[Expression 10]

$$P_l = \sum_{i=1}^{L} S(x_i, \omega) H_l(x_i, \omega) \tag{10}$$

$$P_r = \sum_{i=1}^{L} S(x_i, \omega) H_r(x_i, \omega)$$

Note that, in Expression (10), $H_l(x_i, \omega)$ and $H_r(x_i, \omega)$ are the normalized head-related transfer functions from the position $x_i$ of the virtual speakers SP11 to the left and right eardrum positions of the listener, respectively.

By such operation, it is possible to reproduce the input signal $D'_n{}^m(\omega)$ of the spherical harmonic domain finally by the headphone presentation. That is, it is possible to realize, by the headphone presentation, the same effect as Ambisonics.

Figure 2:
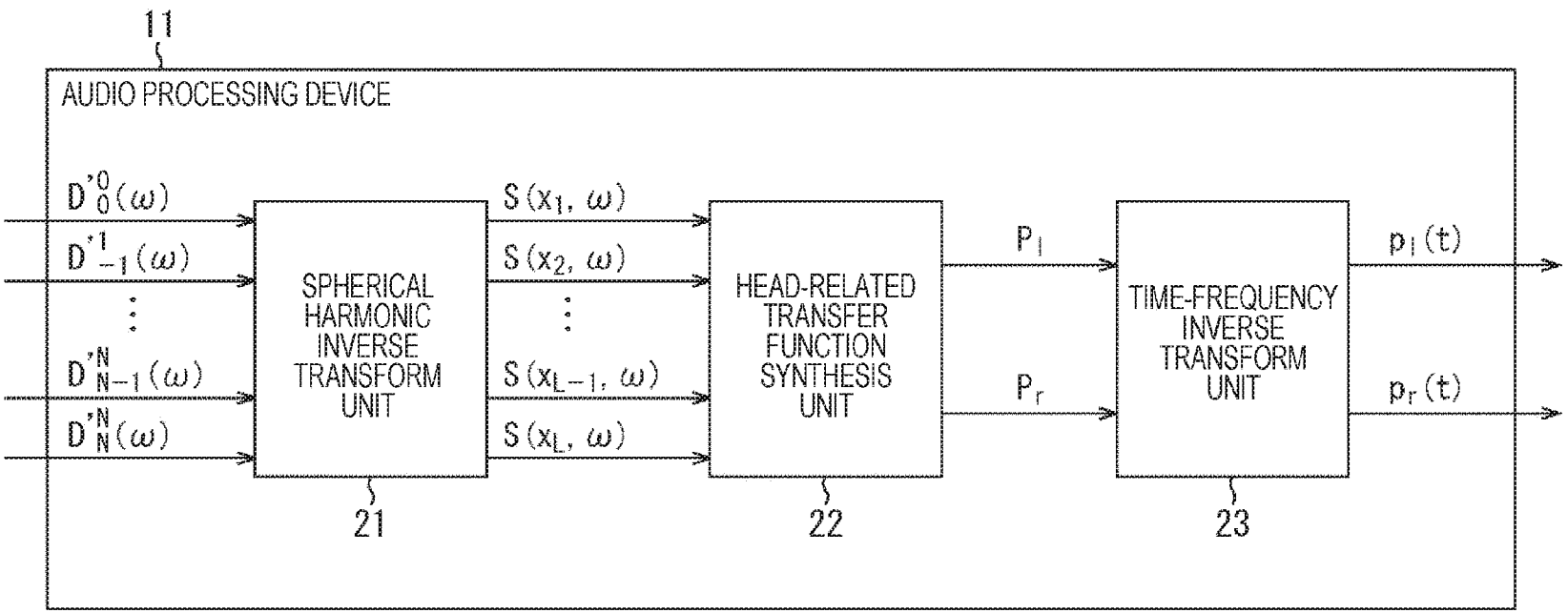
FIG. 2 is a diagram showing the configuration of a general audio processing device.

An audio processing device, which generates the left and right drive signals of the headphones from the input signal by a general technique combining Ambisonics and a binaural reproduction technology as described above (hereinafter also referred to as the general technique), has the configuration as shown in FIG. 2.

That is, an audio processing device 11 shown in FIG. 2 includes a spherical harmonic inverse transform unit 21, a head-related transfer function synthesis unit 22, and a time-frequency inverse transform unit 23.

The spherical harmonic inverse transform unit 21 performs the spherical harmonic inverse transform on the inputted input signal $D'_n{}^m(\omega)$ by calculating Expression (7) and supplies the speaker drive signals $S(x_i, \omega)$ of the virtual speakers SP11 obtained as a result to the head-related transfer function synthesis unit 22.

The head-related transfer function synthesis unit 22 generates the left drive signal $P_l$ and the right drive signal $P_r$ of the headphones HD11 by Expression (10) from the speaker drive signals $S(x_i, \omega)$ from the spherical harmonic inverse transform unit 21 and the head-related transfer function $H_l(x_i, \omega)$ and the head-related transfer function $H_r(x_i, \omega)$, which are prepared in advance, and outputs the drive signals $P_l$ and $P_r$.

Moreover, the time-frequency inverse transform unit 23 performs time-frequency inverse transform on the drive signal $P_l$ and the drive signal $P_r$, which are signals in the time-frequency domain outputted from the head-related transfer function synthesis unit 22 and supplies the drive signal $p_l(t)$ and the drive signal $p_r(t)$, which are signals in the time domain and obtained as a result, to the headphones HD11 to reproduce the sound.

Note that, hereinafter, in a case where it is unnecessary to particularly distinguish the drive signal $P_l$ and the drive signal $P_r$ for the time-frequency $\omega$, they are also simply referred to as drive signals $P(\omega)$, and in a case where it is unnecessary to particularly distinguish the drive signal $p_l(t)$ and the drive signal $p_r(t)$, they are also simply referred to as drive signals $p(t)$. In addition, in a case where it is unnecessary to particularly distinguish the head-related transfer function $H_l(x_i, \omega)$ and the head related-transfer function $H_r(x_i, \omega)$, they are also simply referred to as head-related transfer functions $H(x_i, \omega)$.

Figure 3:
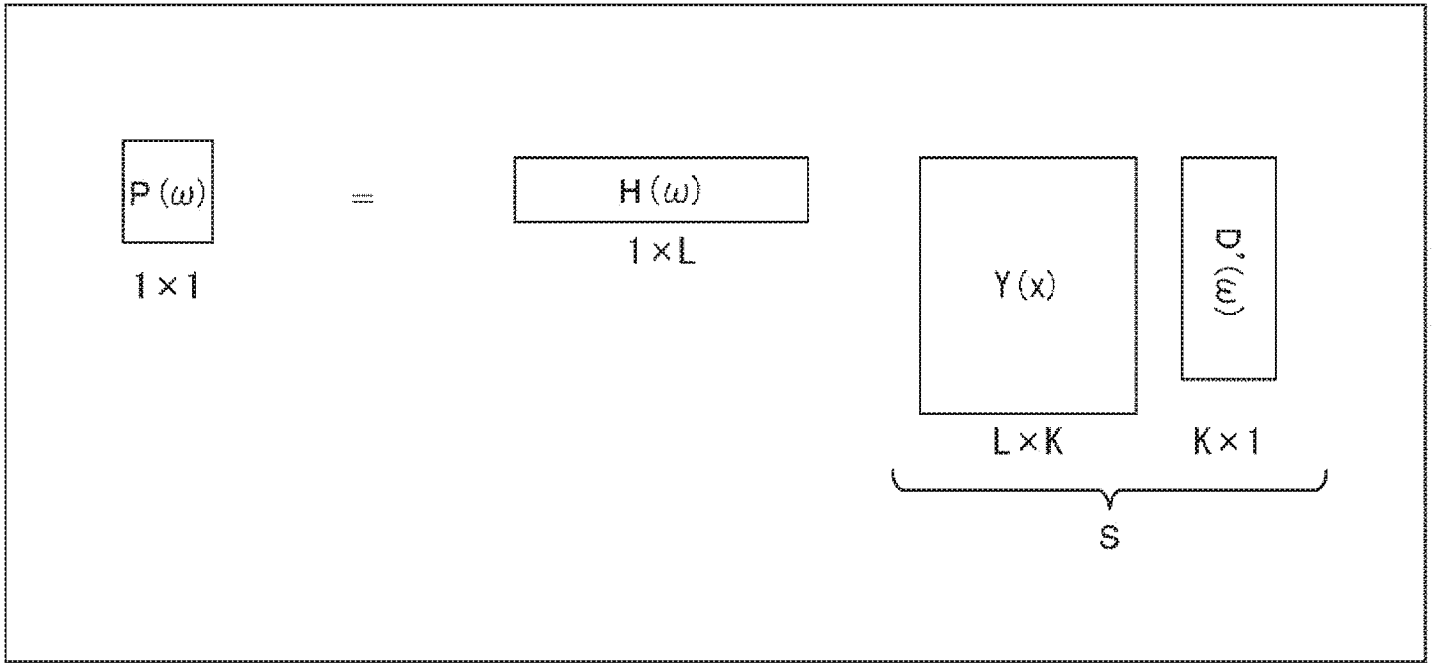
FIG. 3 is a diagram for explaining the computation of a drive signal by a general technique.

In the audio processing device 11, for example, the operation shown in FIG. 3 is performed in order to obtain the drive signals $P(\omega)$ of 1×1, that is, one row and one column.

In FIG. 3, $H(\omega)$ is a vector (matrix) of 1×L including the L number of head-related transfer functions $H(x_i, \omega)$. In addition, $D'(\omega)$ is a vector including the input signals $D'_n{}^m(\omega)$, and suppose that the number of input signals $D'_n{}^m(\omega)$ of bins of the same time-frequency $\omega$ is K, then the vector $D'(\omega)$ becomes K×1. Moreover, $Y(x)$ is a matrix including spherical harmonics $Y_n{}^m(\beta_i, \alpha_i)$ of each degree, and the matrix $Y(x)$ becomes a matrix of L×K.

Therefore, in the audio processing device 11, a matrix (vector) S obtained from the matrix operation of the matrix $Y(x)$ of L×K and the vector $D'(\omega)$ of K×1 is obtained, and further, the matrix operation of the matrix S and a vector (matrix) $H(\omega)$ of 1×L is performed to obtain one drive signal $P(\omega)$.

In addition, in a case where the head of the listener wearing the headphones HD11 rotates in a predetermined direction expressed by a rotation matrix $g_j$ (hereinafter also referred to as a direction $g_j$), for example, the drive signal $P_l(g_j, \omega)$ of the left headphone of the headphones HD11 is as shown in the following Expression (11).

[Expression 11]

$$P_l(g_j, \omega) = \sum_{i=1}^{L} S(x_i, \omega) H_l(g_j^{-1} x_i, \omega) \tag{11}$$

Note that the rotation matrix $g_j$ is a three-dimensional rotation matrix expressed by $\varphi$, $\theta$, and $\psi$, which are rotation angles of the Euler angle, that is, a rotation matrix of 3×3. In addition, in Expression (11), the drive signal $P_l(g_j, \omega)$ is the aforementioned drive signal $P_l$ and written as the drive signal $P_l(g_j, \omega)$ herein to clarify the position, that is, the direction $g_j$ and the time-frequency $\omega$.

Figure 4:
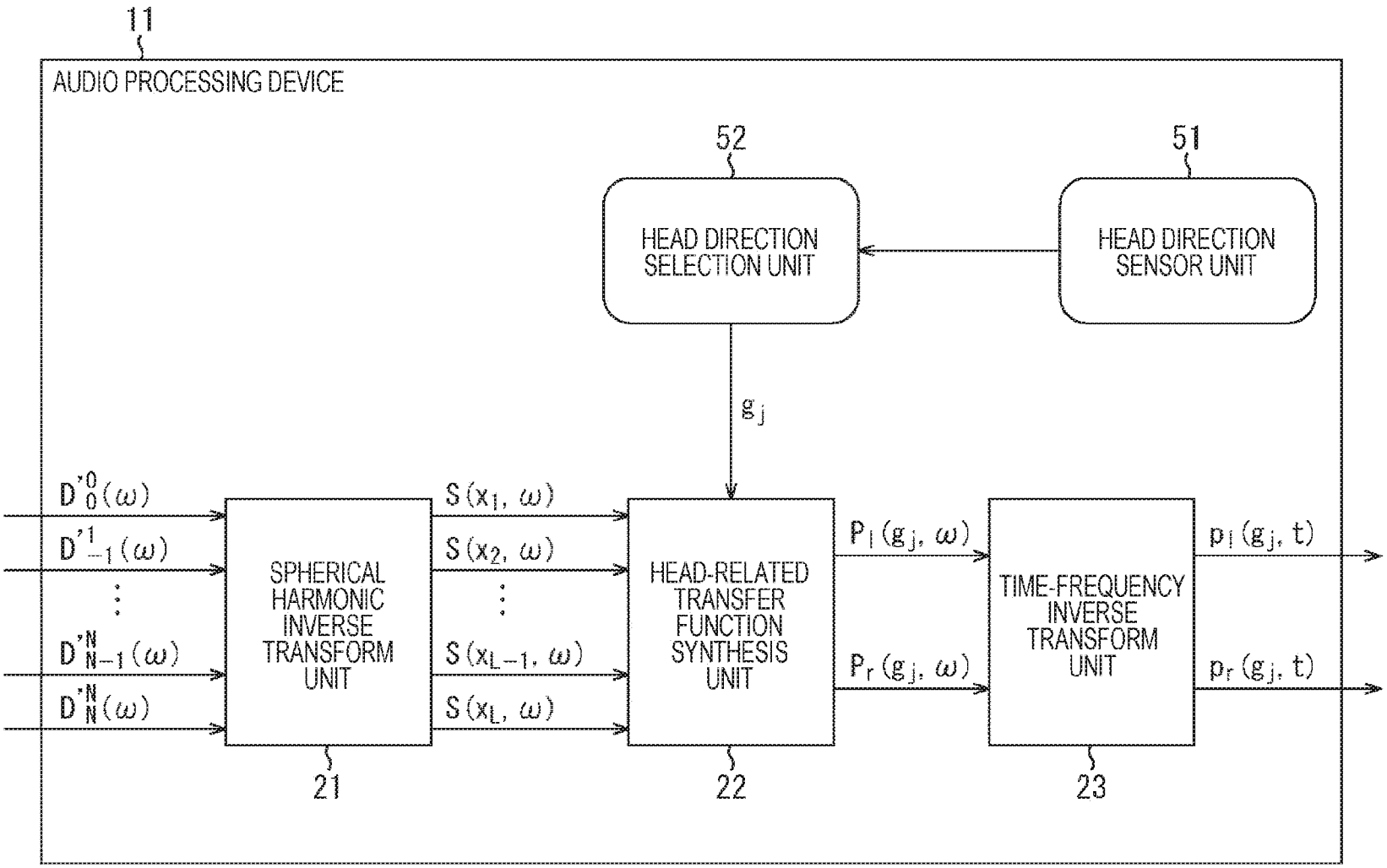
FIG. 4 is a diagram showing the configuration of an audio processing device to which a head tracking function is added.

By further adding, for example, the configuration for specifying the rotation direction of the head of the listener as shown in FIG. 4, that is, the configuration of the head tracking function to the general audio processing device 11, the sound image position viewed from the listener can be fixed in the space. Note that parts in FIG. 4 corresponding to those in FIG. 2 are denoted by the same reference signs, and the descriptions thereof will be omitted as appropriate.

In an audio processing device 11 shown in FIG. 4, the configuration shown in FIG. 2 is further provided with a head direction sensor unit 51 and a head direction selection unit 52.

The head direction sensor unit 51 detects the rotation of the head of the user, who is a listener, and supplies the detection result to the head direction selection unit 52. On the basis of the detection result from the head direction sensor unit 51, the head direction selection unit 52 obtains the rotation direction of the head of the listener, that is, the direction of the head of the listener after the rotation as the direction $g_j$ and supplies the direction $g_j$ to the head-related transfer function synthesis unit 22.

In this case, on the basis of the direction $g_j$ supplied from the head direction selection unit 52, the head-related transfer function synthesis unit 22 computes the left and right drive signals of the headphones HD11 by using the head-related transfer function of the relative direction $g_j^{-1}x_i$ of each of the virtual speakers SP11 viewed from the head of the listener from among a plurality of head-related transfer functions prepared in advance. Thus, similarly to the case of using the real speakers, even in the case of reproducing the sound by the headphones HD11, it is possible to fix the sound image position viewed from the listener in the space.

By generating the drive signals of the headphones by the general technique or the technique adding the head tracking function to the general technique described above, the same effects as Ambisonics can be obtained without using the speaker array and without limiting the range of reproducing the sound space. However, with these techniques, not only the operation amount, such as the convolution operation of the head-related transfer function, increases, but also the usage amount of the memory used for the operation and the like increases.

Thereupon, in the present technology, the convolution of the head-related transfer functions performed in the time-frequency domain by the general technique is performed in the spherical harmonic domain. As a result, it is possible to reduce the operation amount of the convolution and the necessary memory amount and to reproduce the sound more efficiently.

Hereinafter, the techniques according to the present technology will be described.

For example, paying attention to the left headphone, the vector $P_l(\omega)$ including each drive signal $P_l(g_j, \omega)$ of the left headphone for the full rotation direction of the head of the user (listener), who is a listener, is expressed as shown in the following Expression (12).

[Expression 12]

$$\begin{aligned} P_1(\omega) &= H(\omega)S(\omega) \\ &= H(\omega)Y(x)D'(\omega) \end{aligned} \tag{12}$$

Note that, in Expression (12), $S(\omega)$ is the vector including the speaker drive signal $S(x_i, \omega)$, and $S(\omega)=Y(x)D'(\omega)$. In addition, in Expression (12), $Y(x)$ is a matrix including each degree and the spherical harmonics $Y_n{}^m(x_i)$ of the position $x_i$ of each virtual speaker as shown in the following Expression (13). Herein, i=1, 2, . . . , L, and the maximum value (maximum degree) of the degree n is N.

$D'(\omega)$ is a vector (matrix) including the input signal $D'_n{}^m(\omega)$ of the sound corresponding to each degree as shown in the following Expression (14). Each input signal $D'_n{}^m(\omega)$ is a signal of a spherical harmonic domain.

Moreover, in Expression (12), $H(\omega)$ is a matrix including the head-related transfer function $H(g_j^{-1}x_i, \omega)$ of the relative direction $g_j^{-1}x_i$ of each of the virtual speakers viewed from the head of the listener as shown in the following Expression (15) in a case where the direction of the head of the listener is the direction $g_j$. In this example, the head-related transfer function $H(g_j^{-1}x_i, \omega)$ of each of the virtual speakers is prepared for each direction of the total M number of directions $g_1$ to $g_M$.

[Expression 13]

$$Y(x) = \begin{pmatrix} Y_0^0(x_1) & \cdots & Y_N^N(x_1) \\ \vdots & \ddots & \vdots \\ Y_0^0(x_L) & \cdots & Y_N^N(x_L) \end{pmatrix} \quad (13)$$

[Expression 14]

$$D'(\omega) = \begin{pmatrix} D_0'^0(\omega) \\ \vdots \\ D_N'^N(\omega) \end{pmatrix} \quad (14)$$

[Expression 15]

$$H(\omega) = \begin{pmatrix} H(g_1^{-1}x_1, \omega) & \cdots & H(g_1^{-1}x_L, \omega) \\ \vdots & \ddots & \vdots \\ H(g_M^{-1}x_1, \omega) & \cdots & H(g_M^{-1}x_L, \omega) \end{pmatrix} \quad (15)$$

To compute the drive signal $P_l(g_j, \omega)$ of the left headphone when the head of the listener is directed in the direction $g_j$, the row corresponding to the direction $g_j$, which is the direction of the head of the listener, that is, the row including the head-related transfer function $H(g_j^{-1}x_i, \omega)$ for that direction $g_j$ should be selected from the matrix $H(\omega)$ of the head-related transfer functions to perform the calculation of Expression (12).

Figure 5:
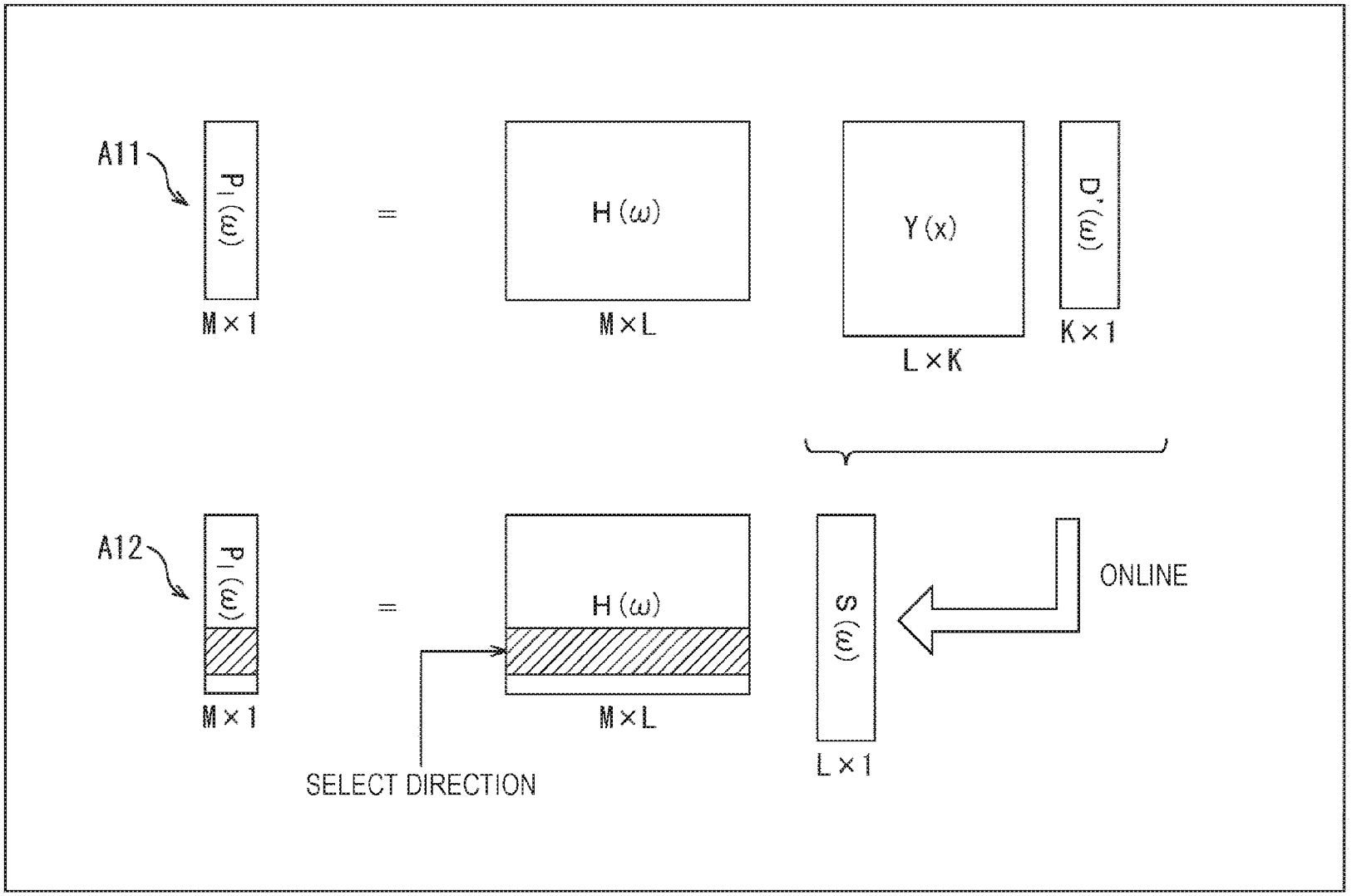
FIG. 5 is a diagram for explaining the computation of a drive signal in a case where the head tracking function is added.

In this case, for example, only necessary rows are calculated as shown in FIG. 5.

In this example, since the head-related transfer function is prepared for each of the M number of directions, the matrix calculation shown in Expression (12) is as shown by the arrow A11.

That is, suppose that the number of input signals $D'_n{}^m(\omega)$ of the time-frequency $\omega$ is K, the vector $D'(\omega)$ is a matrix of K×1, that is, K rows and one column. In addition, the matrix Y(x) of the spherical harmonics is L×K, and the matrix $H(\omega)$ is M×L. Therefore, in the calculation of Expression (12), the vector $P_l(\omega)$ is M×1.

Herein, by performing matrix operation (product-sum operation) of the matrix Y(x) and the vector $D'(\omega)$ in online operation first to obtain the vector $S(\omega)$, at the time of the computing the drive signal $P_l(g_j, \omega)$, it is possible to select the row corresponding to the direction $g_j$ of the head of the listener in the matrix $H(\omega)$ as shown by the arrow A12 and reduce the operation amount. In FIG. 5, the hatched portion in the matrix $H(\omega)$ is the row corresponding to the direction $g_j$, the operation of this row and the vector $S(\omega)$ is performed, and the desired drive signal $P_l(g_j, \omega)$ of the left headphone is computed.

Herein, when the matrix $H'(\omega)$ is defined as shown in the following Expression (16), the vector PIN) shown in Expression (12) can be expressed by the following Expression (17).

[Expression 16]

$$H'(\omega)=H(\omega)Y(x) \quad (16)$$

[Expression 17]

$$P_l(\omega)=H'(\omega)D'(\omega) \quad (17)$$

In Expression (16), the head-related transfer function, more specifically, the matrix $H(\omega)$ including the head-related transfer function in the time-frequency domain, is transformed by the spherical harmonic transform using the spherical harmonics into the matrix $H'(\omega)$ including the head-related transfer function in the spherical harmonic domain.

Therefore, in the calculation of Expression (17), convolution of the speaker drive signal and the head-related transfer function is performed in the spherical harmonic domain. In other words, in the spherical harmonic domain, the product-sum operation of the head-related transfer function and the input signal is performed. Note that the matrix $H'(\omega)$ can be calculated and kept in advance.

In this case, to compute the drive signal $P_l(g_j, \omega)$ of the left headphone when the head of the listener is directed in the direction $g_j$, only the row corresponding to the direction $g_j$ of the head of the listener is selected from the matrix $H'(\omega)$ kept in advance to calculate Expression (17).

In such a case, the calculation of Expression (17) is calculation shown in the following Expression (18). Thus, it is possible to greatly reduce the operation amount and the necessary memory amount.

[Expression 18]

$$P_l(g_j, \omega) = \sum_{n=0}^{N} \sum_{m=-n}^{n} H_n'^m(g_j, \omega) D_n'^m(\omega) \quad (18)$$

In Expression (18), $H'_n{}^m(g_j, \omega)$ is one element of the matrix $H'(\omega)$, that is, a head-related transfer function in the spherical harmonic domain, which is a component (element) corresponding to the direction $g_j$ of the head in the matrix $H'(\omega)$. n and m in the head-related transfer function $H'_n{}^m(g_j, \omega)$ are the degree n and the degree m of the spherical harmonics.

Figure 6:
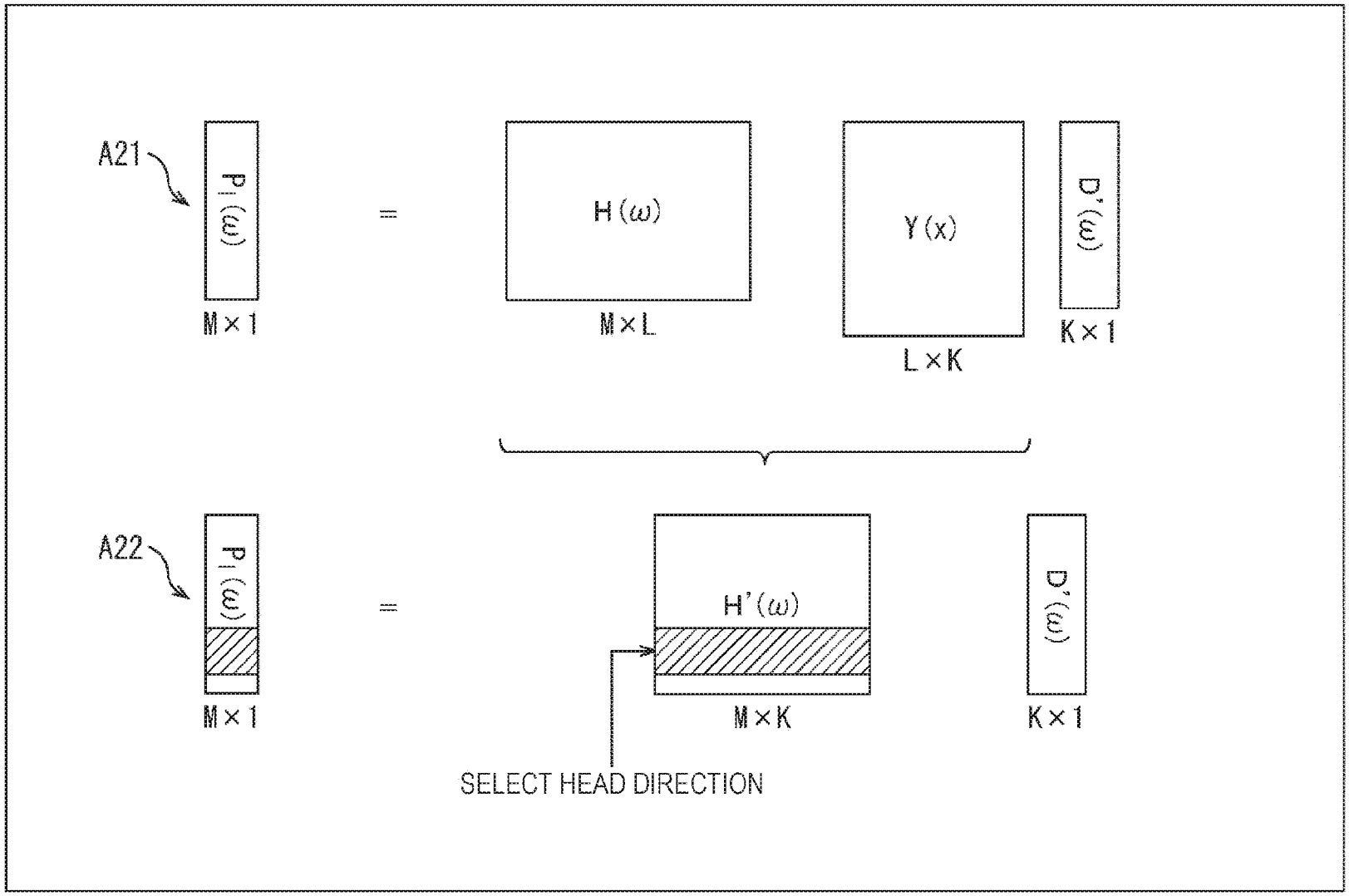
FIG. 6 is a diagram for explaining the computation of a drive signal by a first proposed technique.

In such operation shown in Expression (18), the operation amount is reduced as shown in FIG. 6. That is, the calculation shown in Expression (12) is calculation to obtain a product of the matrix $H(\omega)$ of M×L, the matrix Y(x) of L×K, and the vector $D'(\omega)$ of K×1 as indicated by the arrow A21 in FIG. 6.

Herein, since $H(\omega)Y(x)$ is the matrix $H'(\omega)$ as defined in Expression (16), the calculation indicated by the arrow A21 eventually becomes as indicated by the arrow A22. In particular, since the calculation for obtaining the matrix $H'(\omega)$ can be performed offline, that is, in advance, if the matrix $H'(\omega)$ is obtained and kept in advance, it is possible to reduce the operation amount for obtaining the drive signals of the headphones online by that amount.

When the matrix $H'(\omega)$ is thus obtained in advance, the calculation indicated by the arrow A22, that is, the calculation of the aforementioned Expression (18) is performed to actually obtain the drive signals of the headphones.

That is, as indicated by the arrow A22, the row corresponding to the direction $g_j$ of the head of the listener in the matrix $H'(\omega)$ is selected, and the drive signal $P_l(g_j, \omega)$ of the left headphone is computed by the matrix operation of that selected row and the vector $D'(\omega)$ including the inputted input signal $D'_n{}^m(\omega)$. In FIG. 6, the hatched portion in the matrix $H'(\omega)$ is the row corresponding to the direction $g_j$, and the elements constituting this row are the head-related transfer functions $H'_n{}^m(g_j, \omega)$ shown in Expression (18).

<About Reduction of Operation Amount and the Like According to Present Technology>

Herein, referring to FIG. 7, the product-sum amounts and the necessary memory amounts are compared between the technique according to the present technology described above (hereinafter also referred to as a first proposed technique) and the general technique.

For example, suppose that the length of the vector D'(ω) is K and the matrix H(ω) of the head-related transfer function is M×L, then the matrix Y(x) of the spherical harmonics is L×K and the matrix H'(ω) is M×K. In addition, the number of time-frequency bins ω is W.

Herein, in the general technique, as indicated by the arrow A31 in FIG. 7, in the process of transforming the vector D'(ω) into the time-frequency domain for a bin of each time-frequency ω (hereinafter also referred to as time-frequency bin ω), the product-sum operation of L×K occurs, and the product-sum operation by 2 L occurs by the convolution with the left and right head-related transfer functions.

Therefore, the total calc/W of the number of product-sum operations per time-frequency bin ω in the general technique is calc/W=(L×K+2 L).

Figure 7:
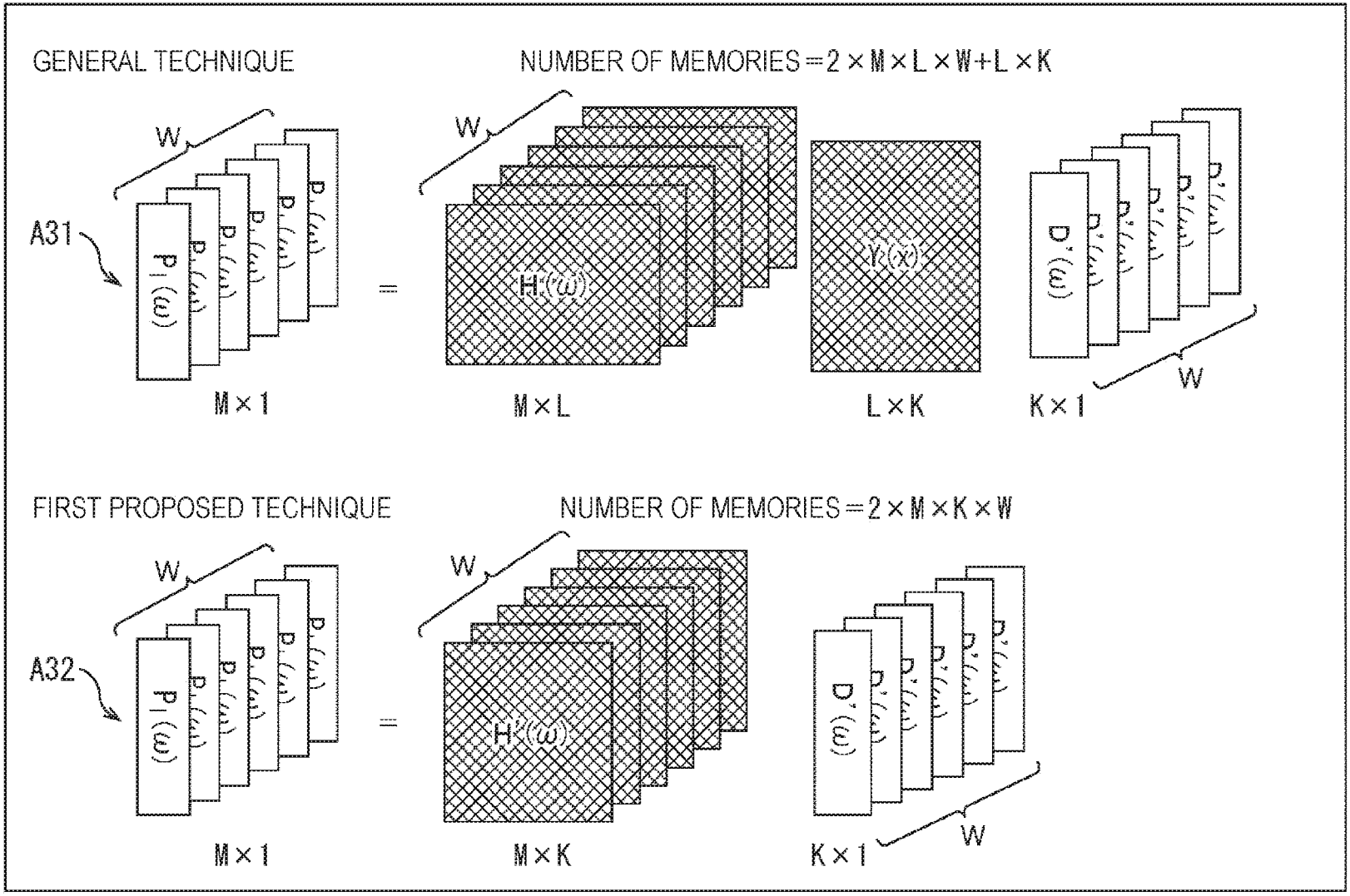
FIG. 7 is a diagram for explaining the operations at the time of computing the drive signals by the first proposed technique and the general technique.

Moreover, suppose that each coefficient of the product-sum operation is one byte, then the memory amount necessary for the operation by the general technique is (the number of directions of the head-related transfer functions to be kept)×two bytes for each time-frequency bin ω, and the number of directions of the head-related transfer functions to be kept is M×L as indicated by the arrow A31 in FIG. 7. Furthermore, a memory is necessary by L×K bytes for the matrix Y(x) of the spherical harmonics common to all the time-frequency bins co.

Therefore, suppose that the number of time-frequency bins ω is W, then the necessary memory amount memory in the general technique is memory=(2×M×L×W+L×K) bytes in total.

On the other hand, in the first proposed technique, the operation indicated by the arrow A32 in FIG. 7 is performed for each time-frequency bin ω.

That is, in the first proposed technique, for each time-frequency bin ω, the product-sum operation by K occurs by the product-sum of the vector D'(ω) in the spherical harmonic domain and the matrix H'(ω) of the head-related transfer function per one ear.

Therefore, the total calc/W of the number of product-sum operations in the first proposed technique is calc/W=2K.

In addition, since the memory amount necessary for the operation according to the first proposed technique is necessary by the amount to keep the matrix H'(ω) of the head-related transfer function for each time-frequency bin ω, the memory is necessary by M×K bytes for the matrix H'(ω).

Therefore, suppose that the number of time-frequency bins ω is W, then the necessary memory amount memory in the first proposed technique is memory=(2 MKW) bytes in total.

Suppose that the maximum degree of the spherical harmonics is four, $K=(4+1)^2=25$. In addition, since the L number of virtual speakers must to be greater than K, suppose that L=32.

In such a case, the product-sum operation amount of the general technique is calc/W=(32×25+2×32)=864, whereas the product-sum operation amount of the first proposed technique is only calc/W=2×25=50. Thus, it can be seen that the operation amount is greatly reduced.

Moreover, suppose that, for example, W=100 and M=1000, then the memory amount necessary for the operation in the general technique is memory=(2×1000×32×100+32×25)=6400800. On the other hand, the memory amount necessary for the operation of the first proposed technique is memory=(2 MKW)=2×1000×25×100=5000000. Thus, it can be seen that the necessary memory amount is greatly reduced.

<Configuration Example of Audio Processing Device>

Figure 8:
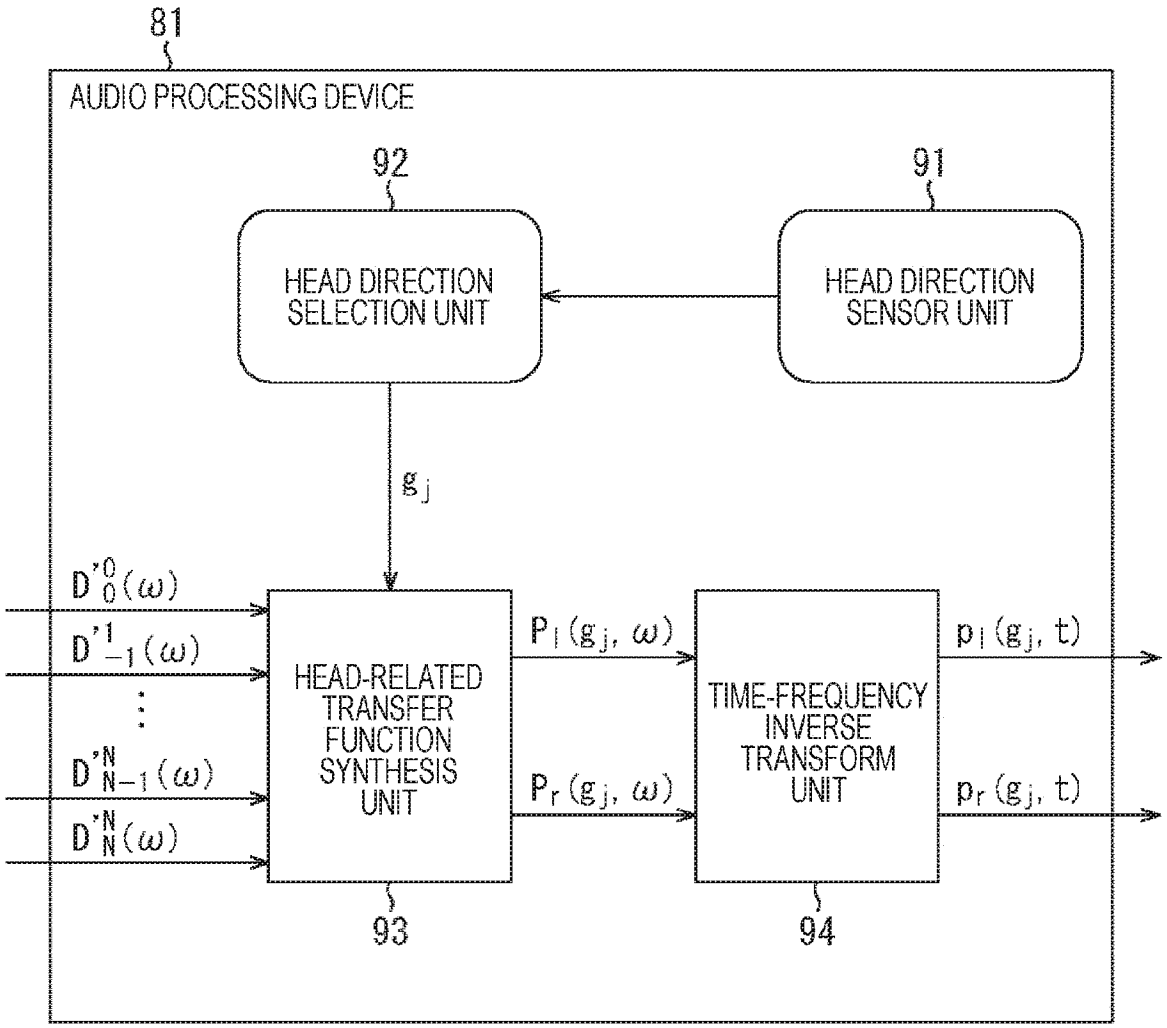
FIG. 8 is a diagram showing a configuration example of an audio processing device to which the present technology is applied.

Next, an audio processing device to which the present technology described above is applied will be described. FIG. 8 is a diagram showing a configuration example of the audio processing device according to one embodiment to which the present technology is applied.

An audio processing device 81 shown in FIG. 8 has a head direction sensor unit 91, a head direction selection unit 92, a head-related transfer function synthesis unit 93, and a time-frequency inverse transform unit 94. Note that the audio processing device 81 may be incorporated in the headphones or may be a device different from the headphones.

The head direction sensor unit 91 includes, for example, an acceleration sensor, an image sensor, and the like attached to the head of the user as necessary, detects the rotation (motion) of the head of the user who is a listener, and supplies the detection result to the head direction selection unit 92. Note that the user herein is a user wearing the headphones, that is, a user who listens to the sound reproduced by the headphones on the basis of the drive signals of the left and right headphones obtained by the time-frequency inverse transform unit 94.

On the basis of the detection result from the head direction sensor unit 91, the head direction selection unit 92 obtains the rotation direction of the head of the listener, that is, the direction $g_j$ of the head of the listener after the rotation and supplies the direction $g_j$ to the head-related transfer function synthesis unit 93. In other words, the head direction selection unit 92 acquires the direction $g_j$ of the head of the user by acquiring the detection result from the head direction sensor unit 91.

An input signal $D'_n{}^m(\omega)$ of each degree of spherical harmonics for each time-frequency bin ω, which is an audio signal in the spherical harmonic domain, is supplied to the head-related transfer function synthesis unit 93 from the outside. Moreover, the head-related transfer function synthesis unit 93 keeps the matrix H'(ω) including the head-related transfer function obtained in advance by calculation.

The head-related transfer function synthesis unit 93 performs the convolution operation of the supplied input signal $D'_n{}^m(\omega)$ and the kept matrix H'(ω) for each of the left and right headphones to synthesize the input signal $D'_n{}^m(\omega)$ and the head-related transfer function in the spherical harmonic domain and compute the drive signal $P_l(g_j, \omega)$ and the drive signal $P_r(g_j, \omega)$ of the left and right headphones. At this time, the head-related transfer function synthesis unit 93 selects the row corresponding to the direction $g_j$ in the matrix H'(ω) supplied from the head direction selection unit 92, that is, for example, the row including the head-related transfer function $H'_n{}^m(g_j, \omega)$ of the aforementioned Expression (18) and performs the convolution operation with the input signal $D'_n{}^m(\omega)$.

By such operation, in the head-related transfer function synthesis unit 93, the drive signal $P_l(g_j, \omega)$ of the left headphone in the time-frequency domain and the drive signal $P_r(g_j, \omega)$ of the right headphone in the time-frequency domain are obtained for each time-frequency bin ω.

The head-related transfer function synthesis unit 93 supplies the drive signal $P_l(g_j, \omega)$ and the drive signal $P_r(g_j, \omega)$ of the left and right headphones obtained to the time-frequency inverse transform unit 94.

The time-frequency inverse transform unit 94 performs the time-frequency inverse transform on the drive signal in the time-frequency domain supplied from the head-related transfer function synthesis unit 93 for each of the left and right headphones to obtain the drive signal $p_l(g_j, t)$ of the left headphone in the time domain and the drive signal $p_r(g_j, t)$ of the right headphone in the time domain and outputs these drive signals to the subsequent part. In the subsequent reproduction device which reproduces the sound by 2 ch, such as headphones, more specifically, headphones including earphones, the sound is reproduced on the basis of the drive signals outputted from the time-frequency inverse transform unit 94.

<Explanation of Drive Signal Generation Processing>

Next, with reference to the flowchart in FIG. 9, the drive signal generation processing performed by the audio processing device 81 will be described. This drive signal generation processing is started when the input signal $D'_n{}^m(\omega)$ is supplied from the outside.

In step S11, the head direction sensor unit 91 detects the rotation of the head of the user, who is a listener, and supplies the detection result to the head direction selection unit 92.

In step S12, on the basis of the detection result from the head direction sensor unit 91, the head direction selection unit 92 obtains the direction $g_j$ of the head of the listener and supplies the direction $g_j$ to the head-related transfer function synthesis unit 93.

In step S13, on the basis of the direction $g_j$ supplied from the head direction selection unit 92, the head-related transfer function synthesis unit 93 convolves the head-related transfer function $H'_n{}^m(g_j, \omega)$ constituting the matrix $H'(\omega)$ kept in advance with the supplied input signal $D'_n{}^m(\omega)$.

That is, the head-related transfer function synthesis unit 93 selects the row corresponding to the direction $g_j$ in the matrix $H'(\omega)$ kept in advance and calculates Expression (18) with the head-related transfer function $H'_n{}^m(g_j, \omega)$ constituting the selected row and the input signal $D'_n{}^m(\omega)$, thereby computing the drive signal $P_l(g_j, \omega)$ of the left headphone. In addition, the head-related transfer function synthesis unit 93 performs the operation for the right headphone similarly to the case of the left headphone and computes the drive signal $P_r(g_j, \omega)$ of the right headphone.

The head-related transfer function synthesis unit 93 supplies the drive signal $P_l(g_j, \omega)$ and the drive signal $P_r(g_j, \omega)$ of the left and right headphones thus obtained to the time-frequency inverse transform unit 94.

In step S14, the time-frequency inverse transform unit 94 performs the time-frequency inverse transform on the drive signal in the time-frequency domain supplied from the head-related transfer function synthesis unit 93 for each of the left and right headphones and computes the drive signal $p_l(g_j, t)$ of the left headphone and the drive signal $p_r(g_j, t)$ of the right headphone. For example, inverse discrete Fourier transform is performed as the time-frequency inverse transform.

The time-frequency inverse transform unit 94 outputs the drive signal $p_l(g_j, t)$ and the drive signal $p_r(g_j, t)$ in the time domain thus obtained to the left and right headphones, and the drive signal generation processing ends.

As described above, the audio processing device 81 convolves the head-related transfer functions with the input signals in the spherical harmonic domain and computes the drive signals of the left and right headphones.

By thus convolving the head-related transfer functions in the spherical harmonic domain, it is possible to greatly reduce the operation amount when the drive signals of the headphones are generated as well as to greatly reduce the memory amount necessary for the operation. In other words, it is possible to reproduce sound more efficiently.

Second Embodiment

<About Direction of Head>

Incidentally, in the first proposed technique described above, although it is possible to greatly reduce the operation amount and the necessary memory amount, it is necessary to keep in the memory all the rotation directions of the head of the listener, that is, the row corresponding to each direction $g_j$ as the matrix $H'(\omega)$ of the head-related transfer function.

Thereupon, a matrix (vector) including the head-related transfer function of the spherical harmonic domain for one direction $g_j$ may be set as $H_s(\omega)=H'(g_j)$, and only the matrix $H_s(\omega)$ including the row corresponding to the one direction $g_j$ of the matrix $H'(\omega)$ may be kept, and a rotation matrix $R'(g_j)$ for performing rotation corresponding to the head rotation of the listener in the spherical harmonic domain may be kept by the number of the plurality of directions $g_j$. Hereinafter, such a technique will be referred to as a second proposed technique of the present technology.

The rotation matrix $R'(g_j)$ of each direction $g_j$ is different from the matrix $H'(\omega)$ and has no time-frequency dependence. Therefore, it is possible to greatly reduce the memory amount as compared with making the matrix $H'(\omega)$ hold the component of the direction $g_j$ of the rotation of the head.

First, as shown in the following Expression (19), consider a product $H'(g_j^{-1}, \omega)$ of a row $H(g_j^{-1}x, \omega)$ corresponding to the predetermined direction $g_j$ of the matrix $H(\omega)$ and the matrix $Y(x)$ of the spherical harmonics.

[Expression 19]

$$H'(g_j^{-1},\omega)=H(g^{-1}x,\omega)Y(x) \tag{19}$$

In the aforementioned first proposed technique, the coordinates of the head-related transfer function used are rotated from x to $g_j^{-1}x$ for the direction $g_j$ of the rotation of the head of the listener. However, the same result can be obtained without changing the coordinates of the position x of the head-related transfer function and by rotating the coordinates of the spherical harmonics from x to $g_jx$. That is, the following Expression (20) is established.

[Expression 20]

$$H'(g_j^{-1},\omega)=H(g_j^{-1}x,\omega)Y(x)=H(x,\omega)Y(g_jx) \tag{20}$$

Moreover, the matrix $Y(g_jx)$ of the spherical harmonics is the product of the matrix $Y(x)$ and the rotation matrix $R'(g_j^{-1})$ and is as shown by the following Expression (21). Note that the rotation matrix $R'(g_j^{-1})$ is a matrix which rotates the coordinates by $g_j$ in the spherical harmonic domain.

[Expression 21]

$$Y(g_jx)=Y(x)R'(g_j^{-1}) \tag{21}$$

Herein, as for k and m belonging to the set Q shown in the following Expression (22), elements other than the elements in the k rows and m columns of the rotation matrix $R'(g_j)$ are zero.

[Expression 22]

$$Q=\{q|n^2+1\leq q\leq(n+1)^2, q,n\in\{0,1,2\ldots\}\} \tag{22}$$

Therefore, the spherical harmonics $Y_n{}^m(g_jx)$, which is an element of the matrix $Y(g_jx)$), can be expressed by the following Expression (23) using an element $R'^{(n)}_{k,m}(g_j)$ of the k rows and m columns of the rotation matrix $R'(g_j)$.

[Expression 23]

$$Y_n^m(g_j x) = \sum_{k=-n}^{n} Y_n^k(x) R'^{(n)}_{k,m}(g_j^{-1}) \tag{23}$$

Herein, the element $R'^{(n)}_{k,m}(g_j)$ is expressed by the following Expression (24).

[Expression 24]

$$R'^{(n)}_{k,m}(g_j) = e^{-jm\phi} r^{(n)}_{k,m}(\theta) e^{-jk\psi} \tag{24}$$

Note that, in Expression (24), θ, φ, and ψ are the rotation angles of the Euler angle of the rotation matrix, and $r^{(n)}_{k,m}(\theta)$ is as shown in the following Expression (25).

[Expression 25]

$$r^{(n)}_{k,m}(\theta) = \sqrt{\frac{(n+k)!(n-k)!}{(n+m)!(n-m)!}} \sum_{\sigma} \binom{n+m}{n-k-\sigma} \binom{n-m}{\sigma} (-1)^{n-k-\sigma} \left(\cos\frac{\theta}{2}\right)^{2\sigma+k+m} \left(\sin\frac{\theta}{2}\right)^{2n-2\sigma-k-m} \tag{25}$$

From the above, the binaural reproducing signal reflecting the rotation of the head of the listener by using the rotation matrix $R'(g_j^{-1})$, for example, the drive signal $P_l(g_j, \omega)$ of the left headphone can be obtained by calculating the following Expression (26). In addition, in a case where the left and right head-related transfer functions may be considered to be symmetric, by performing inversion using a matrix $R_{ref}$ making either the input signal $D'(\omega)$ or the matrix $Hs(\omega)$ of the left head-related transfer function flip horizontal as the pre-processing of Expression (26), it is possible to obtain the right headphone drive signal by only keeping the matrix $Hs(\omega)$ of the left head-related transfer function. However, a case where different left and right head-related transfer functions are necessary will be basically described hereinafter.

[Expression 26]

$$\begin{aligned} P_l(g_j, \omega) &= H(g_j^{-1}x, \omega) Y(X) D'(\omega) \\ &= H(x, \omega) Y(X) R'(g_j^{-1}) D'(\omega) \\ &= H_S(\omega) R'(g_j^{-1}) D'(\omega) \end{aligned} \tag{26}$$

In Expression (26), the drive signal $P_l(g_j, \omega)$ is obtained by synthesizing the matrix $H_s(\omega)$, which is the vector, the rotation matrix $R'(g_j^{-1})$, and the vector $D'(\omega)$.

Figure 10:
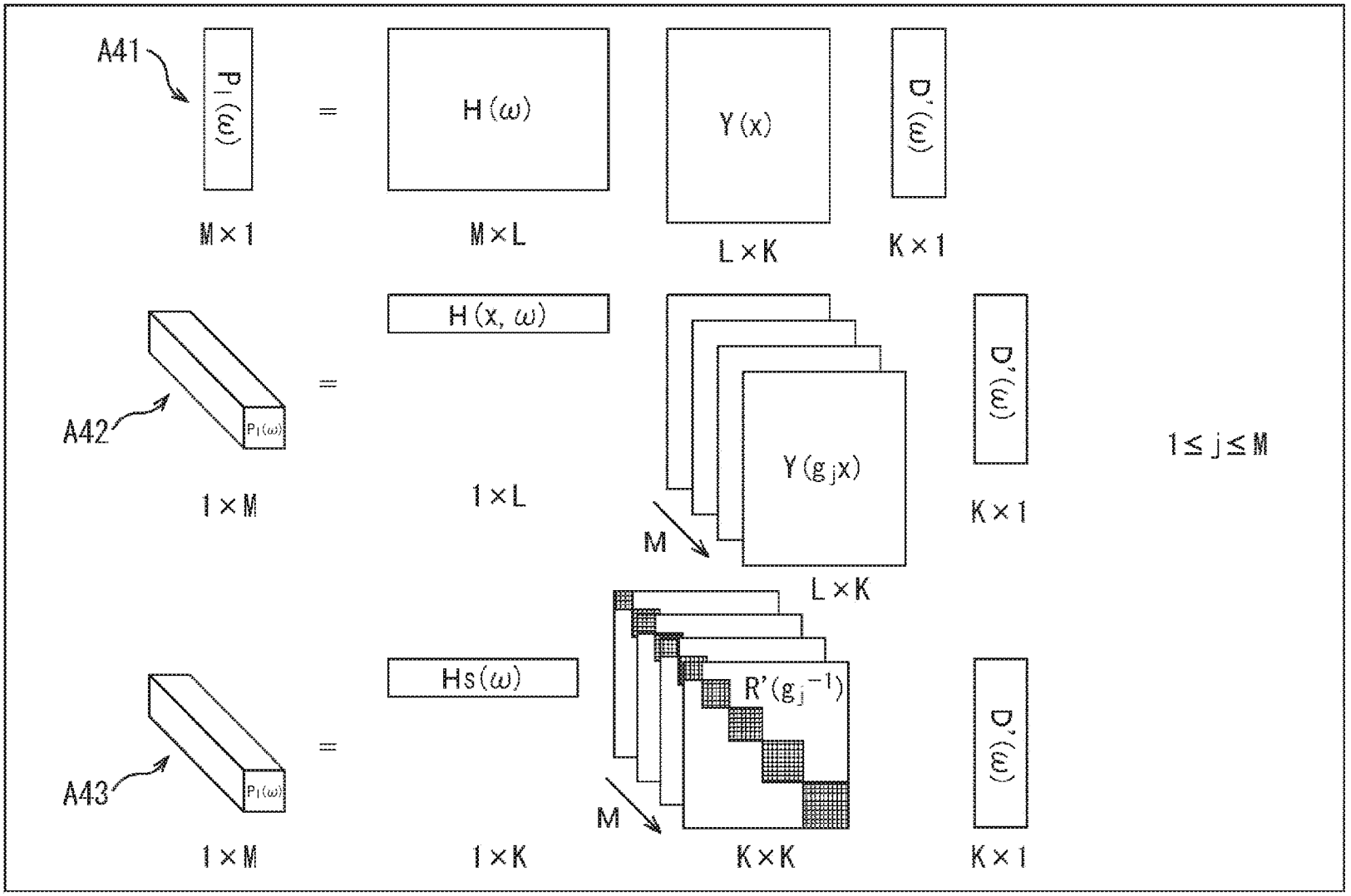
FIG. 10 is a diagram for explaining the computation of a drive signal by a second proposed technique

The calculation as described above is, for example, the calculation shown in FIG. 10. That is, the vector $P_l(\omega)$ including the drive signal $P_l(g_j, \omega)$ of the left headphone is obtained by the product of the matrix $H(\omega)$ of M×L, the matrix Y(x) of L×K, and the vector $D'(\omega)$ of K×1 as indicated by the arrow A41 in FIG. 10. This matrix operation is as shown in the aforementioned Expression (12).

This operation is expressed by using the matrix $Y(g_j x)$ of the spherical harmonics prepared for each of M number of directions $g_j$ as indicated by the arrow A42. That is, the vector $P_l(\omega)$ including the drive signal $P_l(g_j, \omega)$ corresponding to each of M number of directions $g_j$ is obtained by the product of the predetermined row $H(x, \omega)$ of the matrix $H(\omega)$, the matrix $Y(g_j x)$, and the vector $D'(\omega)$ from the relationship shown in Expression (20).

Herein, the row $H(x, \omega)$, which is the vector, is 1×L, the matrix $Y(g_j x)$ is L×K, and the vector $D'(\omega)$ is K×1. This is further transformed by using the relationships shown in Expressions (17) and (21) and is as indicated by the arrow A43. That is, as shown in Expression (26), the vector $P_l(\omega)$ is obtained by the product of the matrix $H_s(\omega)$ of 1×K, the rotation matrix $R'(g_j^{-1})$ of K×K of each of M number of directions $g_j$, and the vector $D'(\omega)$ of K×1.

Note that, in FIG. 10, the hatched portions of the rotation matrix $R'(g_j^{-1})$ are nonzero elements of the rotation matrix $R'(g_j^{-1})$.

Figure 11:
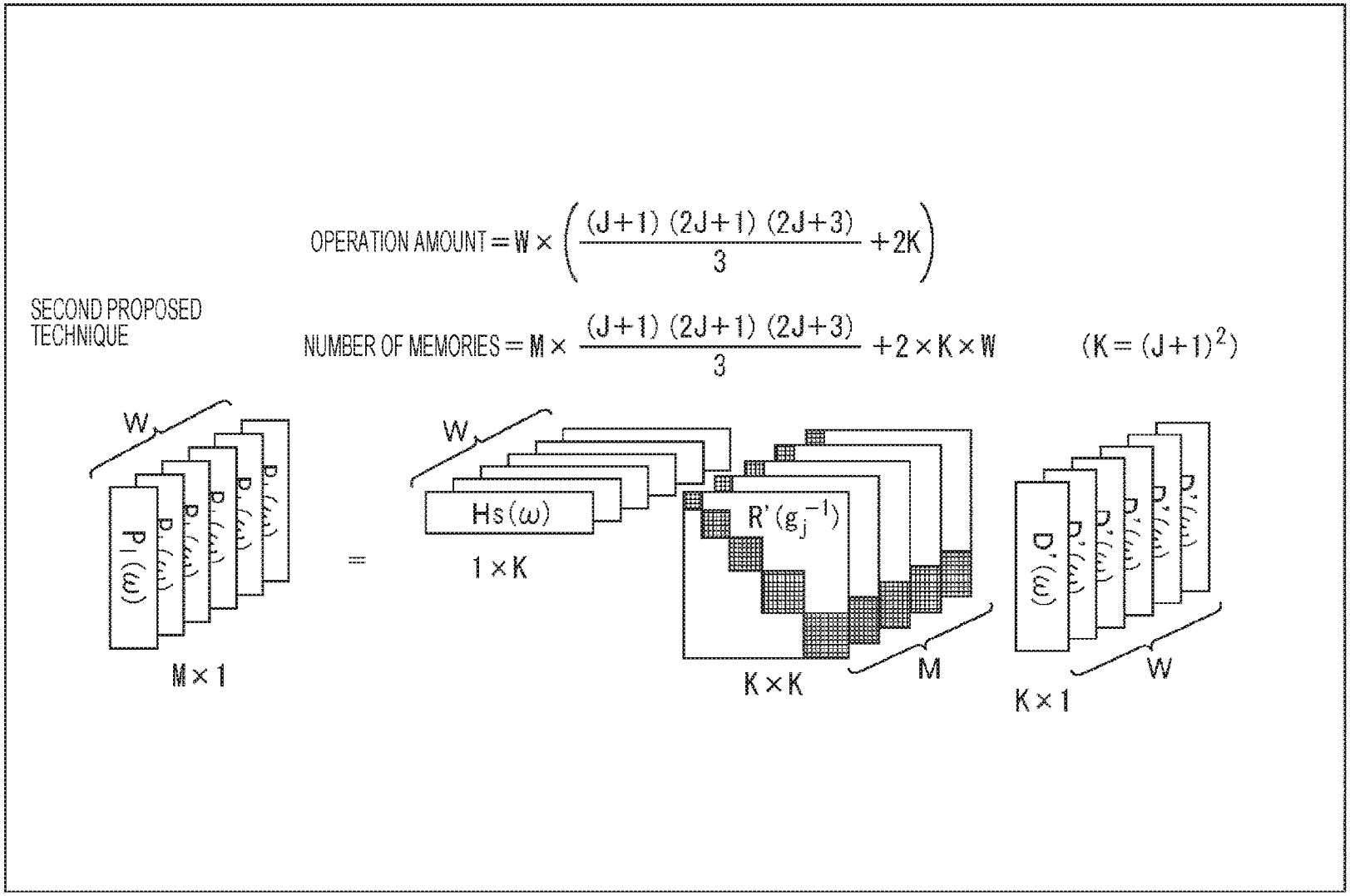
FIG. 11 is a diagram for explaining the operation amount and necessary memory amount of the second proposed technique.

In addition, the operation amount and the required memory amount in such a second proposed technique are as shown in FIG. 11.

That is, suppose that, as shown in FIG. 11, the matrix $H_s(\omega)$ of 1×K is prepared for each time-frequency bin ω, the rotation matrix $R'(g_j^{-1})$ of K×K is prepared for M number of directions $g_j$, and the vector $D'(\omega)$ is K×1. In addition, suppose that the number of time-frequency bins ω is W, and the maximum value of the degree n of the spherical harmonics, that is, the maximum degree is J.

At this time, since the number of nonzero elements of the rotation matrix $R'(g_j^{-1})$ is (J+1) (2J+1) (2J+3)/3, the total calc/W of the number of product-sum operations per time-frequency bin ω in the second proposed technique is as shown in the following Expression (27).

[Expression 27]

$$\text{calc}/W = \frac{(J+1)(2J+1)(2J+3)}{3} + 2K \tag{27}$$

In addition, for the operation by the second proposed technique, it is necessary to keep the matrix $H_s(\omega)$ of 1×K for each time-frequency bin ω for the left and right ears, and further, it is necessary to keep nonzero elements of the rotation matrix $R'(g_j^{-1})$ for each of M number of directions. Therefore, the memory amount memory necessary for the operation by the second proposed technique is as shown in the following Expression (28).

[Expression 28]

$$\text{memory} = M \times \frac{(J+1)(2J+1)(2J+3)}{3} + 2 \times K \times W \tag{28}$$

Herein, for example, suppose that the maximum degree of the spherical harmonics is J=4, then $K=(J+1)^2=25$. In addition, suppose that W=100 and M=1000.

In this case, the product-sum operation amount in the second proposed technique is calc/W=(4+1) (8+1) (8+3)/3+2×25=215. In addition, the memory amount memory necessary for the operation is 1000×(4+1) (8+1) (8+3)/3+2×25×100=170000.

On the other hand, in the aforementioned first proposed technique, the product-sum operation amount under the same condition is calc/W=50, and the memory amount is memory=5000000.

Therefore, according to the second proposed technique, it can be seen that it is possible to greatly reduce the necessary memory amount although the operation amount slightly increases as compared with the aforementioned first proposed technique.

<Configuration Example of Audio Processing Device>

Figure 12:
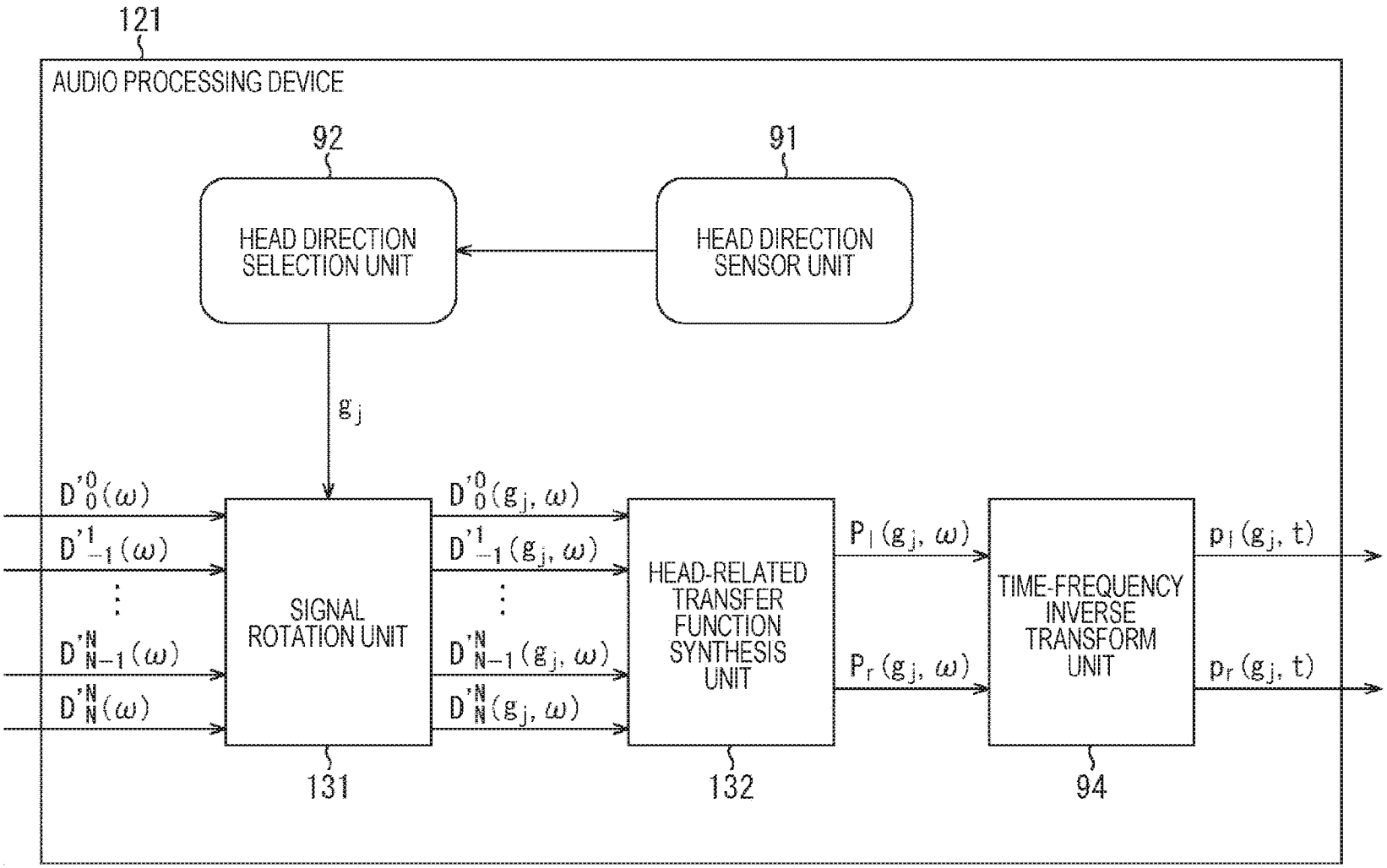
FIG. 12 is a diagram showing a configuration example of an audio processing device to which the present technology is applied.

Next, a configuration example of an audio processing device, which computes the drive signals of the headphones by the second proposed technique, will be described. In such a case, the audio processing device is configured, for example, as shown in FIG. 12. Note that parts in FIG. 12 corresponding to those in FIG. 8 are denoted by the same reference signs, and the descriptions thereof will be omitted as appropriate.

An audio processing device 121 shown in FIG. 12 has a head direction sensor unit 91, a head direction selection unit 92, a signal rotation unit 131, a head-related transfer function synthesis unit 132, and a time-frequency inverse transform unit 94.

The configuration of this audio processing device 121 is different from that of the audio processing device 81 shown in FIG. 8 in that the signal rotation unit 131 and the head-related transfer function synthesis unit 132 are provided in place of the head-related transfer function synthesis unit 93. Other than that, the configuration of the audio processing device 121 is similar to that of the audio processing device 81.

The signal rotation unit 131 keeps the rotation matrix $R'(g_j^{-1})$ for each of the plurality of directions in advance and selects the rotation matrix $R'(g_j^{-1})$ from these matrices $R'(g_j^{-1})$ corresponding to the direction $g_j$ supplied from the head direction selection unit 92.

The signal rotation unit 131 also rotates the input signal $D'_n{}^m(\omega)$ supplied from the outside by $g_j$, which is the rotation amount of the head of the listener, by using the selected rotation matrix $R'(g_j^{-1})$ and supplies the input signal $D'_n{}^m(g_j, \omega)$ obtained as a result to the head-related transfer function synthesis unit 132. That is, in the signal rotation unit 131, the product of the rotation matrix $R'(g_j^{-1})$ and the vector $D'(\omega)$ in the aforementioned Expression (26) is calculated, and the calculation result is set as the input signal $D'_n{}^m(g_j, \omega)$.

The head-related transfer function synthesis unit 132 obtains the product of the input signal $D'_n{}^m(g_j, \omega)$ supplied from the signal rotation unit 131 and the matrix $H_s(\omega)$ of the head-related transfer function of the spherical harmonic domain kept in advance for each of the left and right headphones and computes the drive signals of the left and right headphones. That is, for example, when computing the drive signal of the left headphone, the operation to obtain the product of $H_s(\omega)$ and $R'(g_j^{-1})D'(\omega)$ in Expression (26) is performed in the head-related transfer function synthesis unit 132.

The head-related transfer function synthesis unit 132 supplies the drive signal $P_l(g_j, \omega)$ and the drive signal $P_r(g_j, \omega)$ of the left and right headphones thus obtained to the time-frequency inverse transform unit 94.

Herein, the input signal $D'_n{}^m(g_j, \omega)$ is commonly used for the left and right headphones, and the matrix $H_s(\omega)$ is prepared for each of the left and right headphones. Therefore, by obtaining the input signal $D'_n{}^m(g_j, \omega)$ common to the left and right and then convolving the head-related transfer function of the matrix $H_s(\omega)$ as in the audio processing device 121, it is possible to decrease the operation amount. Note that, in a case where the left and right coefficients may be considered to be symmetric, the matrix $H_s(\omega)$ may be kept in advance for only the left, and the input signal $D_{ref}{}'_n{}^m(g_j, \omega)$ for the right may be obtained by using an inverse matrix making the calculation result of the input signal $D'_n{}^m(g_j, \omega)$ for the left flip horizontal, and the drive signal of the right headphone may be computed from $H_s(\omega)D_{ref}{}'_n{}^m(g_j, \omega)$.

In the audio processing device 121 shown in FIG. 12, a block including the signal rotation unit 131 and the head-related transfer function synthesis unit 132 is equivalent to the head-related transfer function synthesis unit 93 in FIG. 8 and synthesizes the input signal, the head-related transfer function, and the rotation matrix to function as the head-related transfer function synthesis unit which generates the drives signals of the headphones.

<Explanation of Drive Signal Generation Processing>

Figure 13:
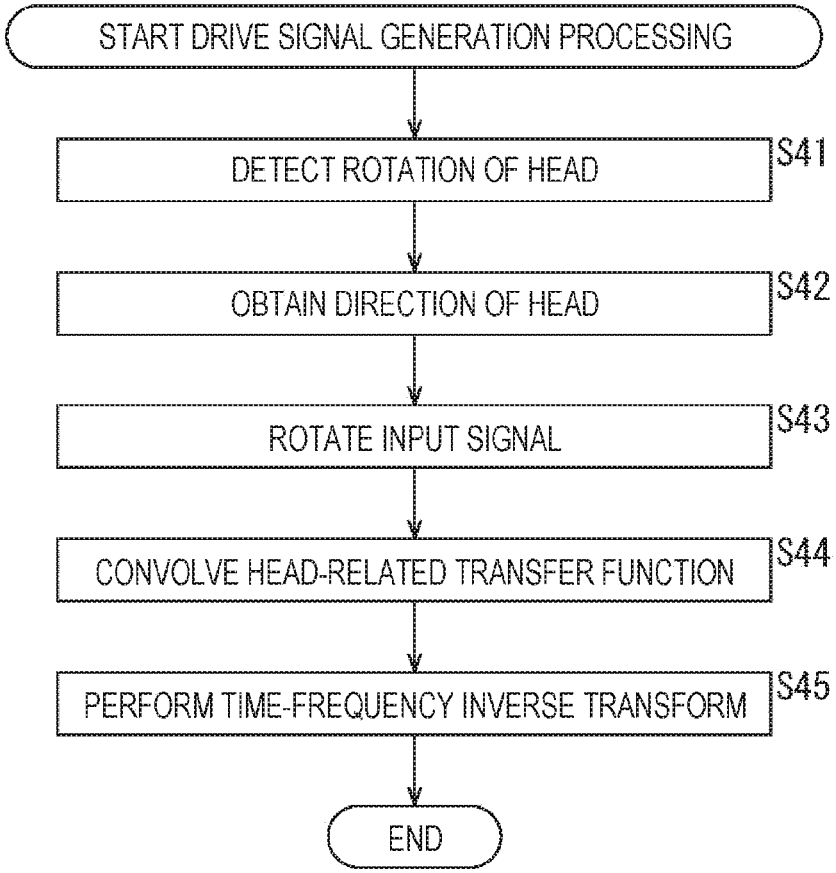
FIG. 13 is a flowchart for explaining the drive signal generation processing.

Subsequently, with reference to the flowchart in FIG. 13, the drive signal generation processing performed by the audio processing device 121 will be described. Note that processing in steps S41 and S42 are similar to the processing in steps S11 and S12 in FIG. 9 so that descriptions thereof will be omitted.

In step S43, on the basis of the rotation matrix $R'(g_j^{-1})$ corresponding to the direction $g_j$ supplied from the head direction selection unit 92, the signal rotation unit 131 rotates the input signal $D'_n{}^m(\omega)$ supplied from the outside by) by $g_j$ and supplies the input signal $D'_n{}^m(g_j, \omega)$ obtained as a result to the head-related transfer function synthesis unit 132.

In step S44, the head-related transfer function synthesis unit 132 obtains the product (product-sum) of the input signal $D'_n{}^m(g_j, \omega)$ supplied from the signal rotation unit 131 and the matrix $H_s(\omega)$ kept in advance for each of the left and right headphones, thereby convolving the head-related transfer function with the input signal in the spherical harmonic domain. Then, the head-related transfer function synthesis unit 132 supplies the drive signal $P_l(g_j, \omega)$ and the drive signal $P_r(g_j, \omega)$ of the left and right headphones, which are obtained by convolving the head-related transfer functions, to the time-frequency inverse transform unit 94.

Once the drive signals of the left and right headphones in the time-frequency domain are obtained, the processing in step S45 is performed thereafter, and the drive signal generation processing ends. The processing in step S45 is similar to the processing in step S14 in FIG. 9 so that the description thereof will be omitted.

As described above, the audio processing device 121 convolves the head-related transfer functions with the input signals in the spherical harmonic domain and computes the drive signals of the left and right headphones. Thus, it is possible to greatly reduce the operation amount when the drive signals of the headphones are generated as well as to greatly reduce the memory amount necessary for the operation.

<Modification Example 1 of Second Embodiment>

<Configuration Example of Audio Processing Device>

Figure 14:
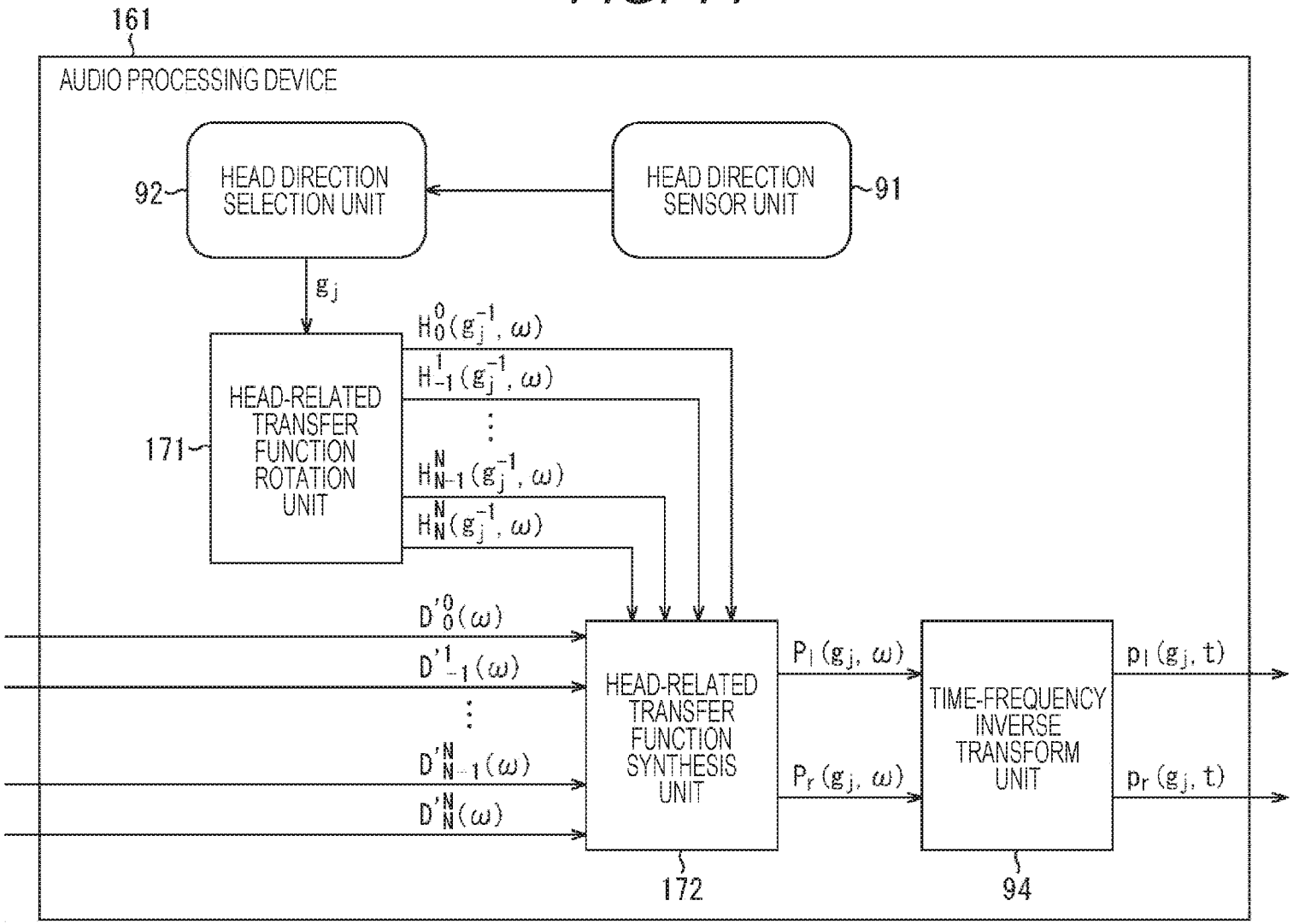
FIG. 14 is a diagram showing a configuration example of an audio processing device to which the present technology is applied.

Moreover, in the second embodiment, the example, in which $R'(g_j^{-1})D'(\omega)$ in the calculation of Expression (26) is calculated first, has been described, but $H_s(\omega)R'(g_j^{-1})$ in the calculation of Expression (26) may be calculated first. In such a case, the audio processing device is configured, for example, as shown in FIG. 14. Note that parts in FIG. 14 corresponding to those in FIG. 8 are denoted by the same reference signs, and the descriptions thereof will be omitted as appropriate.

An audio processing device 161 shown in FIG. 14 has a head direction sensor unit 91, a head direction selection unit 92, a head-related transfer function rotation unit 171, a head-related transfer function synthesis unit 172, and a time-frequency inverse transform unit 94.

The configuration of this audio processing device 161 is different from that of the audio processing device 81 shown in FIG. 8 in that the head-related transfer function rotation unit 171 and the head-related transfer function synthesis unit 172 are provided in place of the head-related transfer function synthesis unit 93. Other than that, the configuration of the audio processing device 161 is similar to that of the audio processing device 81.

The head-related transfer function rotation unit 171 keeps the rotation matrix $R'(g_j^{-1})$ for each of the plurality of directions in advance and selects the rotation matrix $R'(g_j^{-1})$ from these matrices $R'(g_j^{-1})$ corresponding to the direction $g_j$ supplied from the head direction selection unit 92.

The head-related transfer function rotation unit 171 also obtains the product of the selected rotation matrix $R'(g_j^{-1})$ and the matrix $H_s(\omega)$ of the head-related transfer function of the spherical harmonic domain kept in advance and supplies the product to the head-related transfer function synthesis unit 172. That is, in the head-related transfer function rotation unit 171, calculation corresponding to $H_s(\omega)R'(g_j^{-1})$ in Expression (26) is performed for each of the left and right headphones, thereby rotating the head-related transfer function, which is the element of the matrix $H_s(\omega)$, by $g_j$, which is the rotation of the head of the listener. Note that, in a case where the left and right coefficients may be considered to be symmetrical, the matrix $H_s(\omega)$ may be kept in advance for only the left, and the calculation for $H_s(\omega)R'(g_j^{-1})$ for the right may be obtained by using an inverse matrix making the calculation result of the left flip horizontal.

Note that the head-related transfer function rotation unit 171 may acquire the matrix $H_s(\omega)$ of the head-related transfer function from the outside.

The head-related transfer function synthesis unit 172 convolves the head-related transfer function supplied from the head-related transfer function rotation unit 171 with the input signal $D'_n{}^m(\omega)$ supplied from the outside for each of the left and right headphones and computes the drive signals of the left and right headphones. For example, when computing the drive signal of the left headphone, the calculation to obtain the product of $H_s(\omega)R'(g_j^{-1})$ and $D'(\omega)$ in Expression (26) is performed in the head-related transfer function synthesis unit 172.

The head-related transfer function synthesis unit 172 supplies the drive signal $P_l(g_j, \omega)$ and the drive signal $P_r(g_j, \omega)$ of the left and right headphones thus obtained to the time-frequency inverse transform unit 94.

In the audio processing device 161 shown in FIG. 14, a block including the head-related transfer function rotation unit 171 and the head-related transfer function synthesis unit 172 is equivalent to the head-related transfer function synthesis unit 93 in FIG. 8 and synthesizes the input signal, the head-related transfer function, and the rotation matrix to function as the head-related transfer function synthesis unit which generates the drives signals of the headphones.

<Explanation of Drive Signal Generation Processing>

Figure 15:
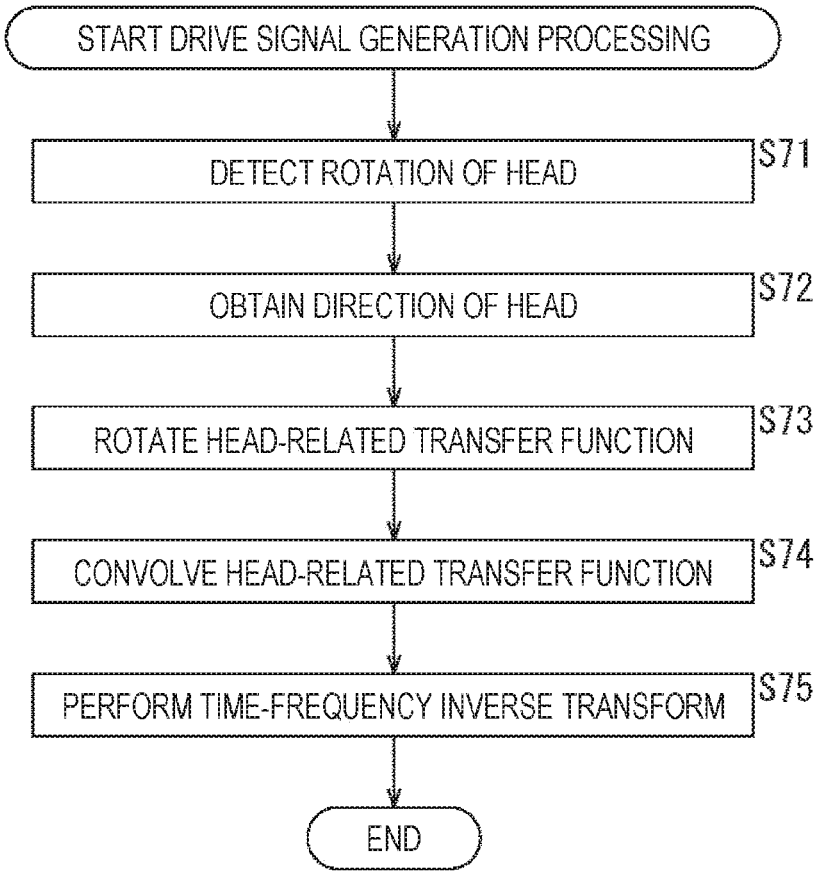
FIG. 15 is a flowchart for explaining the drive signal generation processing.

Next, with reference to the flowchart in FIG. 15, the drive signal generation processing performed by the audio processing device 161 will be described. Note that processing in steps S71 and S72 are similar to the processing in steps S11 and S12 in FIG. 9 so that descriptions thereof will be omitted.

In step S73, on the basis of the rotation matrix $R'(g_j^{-1})$ corresponding to the direction $g_j$ supplied from the head direction selection unit 92, the head-related transfer function rotation unit 171 rotates the head-related transfer function, which is the element of the matrix $H_s(\omega)$, and supplies the matrix including the head-related transfer function after the rotation obtained as a result to the head-related transfer function synthesis unit 172. That is, in step S73, the calculation for $H_s(\omega)R'(g_j^{-1})$ in Expression (26) is performed for each of the left and right headphones.

In step S74, the head-related transfer function synthesis unit 172 convolves the head-related transfer function supplied from the head-related transfer function rotation unit 171 with the input signal $D'_n{}^m(\omega)$ supplied from the outside for each of the left and right headphones and computes the drive signals of the left and right headphones. That is, in step S74, the calculation (product-sum operation) is performed to obtain the product of $H_s(\omega)R'(g_j^{-1})$ and $D'(\omega)$ in Expression (26) for the left headphone, and similar calculation is also performed for the right headphone.

The head-related transfer function synthesis unit 172 supplies the drive signal $P_l(g_j, \omega)$ and the drive signal $P_r(g_j, \omega)$ of the left and right headphones thus obtained to the time-frequency inverse transform unit 94.

Once the drive signals of the left and right headphones in the time-frequency domain are thus obtained, the processing in step S75 is performed thereafter, and the drive signal generation processing ends. The processing in step S75 is similar to the processing in step S14 in FIG. 9 so that the description thereof will be omitted.

As described above, the audio processing device 161 convolves the head-related transfer functions with the input signals in the spherical harmonic domain and computes the drive signals of the left and right headphones. Thus, it is possible to greatly reduce the operation amount when the drive signals of the headphones are generated as well as to greatly reduce the memory amount necessary for the operation.

Third Embodiment

<About Rotation Matrix>

Incidentally, in the second proposed technique, it is necessary to keep the rotation matrices $R'(g_j^{-1})$ for the rotation of three axes of the head of the listener, that is, for the arbitrary M number of directions $g_j$. To Keep such rotation matrices $R'(g_j^{-1})$, a certain amount of memory is necessary although the amount is less than the case of keeping the matrix $H'(\omega)$ with time-frequency dependency.

Thereupon, the rotation matrix $R'(g_j^{-1})$ may be sequentially obtained at the time of operation. Herein, the rotation matrix $R'(g)$ can be expressed by the following Expression (29).

[Expression 29]

$$R'(g)=R'(u(\varphi)a(\theta)u(\psi))=R'(u(\varphi))R'(a(\theta))R'(u(\psi)) \tag{29}$$

Note that, in Expression (29), $u(\varphi)$ and $u(\psi)$ are matrices which rotate the coordinates by the angle $\varphi$ and the angle $\psi$ about the predetermined coordinate axes as rotation axes, respectively.

For example, suppose that there is an orthogonal coordinate system in which axes are the x axis, the y axis, and the z axis, then the matrix $u(\varphi)$ is a rotation matrix which rotates the coordinate system about the z axis as the rotation axis by the angle $\varphi$ in the direction of the horizontal angle (azimuth angle) viewed from that coordinate system. Similarly, the matrix $u(\psi)$ is a matrix which rotates the coordinate system about the z axis as the rotation axis by the angle $\psi$ in the horizontal angle direction viewed from that coordinate system.

In addition, $a(\theta)$ is a matrix which rotates the coordinate system about another coordinate axis different from the z axis, which is the coordinate axis to be the rotation axis by the $u(\varphi)$ and $u(\psi)$, by the angle $\theta$ in the direction of the elevation angle viewed from that coordinate system. The rotation angle of each of the matrix $u(\varphi)$, the matrix $a(\theta)$, and the matrix $u(\psi)$ is an Euler angle.

$R'(g)=R'(u(\varphi)a(\theta)u(\psi))$ is a rotation matrix which, in the spherical harmonic domain, rotates the coordinate system by the angle $\varphi$ in the horizontal angle direction, thereafter rotates the coordinate system after the rotation by the angle $\varphi$ by the angle $\theta$ in the elevation angle direction viewed from that coordinate system, and further rotates the coordinate system after the rotation by the angle $\theta$ by the angle $\psi$ in the horizontal angle direction viewed from that coordinate system.

Furthermore, in Expression (29), $R'(u(\varphi))$, $R'(a(\theta))$, and $R'(u(\psi))$ are the rotation matrices $R'(g)$ when rotating the coordinates by the matrix $(u(\varphi))$, the matrix $(a(\theta))$, and the matrix $(u(\psi))$, respectively.

In other words, the rotation matrix $R'(u(\varphi))$ is a rotation matrix which rotates the coordinates by the angle $\varphi$ in the horizontal angle direction in the spherical harmonic domain, and the rotation matrix $R'(a(\theta))$ is a rotation matrix which rotates the coordinates by the angle $\theta$ in the elevation angle direction in the spherical harmonic domain. In addition, the rotation matrix $R'(u(\psi))$ is a rotation matrix which rotates the coordinates by the angle $\psi$ in the horizontal angle direction in the spherical harmonic domain.

Figure 16:
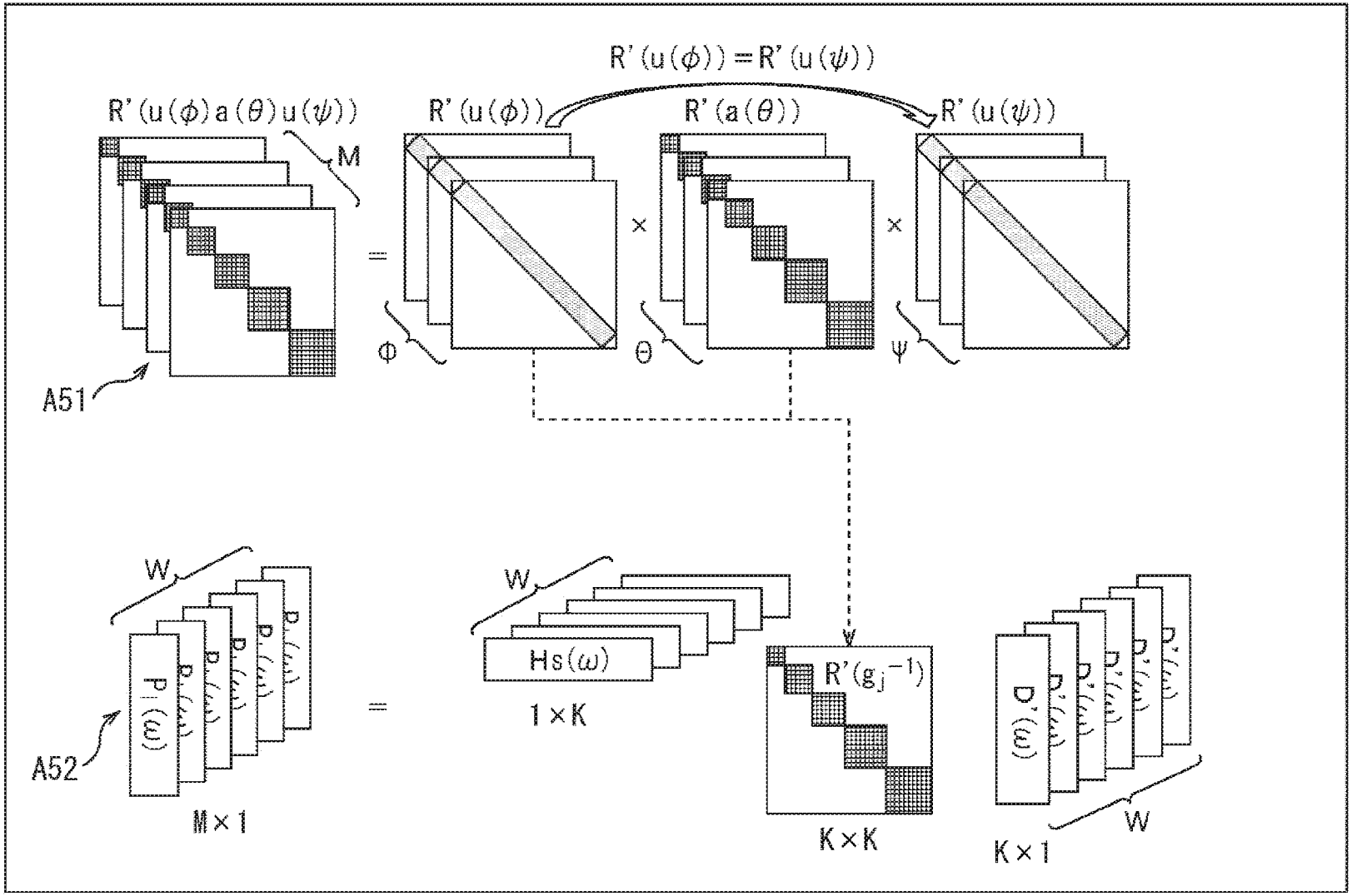
FIG. 16 is a diagram for explaining the computation of a drive signal by a third proposed method.

Therefore, for example, as indicated by the arrow A51 in FIG. 16, the rotation matrix $R'(g)=R'(u(\varphi)a(\theta)u(\psi))$, which rotates the coordinates three times by the angle $\varphi$, the angle $\theta$, and the angle $\psi$ as the rotation angles, can be expressed by the product of three rotation matrices, which are the rotation matrix $R'(u(\varphi))$, the rotation matrix $R'(a(\theta))$, and the rotation matrix $R'(u(\psi))$.

In this case, as the data for obtaining the rotation matrix $R'(g_j^{-1})$, each of the rotation matrix $R'(u(\varphi))$, the rotation matrix $R'(a(\theta))$, and the rotation matrix $R'(u(\psi))$ for the values of each of the rotation angles $\varphi$, $\theta$, and $\psi$ should be kept in tables in the memory. Moreover, in a case where the same head-related transfer function may be used for the left and right, the matrix $Hs(\omega)$ is kept for only one ear, also the aforementioned matrix $R_{ref}$ for inverting the left and right is kept in advance, and the rotation matrix for the other ear can be obtained by obtaining the product of these and the generated rotation matrix.

In addition, when the vector $P_l(\omega)$ is actually computed, one rotation matrix $R'(g_j^{-1})$ is computed by calculating the product of each rotation matrix read out from the tables. Then, as indicated by the arrow A52, the product of the matrix $H_s(\omega)$ of $1\times K$, the rotation matrix $R'(g_j^{-1})$ of $K\times K$ common to each time-frequency bin $\omega$, and the vector $D'(\omega)$ of $K\times 1$ is calculated for each time-frequency bin $\omega$ to obtain the vector $P_l(\omega)$.

Herein, for example, in a case where the rotation matrix $R'(g_j^{-1})$ itself of each rotation angle is kept in the table, suppose that the precision of the angle $\varphi$, the angle $\theta$, and the angle $\psi$ of each rotation is one degree (1°), it is necessary to keep $360^3=46656000$ rotation matrices $R'(g_j^{-1})$.

On the other hand, in a case where suppose that the precision of the angle $\varphi$, the angle $\theta$, and the angle $\psi$ of each rotation is one degree (1°), and the rotation matrix $R'(u(\theta))$, the rotation matrix $R'(a(\varphi))$, and the rotation matrix $R'(u(\psi))$ of each rotation angle are kept in the tables, it is necessary to keep only $360\times 3=1080$ rotation matrices.

Therefore, when the rotation matrix $R'(g_j^{-1})$ itself is kept, it is necessary to keep the data of the order of $O(n^3)$. On the other hand, when the rotation matrix $R'(u(\varphi)$, the rotation matrix $R'(a(\theta))$, and the rotation matrix $R'(u(\psi))$ are kept, only the data of the order of $O(n)$ is sufficient, and the memory amount can be greatly reduced.

In addition, since the rotation matrix $R'(u(\varphi))$ and the rotation matrix $R'(u(\psi))$ are diagonal matrices as indicated by the arrow A51, only the diagonal components should be kept. Moreover, since both the rotation matrix $R'(u(\varphi))$ and the rotation matrix $R'(u(\psi))$ are rotation matrices which performs the rotations in the horizontal angle direction, the rotation matrix $R'(u(\varphi))$ and the rotation matrix $R'(u(\psi))$ can be obtained from the same common table. That is, the table of the rotation matrix $R'(u(\varphi))$ and the table of the rotation matrix $R'(u(\psi))$ can be the same. Note that, in FIG. 16, the hatched portions of each rotation matrix are nonzero elements.

Furthermore, as for k and m belonging to the set Q shown in the aforementioned Expression (22), elements other than k rows and m columns of the elements of the rotation matrix $R'(a(\theta))$ are zero.

From these, it is possible to further reduce the memory amount necessary to keep the data for obtaining the rotation matrix $R'(g_j^{-1})$.

Hereinafter, a technique of thus keeping the table of the rotation matrix $R'(u(\varphi))$ and the rotation matrix $R'(u(\psi))$ and the table of the rotation matrix $R'(a(\theta))$ will be referred to as a third proposed technique.

Herein, the necessary memory amounts are specifically compared between the third proposed technique and the general technique. For example, suppose that the precision of the angle $\varphi$, the angle $\theta$, and the angle $\psi$ is 36 degrees (36°), then the numbers of all the rotation matrices $R'(u(\varphi))$, the rotation matrices $R'(a(\theta))$, and the rotation matrices $R'(u(\psi))$ for each rotation angle are 10 so that the M number of the direction $g_j$ of the rotation of the head$=10\times 10\times 10=1000$.

In the case of $M=1000$, the memory amount necessary for the general technique is memory=6400800 as previously mentioned.

On the other hand, in the third proposed technique, since it is necessary to keep the rotation matrices $R'(a(\theta))$ by the amount of the precision of the angle $\theta$, that is, ten rotation matrices, the memory amount necessary to keep the rotation matrices $R'(a(\theta))$ is $\text{memory}(a)=10\times(J+1)\ (2J+1)\ (2J+3)/3$.

In addition, as for the rotation matrices $R'(u(\varphi))$ and the rotation matrices $R'(u(\psi))$, a common table can be used, it is necessary to keep the matrices by the amount of the precision of the angle $\varphi$ and the angle $\psi$, that is, ten rotation matrices, and only the diagonal components of these rotation matrices should be kept. Therefore, suppose that the length of the vector $D'(\omega)$ is K, then the memory amount necessary to keep the rotation matrices $R'(u(\varphi))$ and the rotation matrices $R'(u(\psi))$ is $\text{memory}(b)=10\times K$.

Further, suppose that the number of time-frequency bins $\omega$ is W, the memory amount necessary to keep the matrix $H_s(\omega)$ of $1\times K$ for each time-frequency bin $\omega$ for the left and right ears is $2\times K\times W$.

Therefore, when these are summed up, the memory amount necessary for the third proposed technique is memory=memory(a)+memory(b)+2KW.

Herein, suppose that $W=100$ and the maximum degree of the spherical harmonics is $J=4$, then $K=(4+1)^2=25$. Thus, the memory amount necessary for the third proposed technique is $\text{memory}=10\times 5\times 9\times 11/3+10\times 25+2\times 25\times 100=6900$, indicating that the memory amount can be greatly reduced. It can be seen that this third proposed technique can greatly reduce the memory amount even when compared with the necessary memory amount of the second proposed technique memory=170000

In addition, in the third proposed technique, in addition to the operation amount in the second proposed technique, the operation amount for obtaining the rotation matrix $R'(g_j^{-1})$ is necessary.

Herein, an operation amount calc(R') necessary to obtain the rotation matrix $R'(g_j^{-1})$ is calc(R')=(J+1) (2J+1) (2J+3)/3×2 irrespective of the precision of the angle φ, the angle θ, and the angle ψ. Suppose that the degree J=4, then the operation amount calc(R')=5×9×11/3×2=330.

Moreover, since the rotation matrix $R'(g_j^{-1})$ can be used commonly for each time-frequency bin ω, the operation amount per time-frequency bin ω is calc(R')/W=330/100=3.3 when W=100.

Therefore, the sum of the operation amount of the third proposed technique is 218.3, which is the sum of the operation amount calc(R')/W=3.3 necessary for deriving the rotation matrix $R'(g_j^{-1})$ and the aforementioned operation of the second proposed technique calc/W=215. As can be seen from the above, in the operation amount of the third proposed technique, the operation amount necessary to obtain the rotation matrix $R'(g_j^{-1})$ is an operation amount that is almost negligible.

In such a third proposed technique, it is possible to greatly reduce the necessary memory amount with the operation amount that is about the same as the second proposed technique. Particularly, the third proposed technique exerts more effects, for example, when the precision of the angle φ, the angle θ, and the angle ψ is set to one degree (1°) or the like so as to withstand practical use in the case of realizing the head tracking function.

<Configuration Example of Audio Processing Device>

Figure 17:
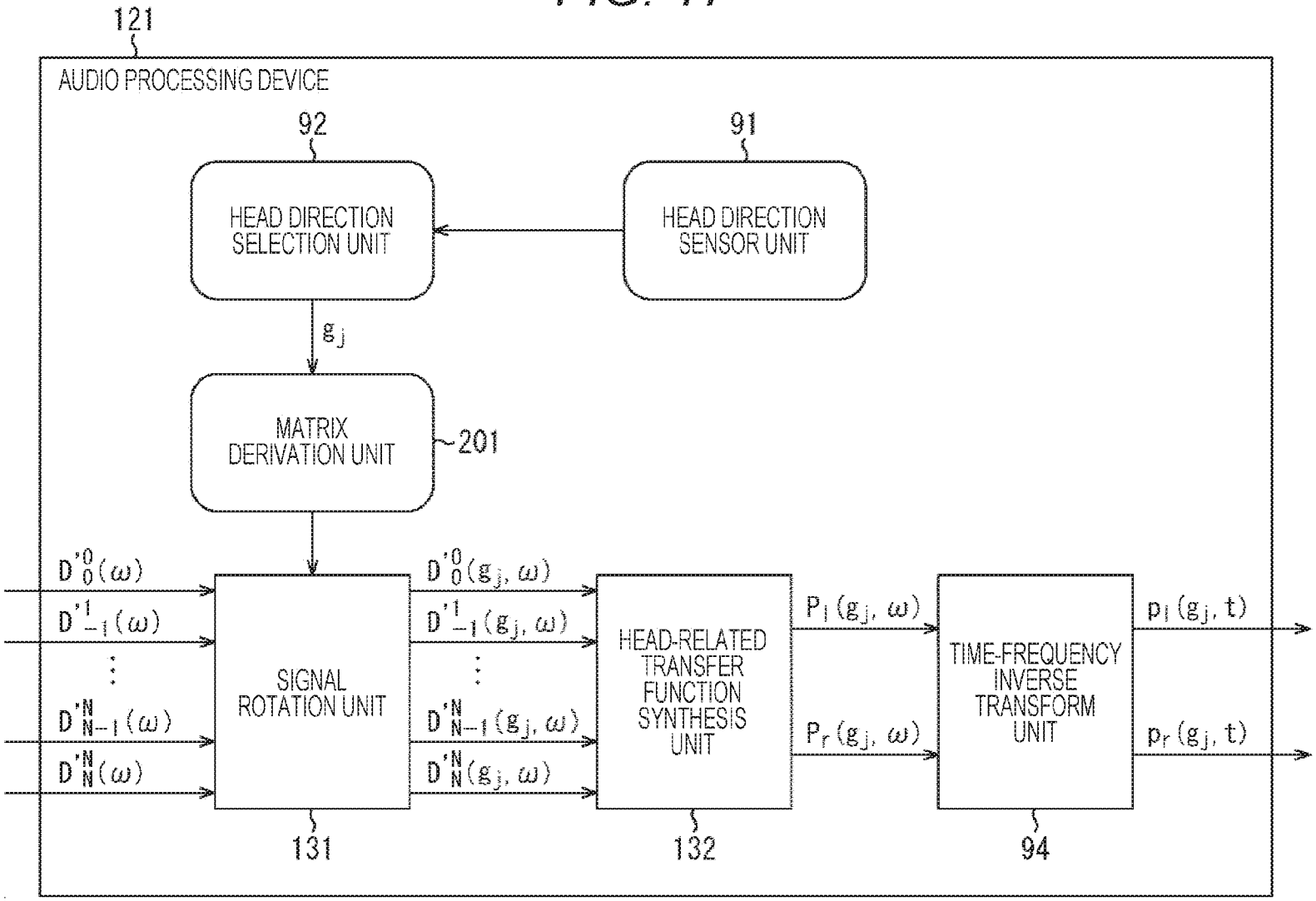
FIG. 17 is a diagram showing a configuration example of an audio processing device to which the present technology is applied.

Next, a configuration example of an audio processing device, which computes the drive signals of the headphones by the third proposed technique, will be described. In such a case, the audio processing device is configured, for example, as shown in FIG. 17. Note that parts in FIG. 17 corresponding to those in FIG. 12 are denoted by the same reference signs, and the descriptions thereof will be omitted as appropriate.

An audio processing device 121 shown in FIG. 17 has a head direction sensor unit 91, a head direction selection unit 92, a matrix derivation unit 201, a signal rotation unit 131, a head-related transfer function synthesis unit 132 and a time-frequency inverse transform unit 94.

The configuration of this audio processing device 121 is different from that of the audio processing device 121 shown in FIG. 12 in that the matrix derivation unit 201 is newly provided. Other than that, the configuration of the audio processing device 121 is similar to that of the audio processing device 121 in FIG. 12.

The matrix derivation unit 201 keeps in advance the table of the rotation matrix R'(u(φ)) and the rotation matrix R'(u(ψ)) and the table of the rotation matrix R'(a(θ)), which are previously mentioned. The matrix derivation unit 201 generates (computes) the rotation matrix $R'(g_j^{-1})$ corresponding to the direction $g_j$ supplied from the head direction selection unit 92 by using the kept tables and supplies the rotation matrix $R'(g_j^{-1})$ to the signal rotation unit 131.

<Explanation of Drive Signal Generation Processing>

Figure 18:
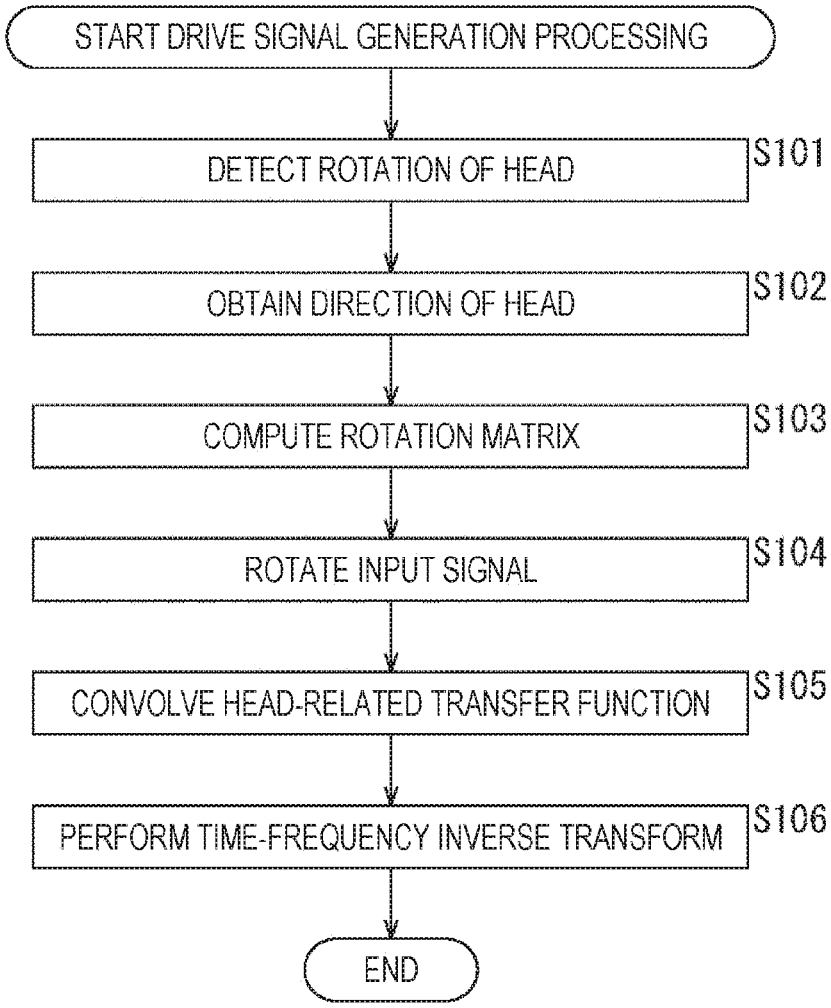
FIG. 18 is a flowchart for explaining the drive signal generation processing.

Next, with reference to the flowchart in FIG. 18, the drive signal generation processing performed by the audio processing device 121 shown in FIG. 17 will be described. Note that processing in steps S101 and S102 are similar to the processing in steps S41 and S42 in FIG. 13 so that descriptions thereof will be omitted.

In step S103, on the basis of the direction $g_j$ supplied from the head direction selection unit 92, the matrix derivation unit 201 computes the rotation matrix $R'(g_j^{-1})$ and supplies the rotation matrix $R'(g_j^{-1})$ to the signal rotation unit 131.

That is, the matrix derivation unit 201 selects and reads out the rotation matrix R'(u(φ)), the rotation matrix R'(a(θ)), and the rotation matrix R'(u(φ)) for the angles of the angle φ, the angle θ, and the angle ψ corresponding to the direction $g_j$ from the tables kept in advance.

Herein, for example, the angle θ is an elevation angle indicating the head rotation direction of the listener indicated by the direction $g_j$, that is, the angle of the elevation angle direction of the head of the listener viewed from the state in which the listener is directed to the reference direction such as the front. Therefore, the rotation matrix R'(a(θ)) is a rotation matrix which rotates the coordinates by the elevation angle amount indicating the head direction of the listener, that is, the rotation amount in the elevation angle direction of the head. Note that the reference direction of the head is arbitrary among the three axes of the angle φ, the angle θ, and the angle ψ previously mentioned. The following description is made with a certain direction of the head in a state in which the top of the head is directed in the vertical direction as the reference direction.

The matrix derivation unit 201 performs the calculation of the aforementioned Expression (29), that is, obtains the product of the rotation matrix R'(u(φ)), the rotation matrix R'(a(θ)), and the rotation matrix R'(u(ψ)), which have been read out, to compute the rotation matrix $R'(g_j^{-1})$.

Once the rotation matrix $R'(g_j^{-1})$ is obtained, the processing in steps S104 to S106 are performed thereafter, and the drive signal generation processing ends. These processing are similar to the processing in steps S43 to S45 in FIG. 13 so that the descriptions thereof will be omitted.

As described above, the audio processing device 121 computes the rotation matrix, rotates the input signal by that rotation matrix, convolves the head-related transfer function with the input signal in the spherical harmonic domain, and computes the drive signals of the left and right headphones. Thus, it is possible to greatly reduce the operation amount when the drive signals of the headphones are generated as well as to greatly reduce the memory amount necessary for the operation.

<Modification Example 1 of Third Embodiment>

<Configuration Example of Audio Processing Device>

Figure 19:
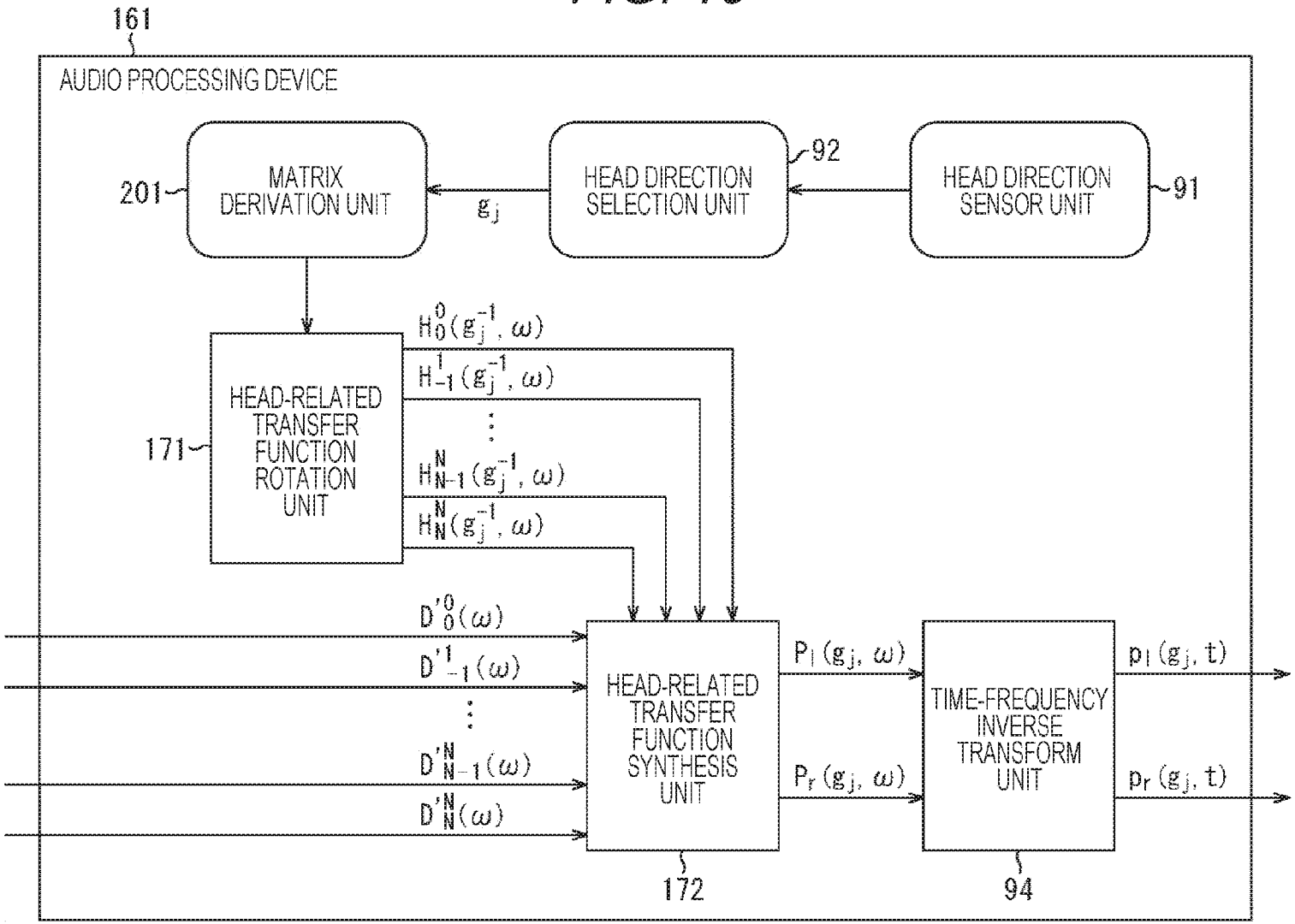
FIG. 19 is a diagram showing a configuration example of an audio processing device to which the present technology is applied.

Moreover, in the third embodiment, the example, in which the input signal is rotated, has been described, but the head-related transfer function may be rotated similarly to the case of the modification example 1 of the second embodiment. In such a case, an audio processing device is configured, for example, as shown in FIG. 19. Note that parts in FIG. 19 corresponding to those in FIG. 14 or 17 are denoted by the same reference signs, and the descriptions thereof will be omitted as appropriate.

An audio processing device 161 shown in FIG. 19 has a head direction sensor unit 91, a head direction selection unit 92, a matrix derivation unit 201, a head-related transfer function rotation unit 171, a head-related transfer function synthesis unit 172 and a time-frequency inverse transform unit 94.

The configuration of this audio processing device 161 is different from that of the audio processing device 161 shown in FIG. 14 in that the matrix derivation unit 201 is newly provided. Other than that, the configuration of the audio processing device 161 is similar to that of the audio processing device 161 in FIG. 14.

The matrix derivation unit 201 computes the rotation matrix $R'(g_j^{-1})$ corresponding to the direction $g_j$ supplied from the head direction selection unit 92 by using the kept tables and supplies the rotation matrix $R'(g_j^{-1})$ to the head-related transfer function rotation unit 171.

<Explanation of Drive Signal Generation Processing>

Figure 20:
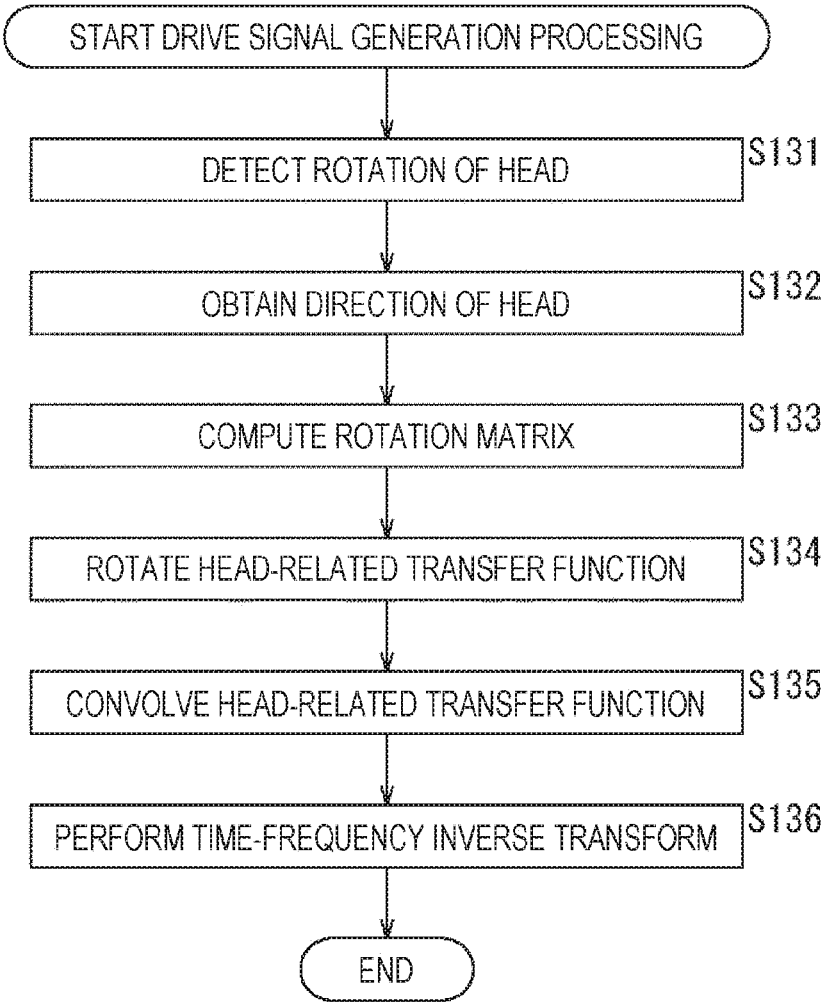
FIG. 20 is a flowchart for explaining the drive signal generation processing.

Next, with reference to the flowchart in FIG. 20, the drive signal generation processing performed by the audio processing device 161 shown in FIG. 19 will be described. Note that processing in steps S131 and S132 are similar to the processing in steps S71 and S72 in FIG. 15 so that descriptions thereof will be omitted.

In step S133, on the basis of the direction $g_j$ supplied from the head direction selection unit 92, the matrix derivation unit 201 computes the rotation matrix $R'(g_j^{-1})$ and supplies the rotation matrix $R'(g_j^{-1})$ to the head-related transfer function rotation unit 171. Note that, in step S133, the processing similar to that in step S103 in FIG. 18 is performed, and the rotation matrix $R'(g_j^{-1})$ is computed.

Once the rotation matrix $R'(g_j^{-1})$ is obtained, the processing in steps S134 to S136 are performed thereafter, and the drive signal generation processing ends. These processing are similar to the processing in steps S73 to S75 in FIG. 15 so that the descriptions thereof will be omitted.

As described above, the audio processing device 161 computes the rotation matrix, rotates the head-related transfer function by that rotation matrix, convolves the head-related transfer function with the input signal in the spherical harmonic domain, and computes the drives signals of the left and right headphones. Thus, it is possible to greatly reduce the operation amount when the drive signals of the headphones are generated as well as to greatly reduce the memory amount necessary for the operation.

Note that, in the example using the rotation matrix $R'(g_j^{-1})$ to compute the drive signals of the headphones as in the second embodiment, the modification example 1 of the second embodiment, the third embodiment, and the modification example 1 of the third embodiment, which are previously mentioned, when the angle $\theta=0$, the rotation matrix $R'(g_j^{-1})$ is a diagonal matrix.

Therefore, for example, in a case where the angle $\theta=0$ is fixed or a case where the inclination of the head of the listener in the direction of the angle $\theta$ is allowed to some extent and handled as the angle $\theta=0$, the operation amount at the time of computing the drive signals of the headphones is further reduced.

Herein, the angle $\theta$ is, for example, an angle (elevation angle) in the vertical direction viewed from the listener in the space, that is, in the pitch direction. Therefore, in a case where the angle $\theta=0$, that is, the angle $\theta$ is zero degrees, the direction of the head of the listener is in a state in which the listener is not moving in the vertical direction from the state in which the listener is directed in the reference direction such as right in front.

For example, in the example shown in FIG. 17, in a case where the angle $\theta=0$ when the absolute value of the angle $\theta$ of the head of the listener is equal to or less than the predetermined threshold value th, the matrix derivation unit 201 supplies the rotation matrix $R'(g_j^{-1})$ as well as information indicating whether or not the angle $\theta=0$ to the signal rotation unit 131.

That is, for example, on the basis of the direction $g_j$ supplied from the head direction selection unit 92, the matrix derivation unit 201 compares the absolute value of the angle $\theta$ indicated by that direction $g_j$ with the threshold value th. Then, in a case where the absolute value of the angle $\theta$ is equal to or less than the threshold value th, the matrix derivation unit 201 selects the rotation matrix $R'(a(\theta))$ with the angle $\theta=0$ and computes the rotation matrix $R'(g_j^{-1})$, omits the calculation of the rotation matrix $R'(a(\theta))$ which is an identity matrix and computes the rotation matrix $R'(g_j^{-1})$ from only the product of the rotation matrix $R'(u(\varphi))$ and the rotation matrix $R'(u(\psi))$, or sets the rotation matrix $R'(u(\varphi+\psi))$ as the rotation matrix $R'(g_j^{-1})$, and supplies that rotation matrix $R'(g_j^{-1})$ and the information indicating that the angle $\theta=0$ to the signal rotation unit 131.

When the information indicating that the angle $\theta=0$ is supplied from the matrix derivation unit 201, the signal rotation unit 131 performs the calculation of $R'(g_j^{-1})D'(\omega)$ in the aforementioned Expression (26) for only the diagonal components to compute the input signal $D'_n{}^m(g_j, \omega)$. In addition, in a case where information indicating that the angle $\theta=0$ is not supplied from the matrix derivation unit 201, the signal rotation unit 131 performs the calculation of $R'(g_j^{-1})D'(\omega)$ in the aforementioned Expression (26) for all the components to compute the input signal $D'_n{}^m(g_j, \omega)$.

Similarly, also in the case of the audio processing device 161 shown in FIG. 19, for example, the matrix derivation unit 201 compares the absolute value of the angle $\theta$ with the threshold value th on the basis of the direction $g_j$ supplied from the head direction selection unit 92. Then, in a case where the absolute value of the angle $\theta$ is equal to or less than the threshold value th, the matrix derivation unit 201 computes the rotation matrix $R'(g_j^{-1})$ with the angle $\theta=0$ and supplies that rotation matrix $R'(g_j^{-1})$ and the information indicating that the angle $\theta=0$ to the head-related transfer function rotation unit 171.

Moreover, when the information indicating that the angle $\theta=0$ is supplied from the matrix derivation unit 201, the head-related transfer function rotation unit 171 performs the calculation for $H_s(\omega)R'(g_j^{-1})$ in the aforementioned Expression (26) for only the diagonal components.

In a case where the rotation matrix $R'(g_j^{-1})$ is thus a diagonal matrix, it is possible to further reduce the operation amount by calculating only the diagonal components.

Fourth Embodiment

<About Truncation of Degree for Each Time-Frequency>

Incidentally, it is known that the head-related transfer function has different degrees necessary in the spherical harmonic domain, which is described in, for example, "Efficient Real Spherical Harmonic Representation of Head-Related Transfer Functions (Griffin D. Romigh et al., 2015)" and the like.

For example, if the element of the degree $n=N(\omega)$ necessary for each time-frequency bin $\omega$ is known among the elements constituting the matrix $H_s(\omega)$ of the head-related transfer function shown in Expression (26), it is possible to further reduce the operation amount.

Figure 21:
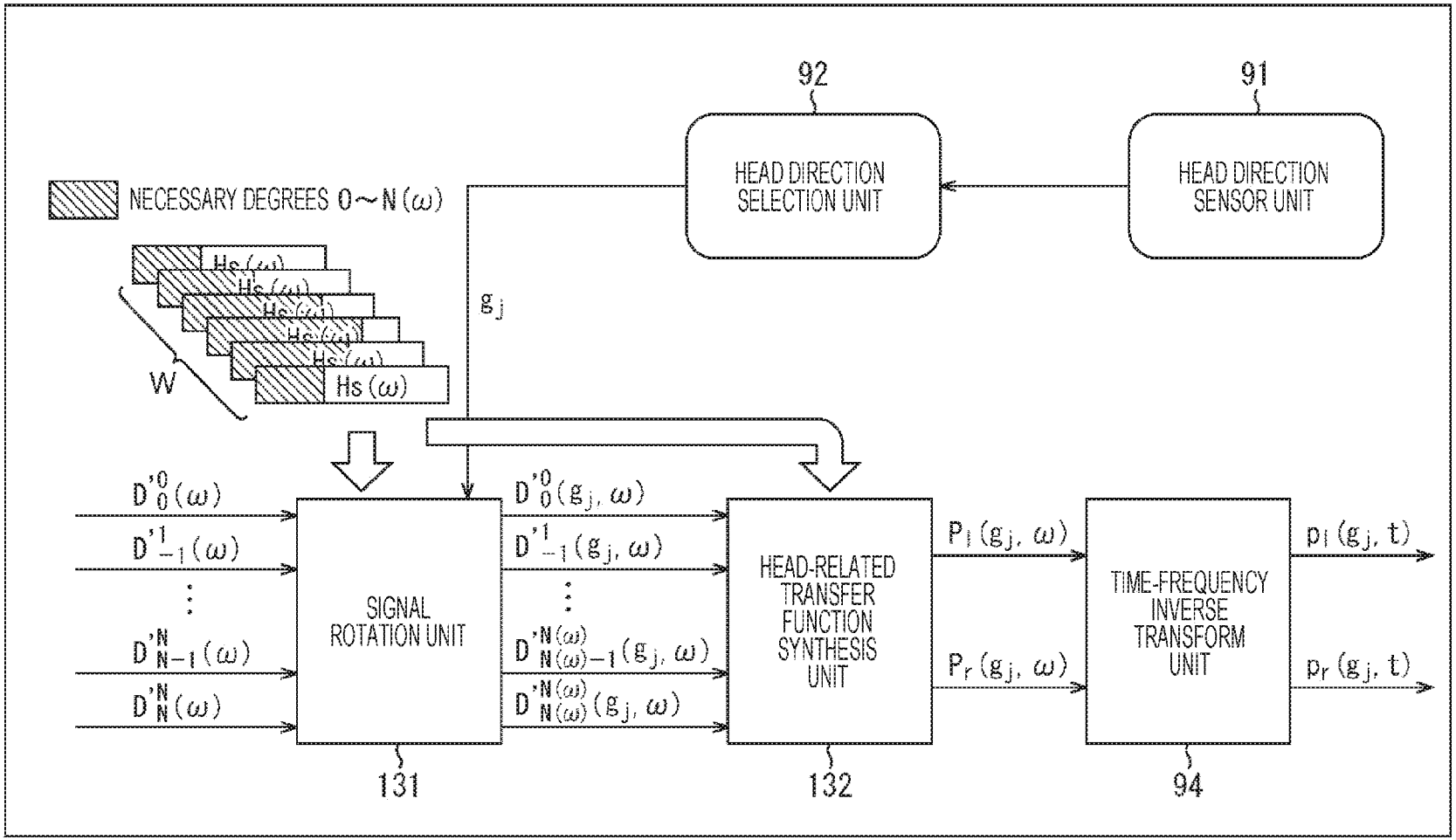
FIG. 21 is a diagram for explaining reduction in operation amount by degree-truncation.

For example, in the example of the audio processing device 121 shown in FIG. 12, the operation should be performed for only the respective elements of degrees $n=0$ to $N(\omega)$ in the signal rotation unit 131 and the head-related transfer function synthesis unit 132 as shown in FIG. 21. Note that parts in FIG. 21 corresponding to those in FIG. 12 are denoted by the same reference signs, and the descriptions thereof will be omitted.

In this example, in addition to the database of the head-related transfer function obtained by the spherical harmonic transform, that is, the matrix $H_s(\omega)$ of each time-frequency bin $\omega$, the audio processing device 121 simultaneously has, as the database, the information indicating the degree n and the degree m necessary for each time-frequency bin ω.

In FIG. 21, each of the rectangles in which the characters "$H_s(\omega)$" are written is the matrix $H_s(\omega)$ of each time-frequency bin ω kept in the head-related transfer function synthesis unit 132, and the hatched portions of these matrices $H_s(\omega)$ are the element portions of the necessary degrees n=0 to N(ω).

In this case, the information indicating the necessary degrees of each time-frequency bin ω is supplied to the signal rotation unit 131 and the head-related transfer function synthesis unit 132. Then, in the signal rotation unit 131 and the head-related transfer function synthesis unit 132, the operations in steps S43 and S44 in FIG. 13 are performed for each time-frequency bin ω from the zero-order to the degree n=N(ω) necessary for that time-frequency bin ω on the basis of the supplied information.

Specifically, for example, in the signal rotation unit 131, the operation to obtain $R'(g_j^{-1})D'(\omega)$ in Expression (26), that is, the operation to obtain the product of the rotation matrix $R'(g_j^{-1})$ and the vector D'(ω) including the input signal $D'_n{}^m(\omega)$ for each time-frequency bin ω is performed from the zero-order to the degree n=N(ω) and the degree m=M(ω) necessary for that time-frequency bin ω.

In addition, for each time-frequency bin ω, the head-related transfer function synthesis unit 132 extracts only the elements of the zero-order to the degree n=N(ω) and the degree m=M(ω) necessary for that time-frequency bin ω from among the elements of the kept matrix $H_s(\omega)$ and sets the elements as the matrix $H_s(\omega)$ used for the operation. Then, the head-related transfer function synthesis unit 132 performs the calculation to obtain the product of that matrix $H_s(\omega)$ and $R'(g_j^{-1})D'(\omega)$ for only the necessary degrees and generates the drive signals.

Thus, it is possible to reduce calculation of unnecessary degrees in the signal rotation unit 131 and the head-related transfer function synthesis unit 132.

The technique of thus performing the operation for only the necessary degrees can be applied to any of the first proposed technique, the second proposed technique, and the third proposed technique, which are previously mentioned.

For example, in the third proposed technique, suppose that the maximum value of the degree n is four and the degree necessary for a predetermined time-frequency bin ω is degree n=N(ω)=2.

In such a case, as previously mentioned, the operation amount by the third proposed technique is usually 218.3. On the other hand, when the degree n=Nω)=2 in the third proposed technique, the total operation amount is 56.3. It can be seen that the operation amount is reduced to 26% as compared with the total operation amount of 218.3 when the original degree n is four.

Figure 22:
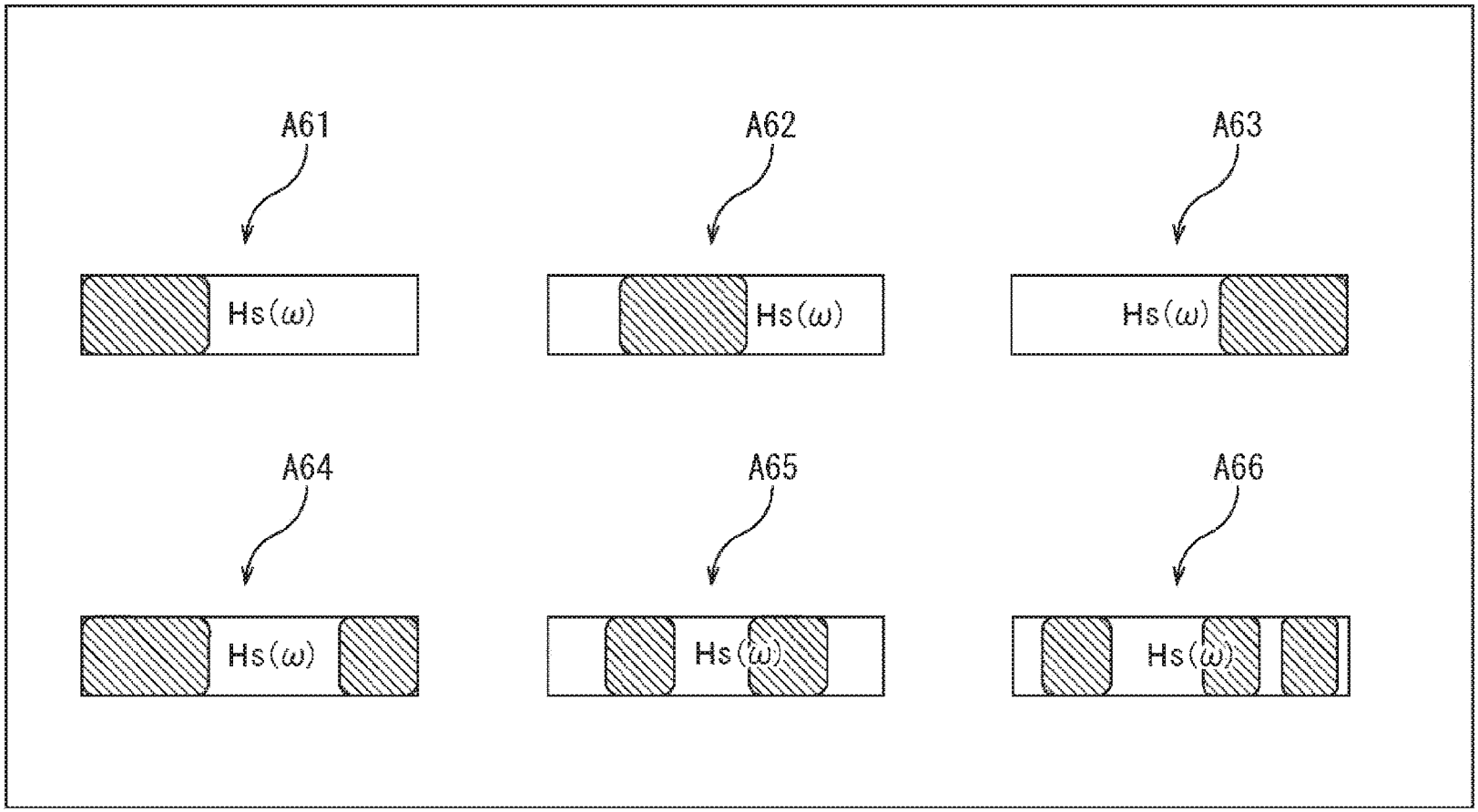
FIG. 22 is a diagram for explaining reduction in operation amount by degree-truncation.

Note that, herein, the elements of the matrix $H_s(\omega)$ and the matrix H'(ω) of the head-related transfer function used for the calculation are from the degree n=0 to N(ω), but any elements of $H_s(\omega)$ can be used as shown in FIG. 22, for example. That is, each element of a plurality of discontinuous degrees n may be used as an element used for the calculation. Note that the example of the matrix $H_s(\omega)$ is shown in FIG. 22, but the same applies to the matrix H'(ω).

In FIG. 22, a rectangle, which is indicated by each of the arrows A61 to A66 and in which the characters "$H_s(\omega)$" are written, are the matrix $H_s(\omega)$ of the predetermined time-frequency bin co kept in the head-related transfer function synthesis unit 132 and the head-related transfer function rotation unit 171. In addition, the hatched portions of these matrices $H_s(\omega)$ are the element portions of the necessary degree n and degree m.

For example, in the example indicated by each of the arrows A61 to A63, the portions including the elements adjacent to each other in the matrix $H_s(\omega)$ are element portions of the necessary degrees, and the positions (regions) of these element portions in the matrix $H_s(\omega)$ are different for each example.

On the other hand, in the example indicated by each of the arrows A64 to A66, a plurality of portions including the elements adjacent to each other in the matrix $H_s(\omega)$ are element portions of the necessary degrees. In these examples, the number, positions, and sizes of the portions including the necessary elements in the matrices $H_s(\omega)$ are different for each example.

Herein, the operation amounts and the necessary memory amounts in the general technique, the first to third proposed techniques previously mentioned and in the case where the operation is performed further for only the necessary degree n by the third proposed technique are shown in FIG. 23.

In this example, the number of time-frequency bins ω is W=100, the number of the directions of the head of the listener is M=1000, and the maximum value J of the degree is J=0 to 5. Moreover, the length of the vector D'(ω) is $K=(J+1)^2=25$, and the L number of speakers, which is the number of virtual speakers, is L=K. Furthermore, the numbers of rotation matrices R'(u(φ)), rotation matrices R'(a(θ)), and rotation matrices R'(u(ψ)) kept in the tables are 10 for all.

In FIG. 23, the field of "degree J of spherical harmonics" indicates the value of the maximum degree n=J of the spherical harmonics, and the field of "number of necessary virtual speakers" indicates the least necessary number of virtual speakers to regenerate the sound field correctly.

Further, the field of "operation amount (general technique)" indicates the number of product-sum operations necessary to generate the drive signals of the headphones by the general technique, and the field of "operation amount (first proposed technique)" indicates the number of product-sum operations necessary to generate the drive signals of the headphones by the first proposed technique.

The field of "operation amount (second proposed technique)" indicates the number of product-sum operations necessary to generate the drive signals of the headphones by the second proposed technique, and the field of "operation amount (third proposed technique)" indicates the number of product-sum operations necessary to generate the drive signals of the headphones by the third proposed technique. In addition, the field of "operation amount (third proposed technique degree −2 truncated)" indicates the number of product-sum operations necessary to generate the drive signals of the headphones by the third proposed technique and by the operation using the degree up to N(ω). This example is an example in which, in particular, the upper two orders of the degree n are truncated and the operation is not performed.

Herein, the number of product-sum operations at each time-frequency bin ω is described in each of the fields of the operation amounts in the general technique, the first proposed technique, the second proposed technique, the third proposed technique, and the case where the operation is performed using up to the degree N(ω) by the third proposed technique.

Further, the field of "memory (general technique)" indicates the memory amount necessary to generate the drive signals of the headphones by the general technique, and the field of "memory (first proposed technique)" indicates the memory amount necessary to generate the drive signals of the headphones by the first proposed technique.

Similarly, the field of "memory (second proposed technique)" indicates the memory amount necessary to generate the drive signals of the headphones by the second proposed technique, and the field of "memory (third proposed technique)" indicates the memory amount necessary to generate the drive signals of the headphones by the third proposed technique.

Note that the fields marked with "" in FIG. 23** indicates that the calculation is performed with the degree n=0 since the degree −2 is negative.

Figure 24:
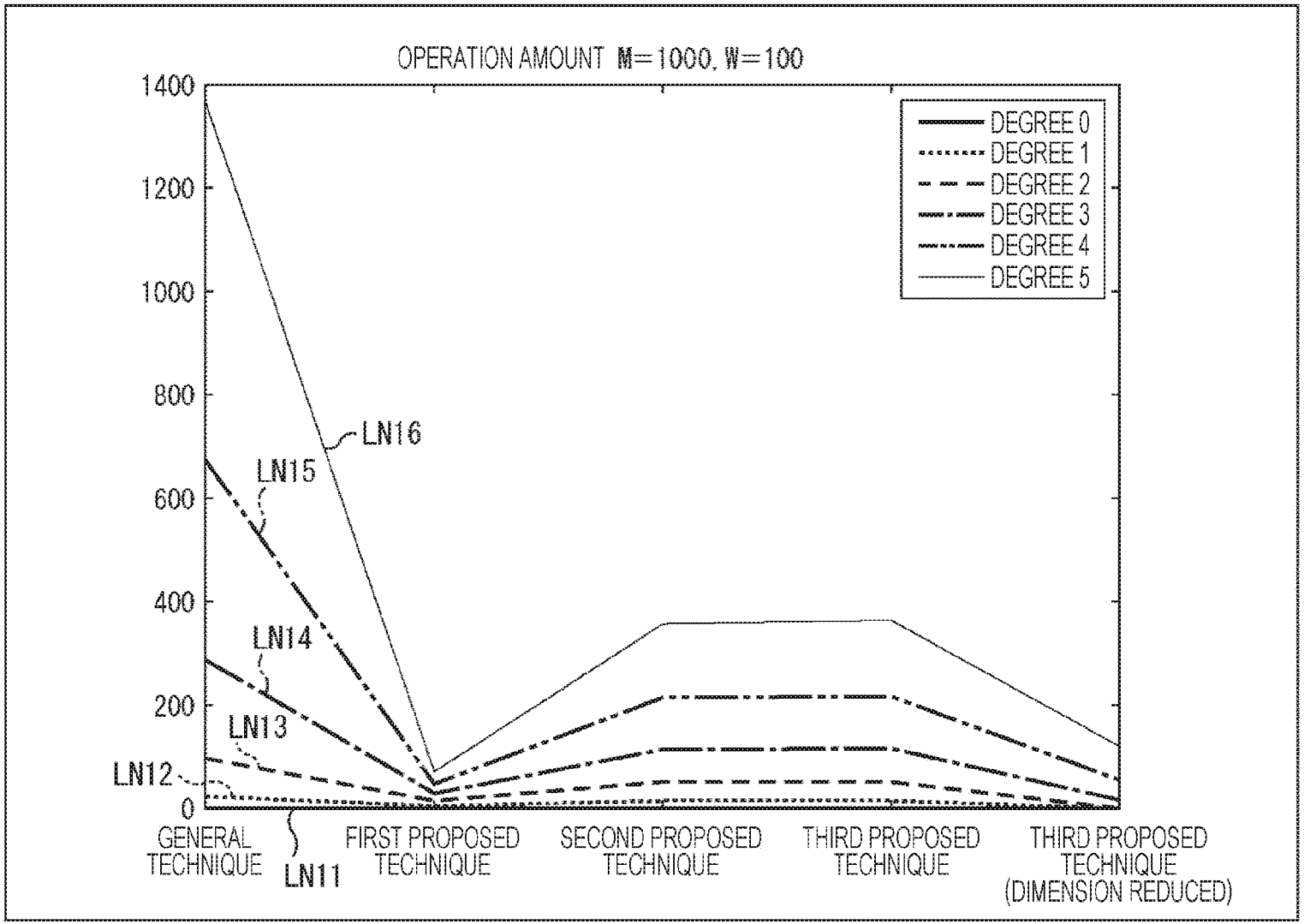
FIG. 24 is a diagram for explaining the operation amounts and necessary memory amounts of each proposed technique and the general technique.

Moreover, a graph of the operation amount for each degree by each proposed technique shown in FIG. 23 is shown in FIG. 24. Similarly, a graph of the necessary memory amount for each degree by each proposed technique shown in FIG. 23 is shown in FIG. 25.

In FIG. 24, the vertical axis represents the operation amount, that is, the number of product-sum operations, and the horizontal axis represents each technique. In addition, the polygonal lines LN11 to LN16 indicate the operation amounts of the respective techniques in a case where the maximum degree J is J=0 to 5.

As can be seen from FIG. 24, it can be seen that the first proposed technique and the technique of reducing the degrees by the third proposed technique are particularly effective in reducing the operation amounts.

Figure 25:
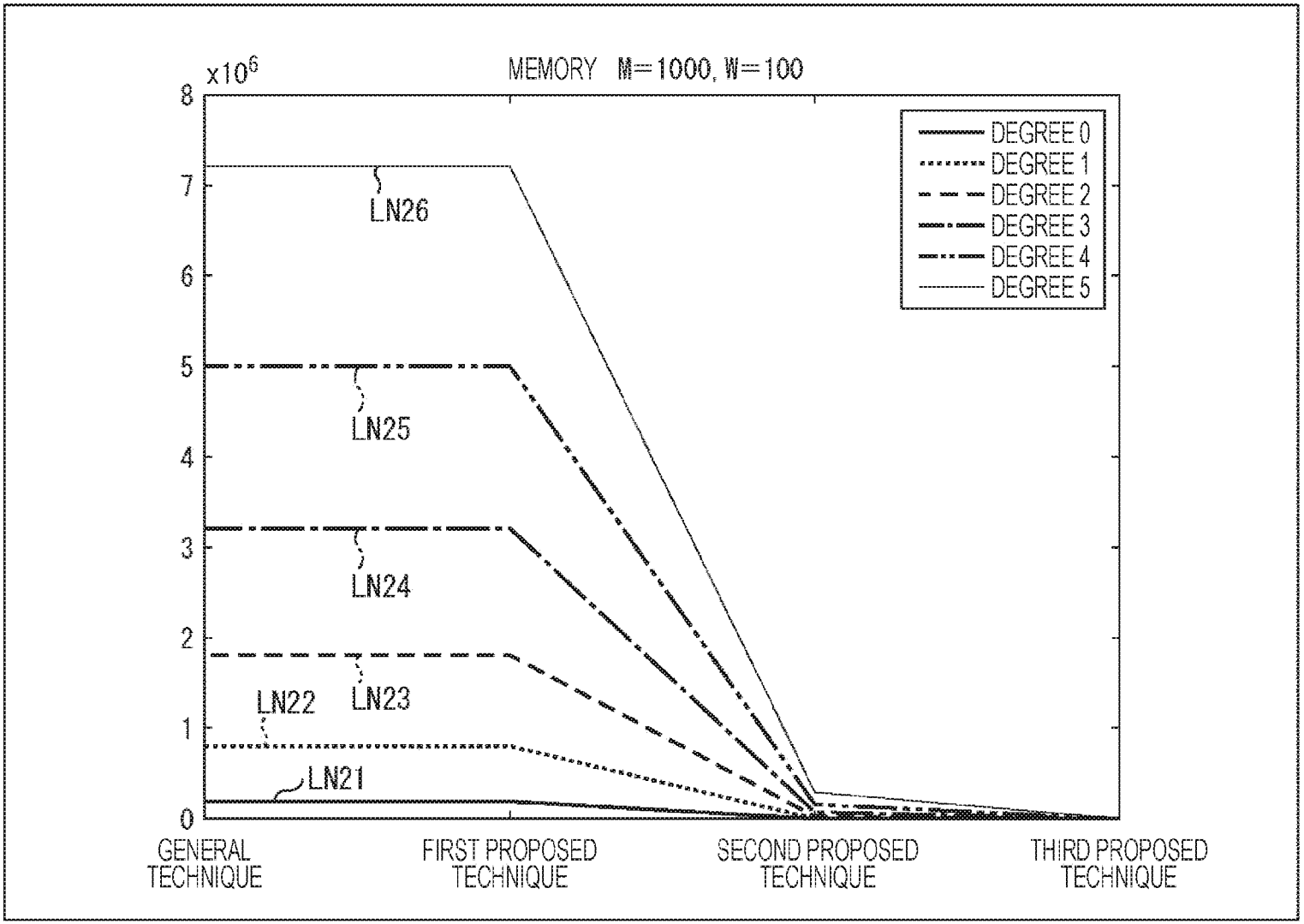
FIG. 25 is a diagram for explaining the operation amounts and necessary memory amounts of each proposed technique and the general technique.

Moreover, in FIG. 25, the vertical axis represents the necessary memory amount, and the horizontal axis represents each technique. In addition, the polygonal lines LN21 to LN26 indicate the memory amounts of the respective techniques in a case where the maximum degree J is J=0 to 5.

As can be seen from FIG. 25, it can be seen that the second proposed technique and the third proposed technique are particularly effective in reducing the necessary memory amounts.

Fifth Embodiment

<About Binaural Signal Generation in MPEG 3D>

Incidentally, in Moving Picture Experts Group (MPEG) 3D standard, HOA is prepared as a transmission path, and a binaural signal transform unit called HOA to Binaural (H2B) is prepared in a decoder.

Figure 26:
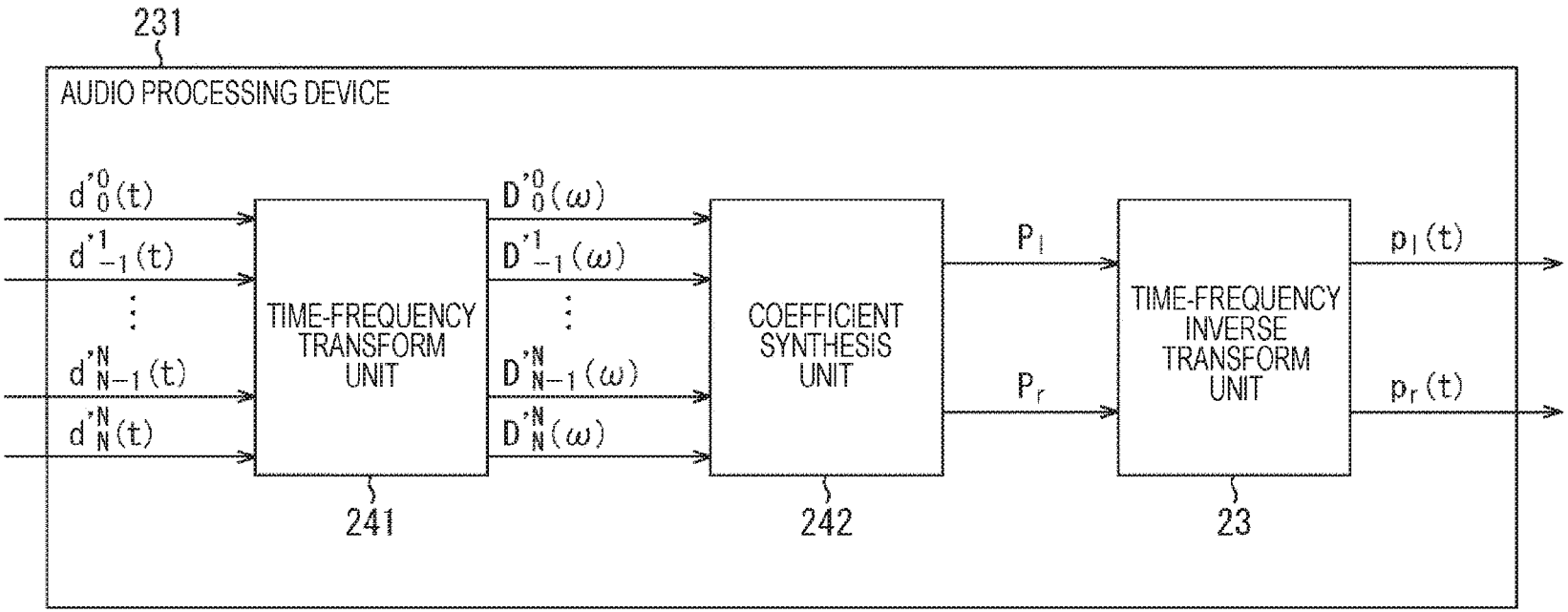
FIG. 26 is a diagram showing the configuration of a general audio processing device with the MPEG 3D standard.

That is, in the MPEG 3D standard, a binaural signal, that is, a drive signal is generally generated by an audio processing device 231 with the configuration shown in FIG. 26. Note that parts in FIG. 26 corresponding to those in FIG. 2 are denoted by the same reference signs, and the descriptions thereof will be omitted as appropriate.

An audio processing device 231 shown in FIG. 26 is configured with a time-frequency transform unit 241, a coefficient synthesis unit 242, and a time-frequency inverse transform unit 23. In this example, the coefficient synthesis unit 242 is a binaural signal transform unit.

In H2B, the head-related transfer function is kept in the form of an impulse response h(x, t), that is, a time signal, and the input signal itself of HOA, which is an audio signal, is not transmitted as the aforementioned input signal $D'_n{}^m(\omega)$ but is transmitted as a time signal, that is, a signal in the time domain.

Hereinafter, the input signal in the time domain of the HOA will be written as the input signal $d'_n{}^m(t)$. Note that, in the input signal $d'_n{}^m(t)$, n and m are the degrees of the spherical harmonics (spherical harmonic domain) similarly to the case of the aforementioned input signal $D'_n{}^m(\omega)$, and t is time.

In H2B, the input signal $d'_n{}^m(t)$ for each of these degrees is inputted into the time-frequency transform unit 241, time-frequency transform is performed on these input signals $d'_n{}^m(t)$ in the time-frequency transform unit 241, and the input signals $D'_n{}^m(\omega)$ obtained as a result are supplied to the coefficient synthesis unit 242.

In the coefficient synthesis unit 242, the product of the head-related transfer function and the input signal $D'_n{}^m(\omega)$ is obtained for all the time-frequency bins ω for each degree n and degree m of the input signal $D'_n{}^m(\omega)$.

Herein, the coefficient synthesis unit 242 keeps in advance a vector of a coefficient including the head-related transfer function. This vector is expressed by a product of the vector including the head-related transfer function and the matrix including the spherical harmonics.

In addition, the vector including the head-related transfer function is a vector including a head-related transfer function of the arrangement position of each of the virtual speakers viewed from a predetermined direction of the head of the listener.

The coefficient synthesis unit 242 keeps the vector of the coefficient in advance, obtains the product of that vector of the coefficient and the input signal $D'_n{}^m(\omega)$ supplied from the time-frequency transform unit 241 to calculate the drive signals of the left and right headphones, and supplies the drive signals to the time-frequency inverse transform unit 23.

Figure 27:
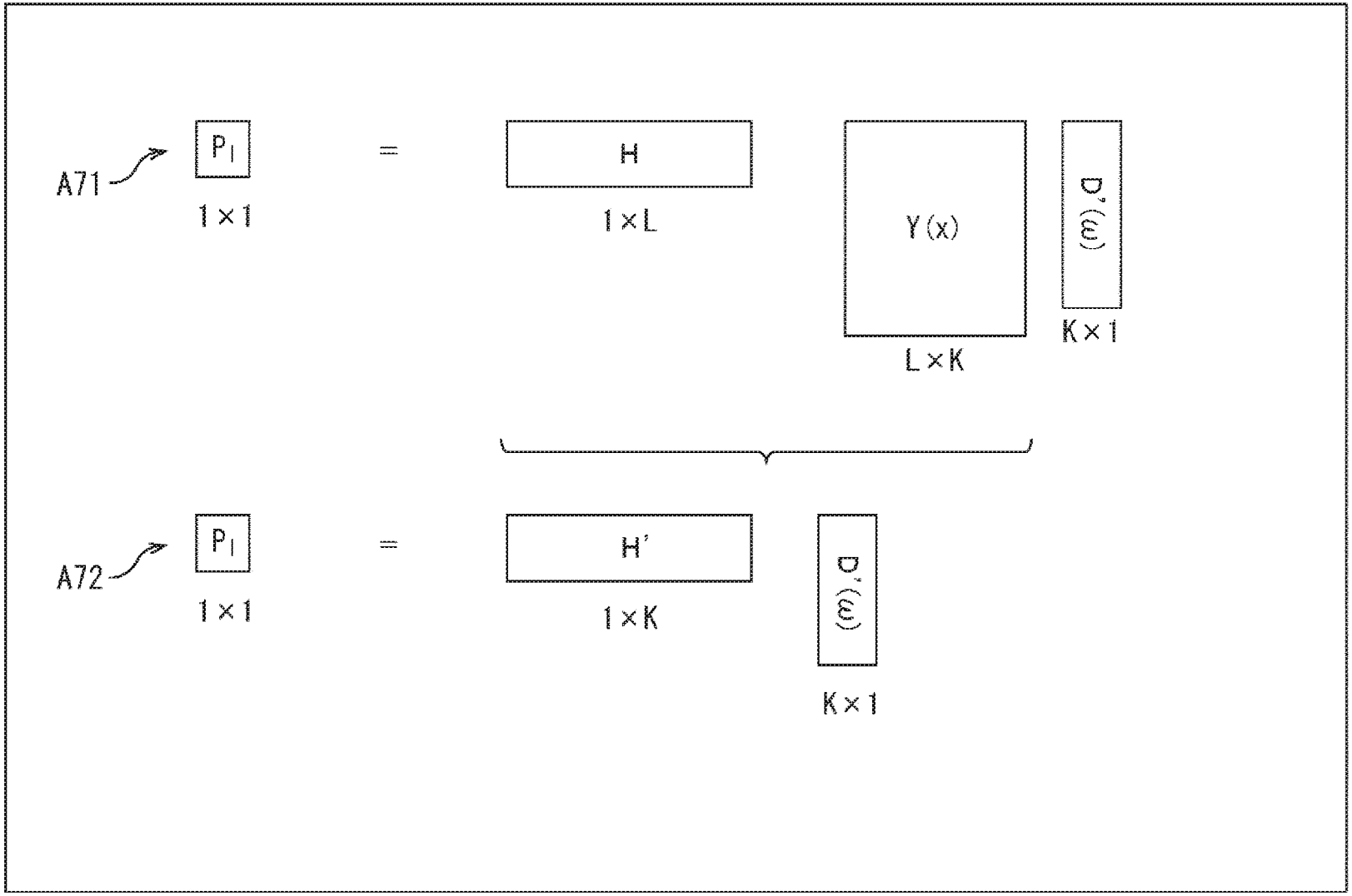
FIG. 27 is a diagram for explaining the computation of a drive signal by the general audio processing device.

Herein, the calculation by the coefficient synthesis unit 242 is the calculation as shown in FIG. 27. That is, in FIG. 27, $P_l$ is a drive signal $P_l$ of 1×1, and H is a vector of 1×L including the L number of head-related transfer functions in a preset predetermined direction.

In addition, Y(x) is a matrix of L×K including the spherical harmonics of each degree, and D'(ω) is the vector including the input signal $D'_n{}^m(\omega)$. In this example, the number of input signals $D'_n{}^m(\omega)$ of the predetermined time-frequency bin ω, that is, the length of the vector D'(ω) is K. Moreover, H' is a vector of the coefficient obtained by calculating the product of the vector H and the matrix Y(x).

In the coefficient synthesis unit 242, the drive signal $P_l$ is obtained from the vector H, the matrix Y(x), and the vector D'(ω) as indicated by the arrow A71.

Herein, the vector H' is kept in advance in the coefficient synthesis unit 242. As a result, in the coefficient synthesis unit 242, the drive signal $P_l$ is obtained from the vector H' and the vector D'(ω) as indicated by the arrow A72.

<Configuration Example of Audio Processing Device>

However, in the audio processing device 231, since the direction of the head of the listener is fixed in the preset direction, it is impossible to realize the head tracking function.

Figure 28:
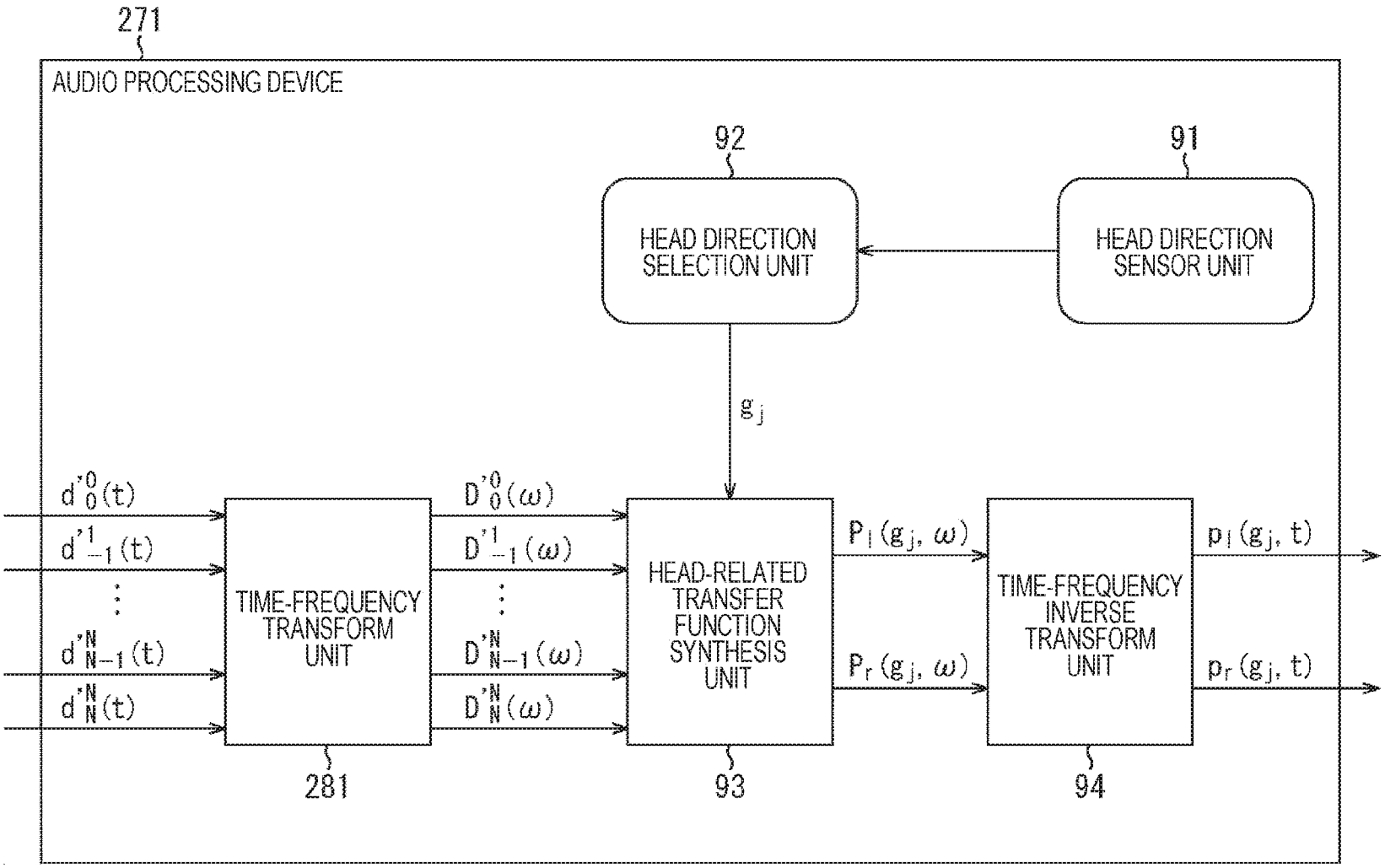
FIG. 28 is a diagram showing a configuration example of an audio processing device to which the present technology is applied.

Thereupon, in the present technology, for example, by configuring the audio processing device as shown in FIG. 28, it is possible to realize the head tracking function also in the MPEG 3D standard and more efficiently reproduce sound. Note that parts in FIG. 28 corresponding to those in FIG. 8 are denoted by the same reference signs, and the descriptions thereof will be omitted as appropriate.

An audio processing device 271 shown in FIG. 28 has a head direction sensor unit 91, a head direction selection unit 92, a time-frequency transform unit 281, a head-related transfer function synthesis unit 93, and a time-frequency inverse transform unit 94.

The configuration of this audio processing device 271 is configured such that the configuration of the audio processing device 81 shown in FIG. 8 is further provided with the time-frequency transform unit 281.

In the audio processing device 271, the input signal $d'_n{}^m(t)$ is supplied to the time-frequency transform unit 281. The time-frequency transform unit 281 performs time-frequency transform on the supplied input signal $d'_n{}^m(t)$ and supplies the input signal $D'_n{}^m(\omega)$ of the spherical harmonic domain obtained as a result to the head-related transfer function synthesis unit 93. The time-frequency transform unit 281 also performs time-frequency transform on the head-related transfer function as necessary. That is, in a case where the head-related transfer function is supplied in the form of a time signal (impulse response), time-frequency transform is performed on the head-related transfer function in advance.

Figure 29:
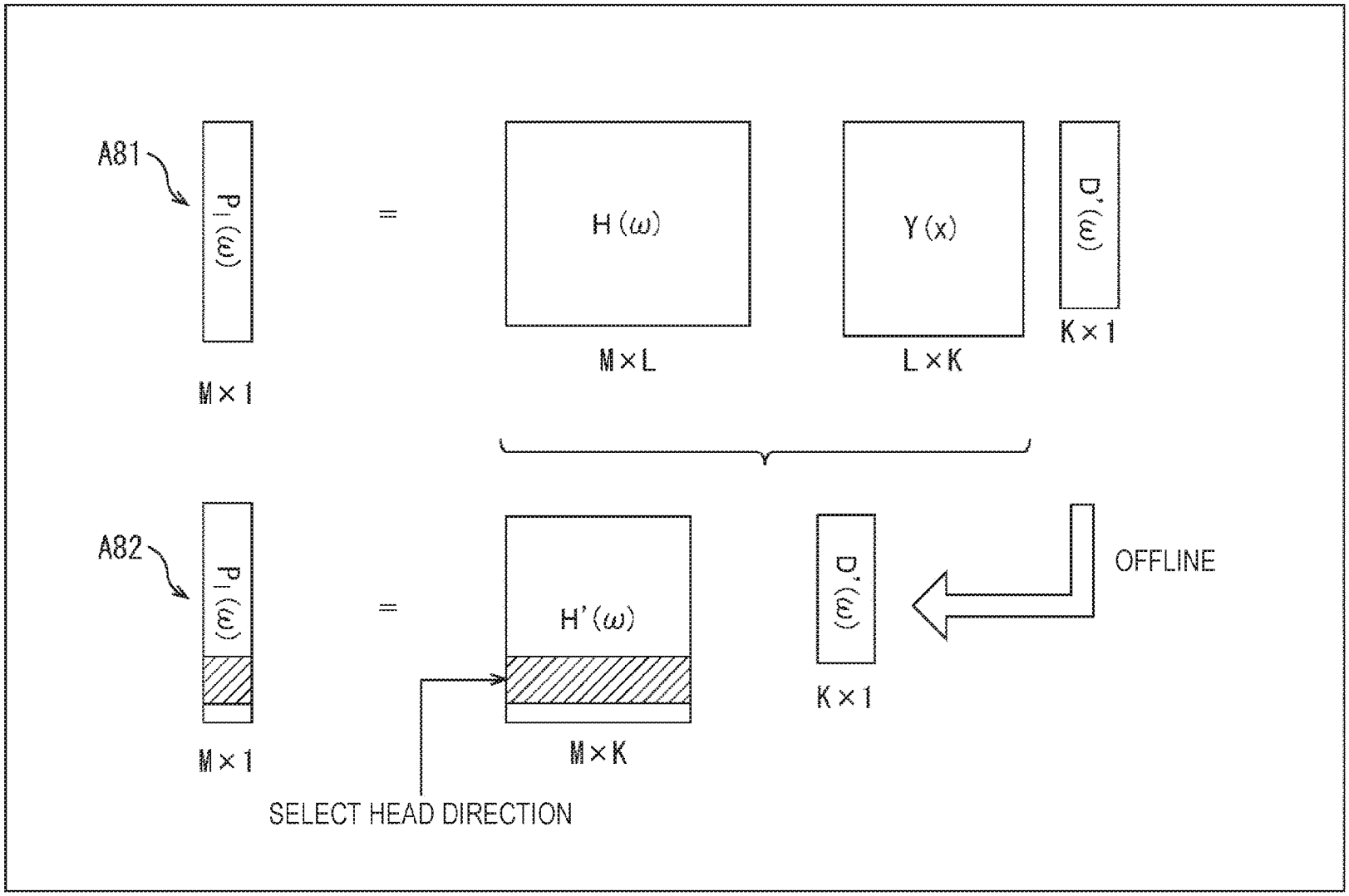
FIG. 29 is a diagram for explaining the computation of a drive signal by the audio processing device to which the present technology is applied.

In the audio processing device 271, for example, in a case of computing the drive signal $P_l(g_j, \omega)$ of the left headphone, the operation shown in FIG. 29 is performed.

That is, in the audio processing device 271, after the input signal $d'_n{}^m(t)$ is transformed into the input signal $D'_n{}^m(\omega)$ by the time-frequency transform, the matrix operation of the matrix $H(\omega)$ of $M \times L$, the matrix $Y(x)$ of $L \times K$, and the vector $D'(\omega)$ of $K \times 1$ is performed as indicated by the arrow A81.

Herein, since $H(\omega)Y(x)$ is the matrix $H'(\omega)$ as defined by the aforementioned Expression (16), the calculation shown by the arrow A81 is eventually becomes as indicated by the arrow A82. In particular, the calculation to obtain the matrix $H'(\omega)$ is performed offline, that is, in advance, and the matrix $H'(\omega)$ is kept in the head-related transfer function synthesis unit 93.

When the matrix $H'(\omega)$ is thus obtained in advance, to actually obtain the drive signals of the headphones, the row corresponding to the direction $g_j$ of the head of the listener in the matrix $H'(\omega)$ is selected, and the drive signal $P_l(g_j, \omega)$ of the left headphone is computed by obtaining the product of that selected row and the vector $D'(\omega)$ including the inputted input signal $D'_n{}^m(\omega)$. In FIG. 29, the hatched portion in the matrix $H'(\omega)$ is the row corresponding to the direction $g_j$.

According to the technique of generating the drive signals of the headphones by such an audio processing device 271, similarly to the case of the audio processing device 81 shown in FIG. 8, it is possible to greatly reduce the operation amount when the drive signals of the headphones are generated as well as to greatly reduce the memory amount necessary for the operation. It is also possible to realize the head tracking function.

Note that the time-frequency transform unit 281 may be provided before the signal rotation unit 131 of the audio processing device 121 shown in FIG. 12 or 17, or the time-frequency transform unit 281 may be provided before the head-related transfer function synthesis unit 172 of the audio processing device 161 shown in FIG. 14 or 19.

Moreover, for example, even in the case where the time-frequency transform unit 281 is provided before the signal rotation unit 131 of the audio processing device 121 shown in FIG. 12, it is possible to further reduce the operation amount by truncating the degree.

In this case, similarly to the case described with reference to FIG. 21, information indicating the necessary degree for each time-frequency bin $\omega$ is supplied to the time-frequency transform unit 281, the signal rotation unit 131, and the head-related transfer function synthesis unit 132, and the operation is performed for only the necessary degree in each unit.

Similarly, even in the case where the time-frequency transform unit 281 is provided in the audio processing device 121 shown in FIG. 17 or the audio processing device 161 shown in FIG. 14 or 19, only the necessary degree may be calculated for each time-frequency bin $\omega$.

Sixth Embodiment

<Reduction of Necessary Memory Amount Relating to Head-Related Transfer Function>

Incidentally, since the head-related transfer function is a filter formed according to diffraction and reflection by the head, auricles, and the like of the listener, the head-related transfer function is different for each individual listener. Therefore, optimizing the head-related transfer functions for individuals is important for binaural reproduction.

However, it is inappropriate to keep the head-related transfer functions for individuals by the number of predictable listeners from the viewpoint of the memory amount. The same applies to a case where the head-related transfer function is kept in the spherical harmonic domain.

If a head-related transfer function optimized for an individual is used in the reproduction system to which each of the aforementioned proposed techniques is applied, it is possible to reduce the necessary individual dependent parameters by designating a degree not dependent and a degree dependent on individuals in advance for each time-frequency bin $\omega$ or for all time-frequency bins $\omega$. In addition, to estimate the head-related transfer function of an individual listener from the shape of the body and the like, it is conceivable to set the individual dependent coefficient (head-related transfer function) in this spherical harmonic domain as the objective variable.

Hereinafter, an example of reducing the individual dependent parameters in the audio processing device 121 shown in FIG. 12 will be specifically described. In addition, an element, which constitutes the matrix $H_s(\omega)$ and is represented by the product of the spherical harmonics of the degree n and the degree m and the head-related transfer function, is written as a head-related transfer function $H'_n{}^m(x, \omega)$ hereinafter.

First, degrees dependent on individuals are the degree n and the degree m in which transfer characteristics greatly differs for each individual user, that is, the head-related transfer function $H'_n{}^m(x, \omega)$ differs for each user. Conversely, degrees not dependent on individuals are the degree n and the degree m of the head-related transfer function $H'_n{}^m(x, \omega)$ in which the difference in transfer characteristics between individuals is sufficiently small.

Figure 30:
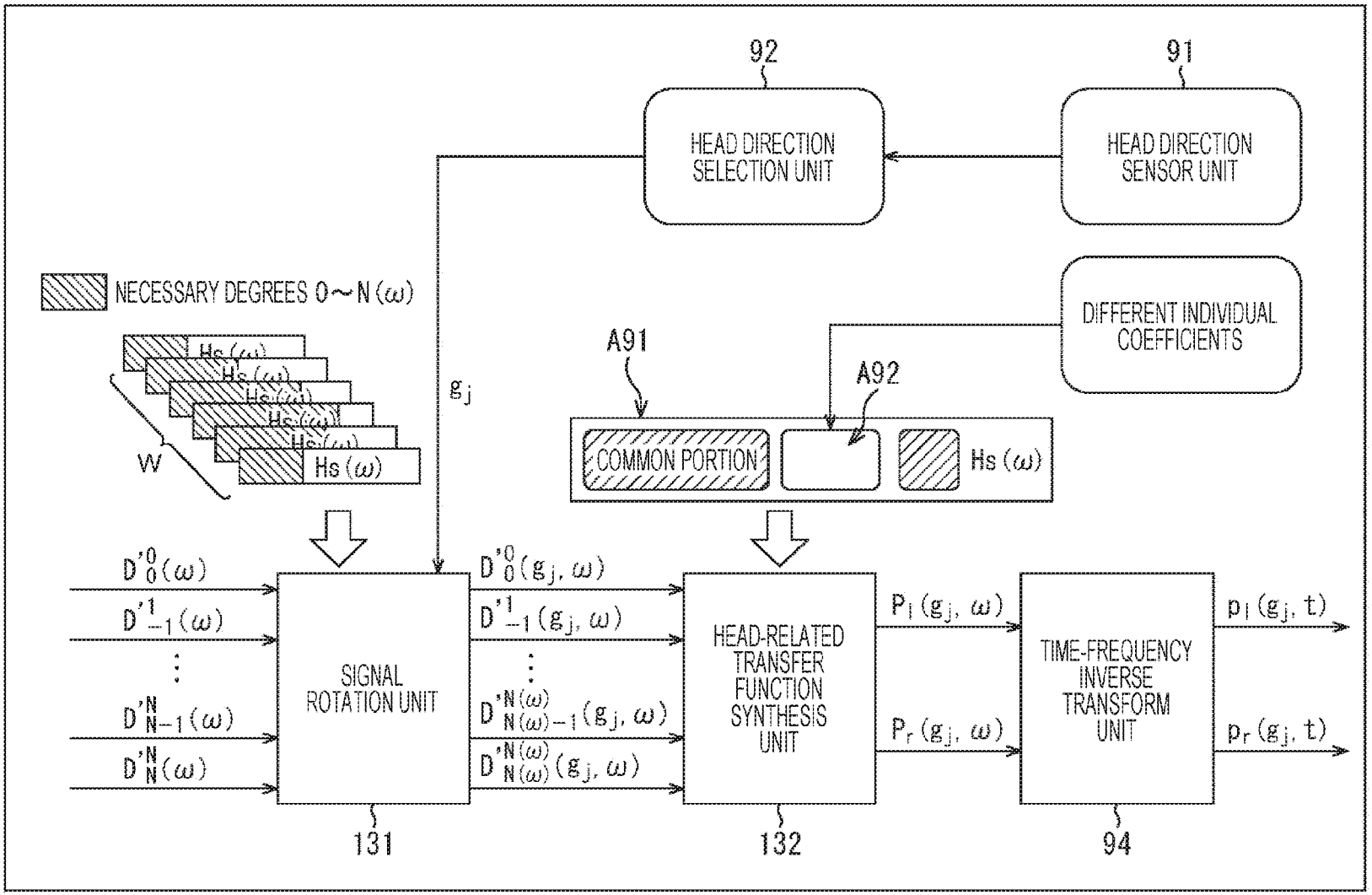
FIG. 30 is a diagram for explaining the generation of a matrix of head-related transfer functions.

In a case of thus generating the matrix $H_s(\omega)$ from the head-related transfer function of the degrees not dependent on individuals and the head-related transfer function of the degrees dependent on individuals, for example, in the example of the audio processing device 121 shown in FIG. 12, the head-related transfer function of the degrees dependent on individuals is acquired by some method as shown in FIG. 30. Note that parts in FIG. 30 corresponding to those in FIG. 12 are denoted by the same reference signs, and the descriptions thereof will be omitted as appropriate.

In the example in FIG. 30, the rectangle, which is indicated by the arrow A91 and in which the characters "$H_s(\omega)$" are written, is the matrix $H_s(\omega)$ of the time-frequency bin $\omega$, and the hatched portions are portions kept by the audio processing device 121 in advance, that is, portions of the head-related transfer function $H'_n{}^m(x, \omega)$ of the degrees not dependent on individuals. On the other hand, the portion indicated by the arrow A92 in the matrix $H_s(\omega)$ is a portion of the head-related transfer function $H'_n{}^m(x, \omega)$ of the degrees dependent on individuals.

In this example, the head-related transfer function $H'_n{}^m(x, \omega)$ of the degrees not dependent on individuals represented by the hatched portions in the matrix $H_s(\omega)$ is the head-related transfer function commonly used for all the users. On the other hand, the head-related transfer function $H'_n{}^m(x, \omega)$ of the degrees dependent on individuals indicated by the arrow A92 is the head-related transfer function, which is different and used for each user, such as optimized one for each individual user.

The audio processing device 121 acquires the head-related transfer function $H'_n{}^m(x, \omega)$ of the degrees dependent on individuals represented by the quadrangle, in which the characters "different individual coefficients" are written, from the outside, generates the matrix $H_s(\omega)$ from that acquired head-related transfer function $H'_n{}^m(x, \omega)$ and the head-related transfer function $H'_n{}^m(x, \omega)$ of the degrees not dependent on individuals kept in advance, and supplies the matrix $H_s(\omega)$ to the head-related transfer function synthesis unit 132.

Note that, at this time, the matrix $H_s(\omega)$ including only the element of the necessary degree is generated for each time-frequency bin $\omega$ on the basis of the information indicating the necessary degree $n=N(\omega)$ of the time-frequency bin $\omega$.

Then, in the signal rotation unit 131 and the head-related transfer function synthesis unit 132, the operation is performed for only the necessary degree on the basis of the information indicating the necessary degree $n=N(\omega)$ of each time-frequency bin $\omega$.

Note that, the example, in which the matrix $H_s(\omega)$ is constituted by the head-related transfer function commonly used for all the users and the head-related transfer function different and used for each user, is described herein, but the all the nonzero elements of the matrix $H_s(\omega)$ may be different for each user. Alternatively, the same matrix $H_s(\omega)$ may be commonly used by all the users.

Moreover, the example, in which the head-related transfer function $H'_n{}^m(x, \omega)$ of the spherical harmonic domain is acquired to generate the matrix $H_s(\omega)$, has been described herein, but the elements of the matrix $H(\omega)$ corresponding to the degrees dependent on individuals, that is, the elements of the matrix $H(x, \omega)$ may be acquired to calculate $H(x, \omega)Y(x)$ and generate the matrix $H_s(\omega)$.

<Configuration Example of Audio Processing Device>

Figure 31:
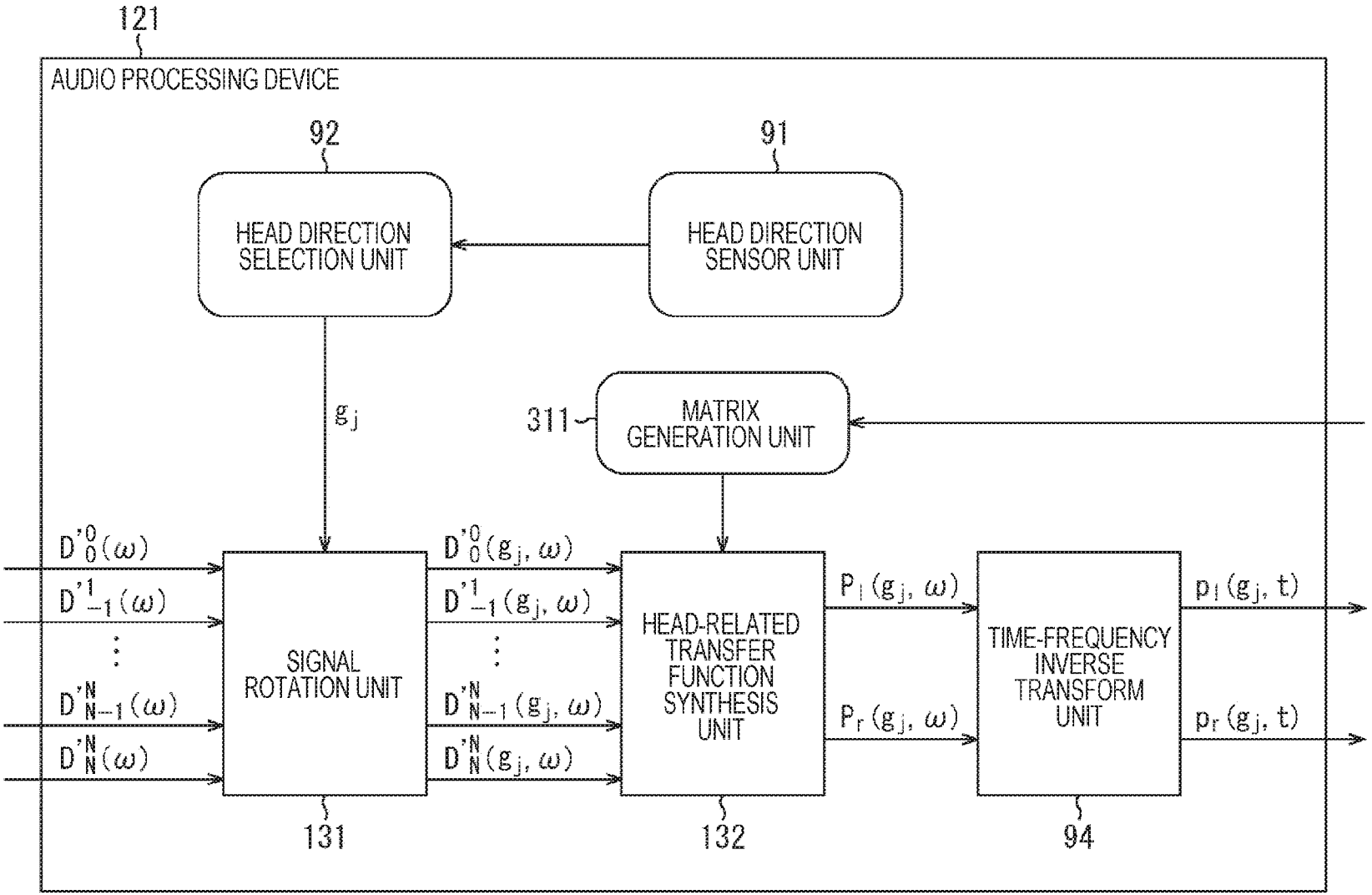
FIG. 31 is a diagram showing a configuration example of an audio processing device to which the present technology is applied.

In the case of thus generating the matrix $H_s(\omega)$, the audio processing device 121 is configured, for example, as shown in FIG. 31. Note that parts in FIG. 31 corresponding to those in FIG. 12 are denoted by the same reference signs, and the descriptions thereof will be omitted as appropriate.

The audio processing device 121 shown in FIG. 31 has a head direction sensor unit 91, a head direction selection unit 92, a matrix generation unit 311, a signal rotation unit 131, a head-related transfer function synthesis unit 132, and a time-frequency inverse transform unit 94.

The configuration of the audio processing device 121 shown in FIG. 31 is configured such that the audio processing device 121 shown in FIG. 12 is further provided with the matrix generation unit 311.

The matrix generation unit 311 keeps in advance the head-related transfer function of the degrees not dependent on individuals, acquires the head-related transfer function of the degrees dependent on individuals from the outside, generates the matrix $H_s(\omega)$ from the acquired head-related transfer function and the head-related transfer function of the degrees not dependent on individuals kept in advance, and supplies the matrix $H_s(\omega)$ to the head-related transfer function synthesis unit 132. This matrix $H_s(\omega)$ can also be said to be a vector with the head-related transfer function of the spherical harmonic domain as an element.

Note that the degrees not dependent on individuals and the degrees dependent on individuals of the head-related transfer functions may be different for each time-frequency $\omega$ or may be the same.

<Explanation of Drive Signal Generation Processing>

Figure 32:
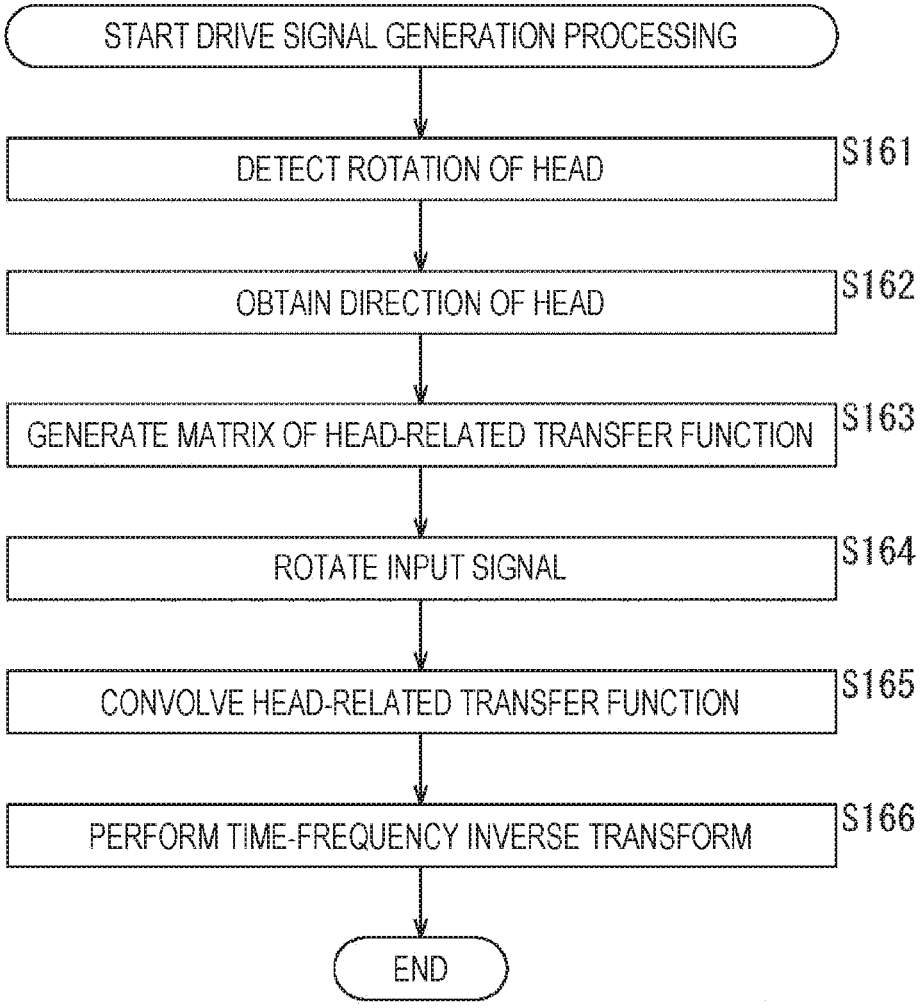
FIG. 32 is a flowchart for explaining the drive signal generation processing.

Next, with reference to the flowchart in FIG. 32, the drive signal generation processing performed by the audio processing device 121 with the configuration shown in FIG. 31 will be described. This drive signal generation processing is started when the input signal $D'_n{}^m(\omega)$ is supplied from the outside. Note that processing in steps S161 and S162 are similar to the processing in steps S41 and S42 in FIG. 13 so that descriptions thereof will be omitted.

In step S163, the matrix generation unit 311 generates the matrix $H_s(\omega)$ of the head-related transfer function and supplies the matrix $H_s(\omega)$ to the head-related transfer function synthesis unit 132.

That is, the matrix generation unit 311 acquires the head-related transfer function of the degrees dependent on individuals from the outside for the listener who listens to the sound reproduced this time, that is, the user. For example, the head-related transfer function of the user is designated by an input manipulation by the user or the like and is acquired from an external device or the like.

After acquiring the head-related transfer function of the degrees dependent on individuals, the matrix generation unit 311 generates the matrix $H_s(\omega)$ from that acquired head-related transfer function and the head-related transfer function of the degrees not dependent on individuals kept in advance, and supplies the obtained matrix $H_s(\omega)$ to the head-related transfer function synthesis unit 132.

At this time, the matrix generation unit 311 generates the matrix $H_s(\omega)$ including only the element of the necessary degree for each time-frequency bin $\omega$ on the basis of the information indicating the necessary degree $n=N(\omega)$ of each time-frequency bin $\omega$ kept in advance.

After the matrix $H_s(\omega)$ of each time-frequency bin $\omega$ is generated, the processing in steps S164 to S166 are performed thereafter, and the drive signal generation processing ends. These processing are similar to the processing in steps S43 to S45 in FIG. 13 so that descriptions thereof will be omitted. However, in steps S164 and S165, the operation is performed for only the element of the necessary degree on the basis of the information indicating the necessary degree $n=N(\omega)$ of each time-frequency bin $\omega$.

As described above, the audio processing device 121 convolves the head-related transfer functions with the input signals in the spherical harmonic domain and computes the drive signals of the left and right headphones. Thus, it is possible to greatly reduce the operation amount when the drive signals of the headphones are generated as well as to greatly reduce the memory amount necessary for the operation.

In particular, since the audio processing device 121 acquires the head-related transfer function of the degrees dependent on individuals from the outside to generate the matrix $H_s(\omega)$, it is possible not only to further reduce the memory amount, but also to regenerate the sound field appropriately by using the head-related transfer function suitable for the individual user.

Note that, the example, in which the technology for generating the matrix $H_s(\omega)$ by acquiring the head-related transfer function of the degrees dependent on individuals from the outside is applied to the audio processing device 121, has been described herein. However, this technology is not limited to such an example and may be applied to the audio processing device 81, the audio processing device 121 shown in FIG. 17, the audio processing device 161 and the audio processing device 271 shown in FIGS. 14 and 19, and the like, which have been previously mentioned, and reduction in unnecessary degrees may be performed at that time.

Seventh Embodiment

<Configuration Example of Audio Processing Device>

Figure 33:
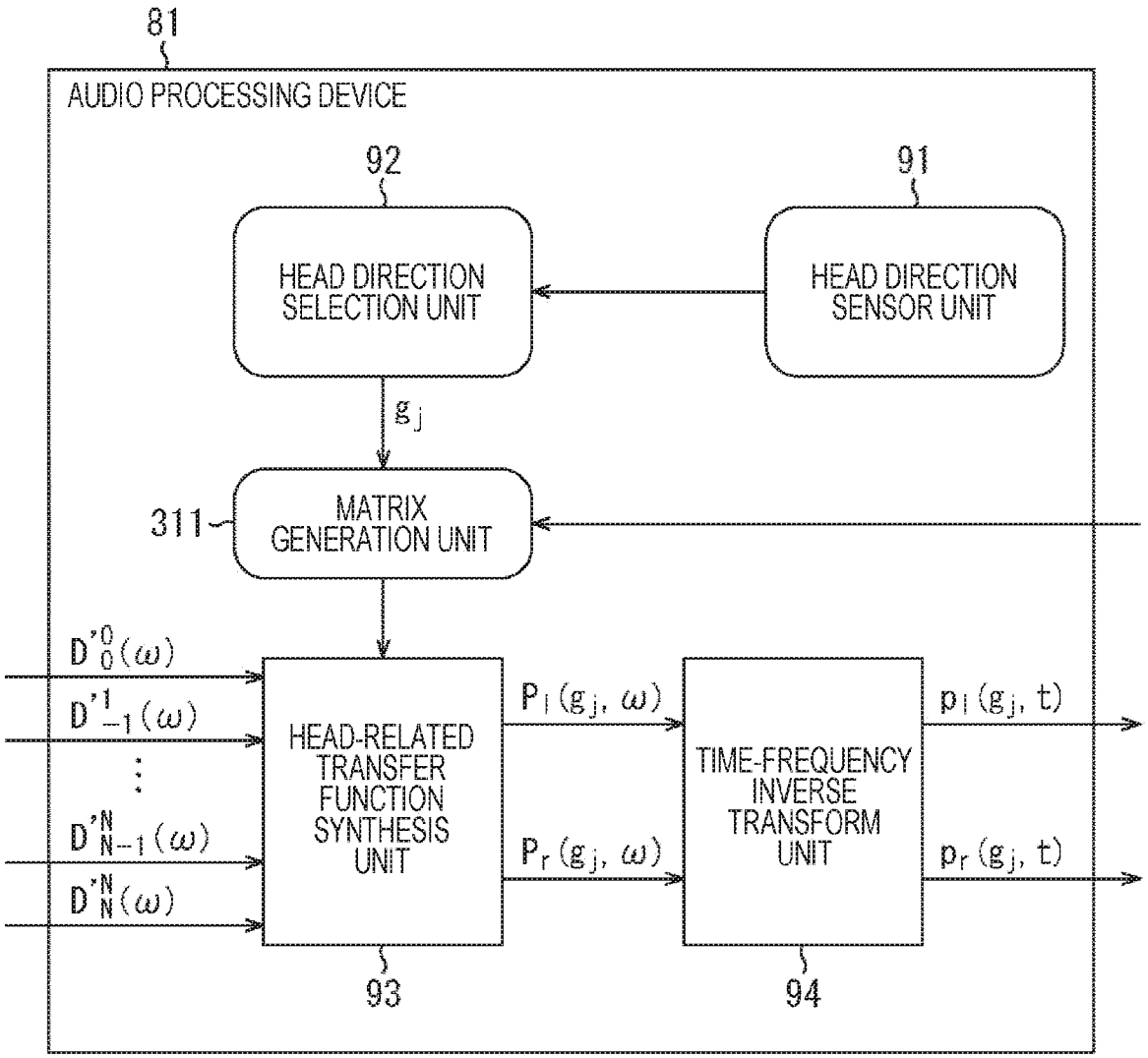
FIG. 33 is a diagram showing a configuration example of an audio processing device to which the present technology is applied.

For example, in a case where the row corresponding to the direction $g_j$ in the matrix H'(ω) of the head-related transfer function is generated by using the head-related transfer function of the degrees dependent on individuals in the audio processing device 81 shown in FIG. 8, the audio processing device 81 is configured as shown in FIG. 33. Note that parts in FIG. 33 corresponding to those in FIG. 8 or 31 are denoted by the same reference signs, and the descriptions thereof will be omitted as appropriate.

The audio processing device 81 shown in FIG. 33 is configured such that the audio processing device 81 shown in FIG. 8 is further provided with a matrix generation unit 311.

In the audio processing device 81 in FIG. 33, the matrix generation unit 311 keeps in advance the head-related transfer function of the degrees not dependent on individuals constituting the matrix H'(ω).

On the basis of the direction $g_j$ supplied from a head direction selection unit 92, the matrix generation unit 311 acquires the head-related transfer function of the degrees dependent on individuals for that direction $g_j$ from the outside, generates the row corresponding to the direction $g_j$ of the matrix H'(ω) from the acquired head-related transfer function and the head-related transfer function of the degrees not dependent on individuals for the direction $g_j$ kept in advance, and supplies the row to the head-related transfer function synthesis unit 93. The row corresponding to the direction $g_j$ of the matrix H'(ω) thus obtained is a vector with the head-related transfer function for the direction $g_j$ as an element. Alternatively, the matrix generation unit 311 may acquire the head-related transfer function of the spherical harmonic domain of the degrees dependent on individuals for the reference direction, generates the matrix $H_s(\omega)$ from the acquired head-related transfer function and the head-related transfer function of the degrees not dependent on individuals for the reference direction kept in advance, further generates the matrix $H_s(\omega)$ for the direction $g_j$ from the product of the rotation matrix $H_s(\omega)$ and the rotation matrix relating to the direction $g_j$ supplied from the head direction selection unit 92, and supplies the matrix $H_s(\omega)$ to the head-related transfer function synthesis unit 93.

Note that the matrix generation unit 311 generates the one including only the element of the necessary degree as the row corresponding to the direction $g_j$ of the matrix H'(ω) on the basis of the information indicating the necessary degree n=N(ω) of each time-frequency bin ω kept in advance.

<Explanation of Drive Signal Generation Processing>

Figure 34:
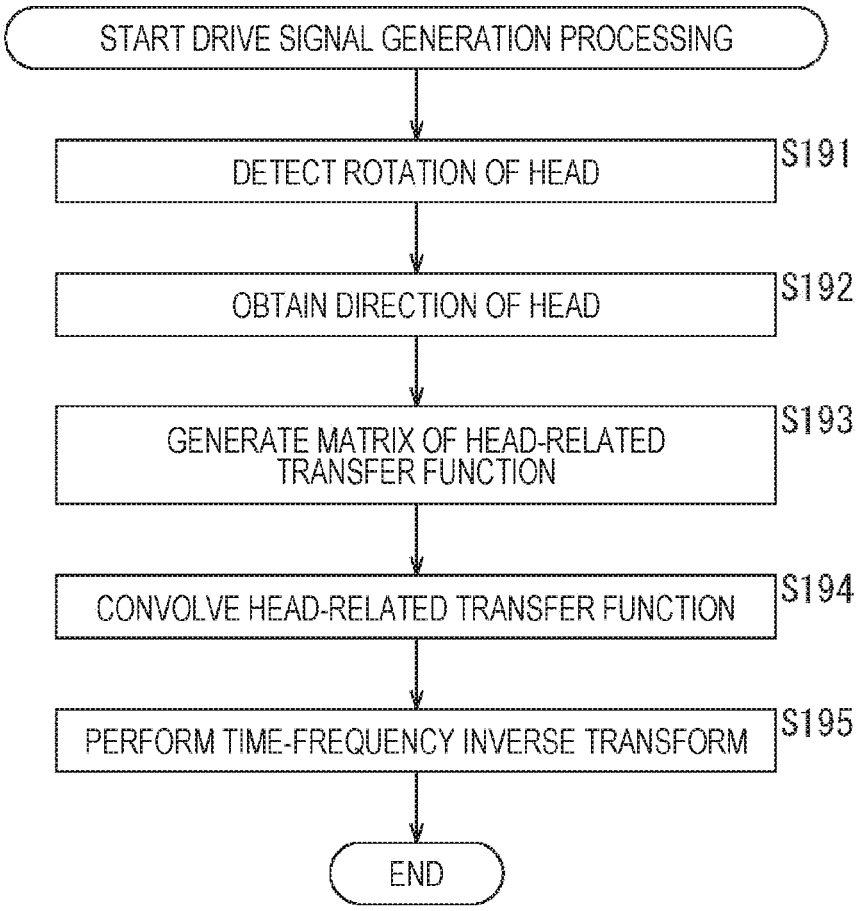
FIG. 34 is a flowchart for explaining the drive signal generation processing.

Next, with reference to the flowchart in FIG. 34, the drive signal generation processing performed by the audio processing device 81 with the configuration shown in FIG. 33 will be described. This drive signal generation processing is started when the input signal $D'_n{}^m(\omega)$ is supplied from the outside.

Figure 9:
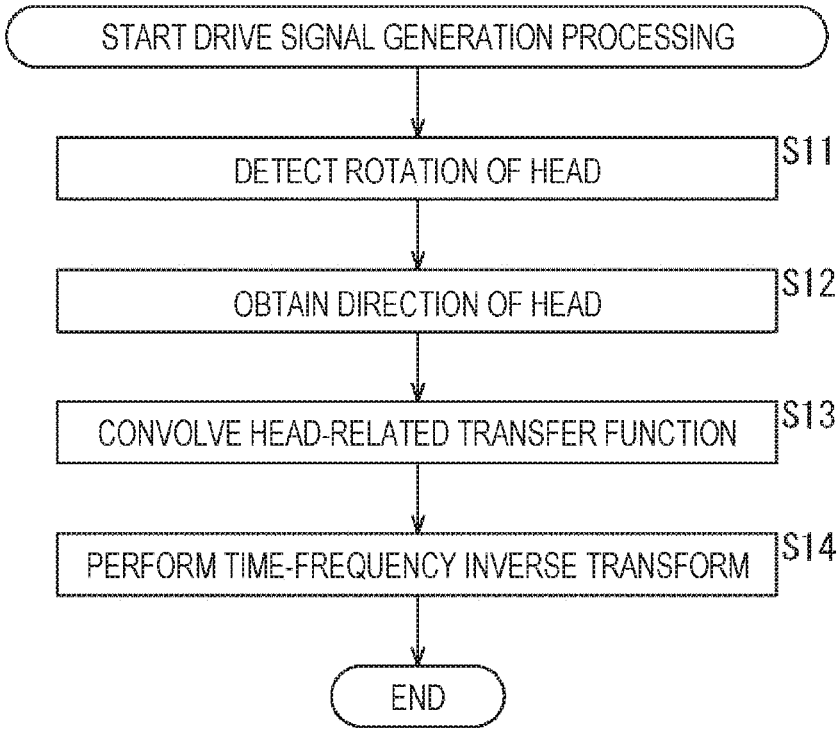
FIG. 9 is a flowchart for explaining the drive signal generation processing.

Note that processing in steps S191 and S192 are similar to the processing in steps S11 and S12 in FIG. 9 so that descriptions thereof will be omitted. However, in step S192, the head direction selection unit 92 supplies the obtained direction $g_j$ of the head of the listener to the matrix generation unit 311.

In step S193, on the basis of the direction $g_j$ supplied from the head direction selection unit 92, the matrix generation unit 311 generates the matrix H'(ω) of the head-related transfer function and supplies the matrix H'(ω) to the head-related transfer function synthesis unit 93.

That is, the matrix generation unit 311 acquires the head-related transfer function of the degrees dependent on individuals for the direction $g_j$ of the head of the user from the outside, which is prepared in advance for the listener who listens to the sound reproduced this time, that is, the user. At this time, the matrix generation unit 311 acquires only the head-related transfer function of the necessary degree for each time-frequency bin ω on the basis of the information indicating the necessary degree n=N(ω) of each time-frequency bin ω.

In addition, the matrix generation unit 311 acquires only the element of the necessary degree indicated by the information indicating the necessary degree n=N(ω) of each time-frequency bin ω from the row which includes only the element of the degrees not dependent on individuals kept in advance and corresponds to the direction $g_j$ of the matrix H'(ω).

Then, the matrix generation unit 311 generates the row, which includes only the element of the necessary degree and corresponds to the direction $g_j$ of the matrix H'(ω), that is, the vector including the head-related transfer function corresponding to the direction $g_j$ for each time-frequency bin co from the acquired head-related transfer function of the degrees dependent on individuals and the head-related transfer function of the degrees not dependent on individuals acquired from the matrix H'(ω) and supplies the vector to the head-related transfer function synthesis unit 93.

Once the processing in step S193 is performed, the processing in steps S194 and S195 are performed thereafter, and the drive signal generation processing ends. These processing are similar to the processing in steps S13 and S14 in FIG. 9 so that descriptions thereof will be omitted.

As described above, the audio processing device 81 convolves the head-related transfer functions with the input signals in the spherical harmonic domain and computes the drive signals of the left and right headphones. Thus, it is possible to greatly reduce the operation amount when the drive signals of the headphones are generated as well as to greatly reduce the memory amount necessary for the operation. In other words, it is possible to reproduce sound more efficiently.

In particular, since the head-related transfer function of the degrees dependent on individuals is acquired from the outside to generate the row which includes only the element of the necessary degree and corresponds to the direction $g_j$ of the matrix H'(ω), it is possible not only to further reduce the memory amount and the operation amount, but also to regenerate the sound field appropriately by using the head-related transfer function suitable for the individual user.

<Configuration Example of Computer>

Incidentally, the series of processing described above can be executed by hardware or can be executed by software. In a case where the series of processing is executed by the software, a program configuring that software is installed in a computer. Herein, the computer includes a computer incorporated into dedicated hardware and, for example, a general-purpose computer capable of executing various functions by being installed with various programs.

Figure 35:
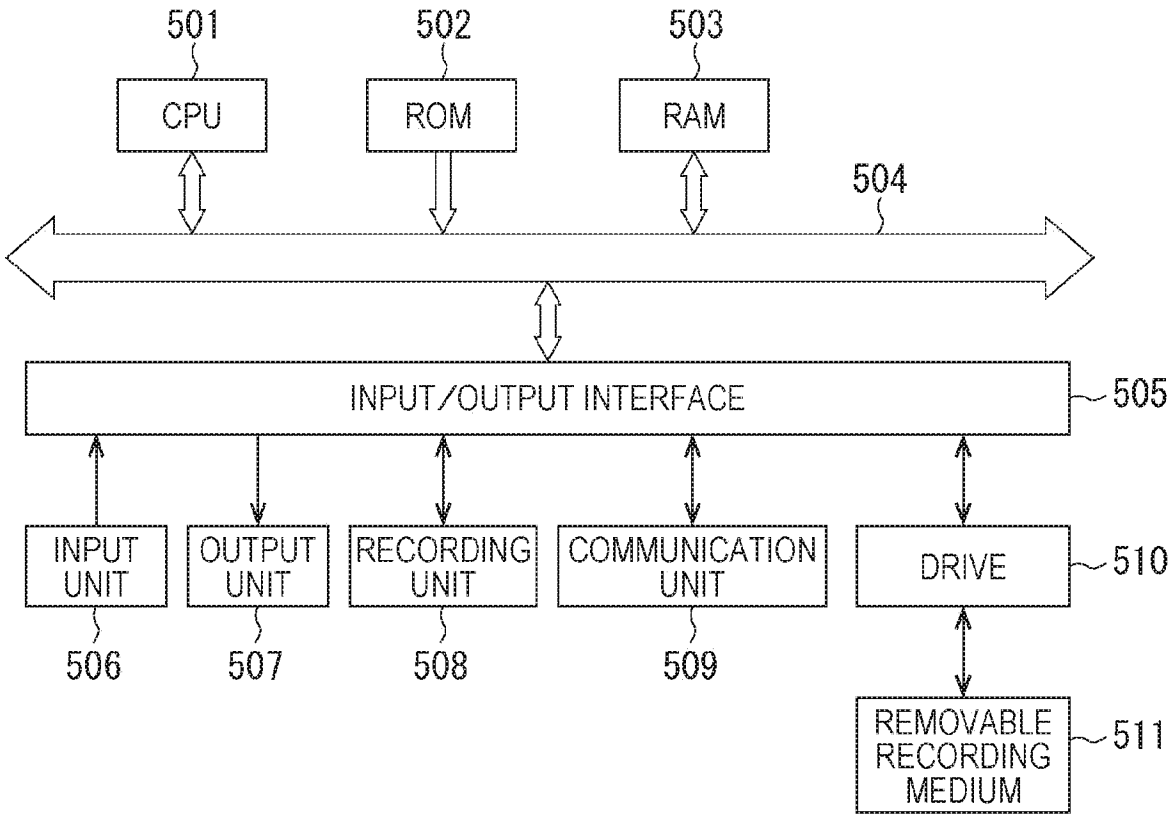
FIG. 35 is a diagram showing a configuration example of a computer.

FIG. 35 is a block diagram showing a configuration example of hardware of a computer which executes the aforementioned series of processing by a program.

In the computer, a central processing unit (CPU) 501, a read only memory (ROM) 502, and a random access memory (RAM) 503 are connected to each other by a bus 504.

The bus 504 is further connected to an input/output interface 505. To the input/output interface 505, an input unit 506, an output unit 507, a recording unit 508, a communication unit 509, and a drive 510 are connected.

The input unit 506 includes a keyboard, a mouse, a microphone, an imaging element, and the like. The output unit 507 includes a display, a speaker, and the like. The recording unit 508 includes a hard disk, a nonvolatile memory, and the like. The communication unit 509 includes a network interface and the like. The drive 510 drives a removable recording medium 511 such as a magnetic disk, an optical disk, a magneto-optical disk, or a semiconductor memory.

In the computer configured as described above, the CPU 501 loads, for example, a program recorded in the recording unit 508 into the RAM 503 via the input/output interface 505 and the bus 504 and executes the program, thereby performing the aforementioned series of processing.

The program executed by the computer (CPU 501) can be, for example, recorded in the removable recording medium 511 as a package medium or the like to be provided. Moreover, the program can be provided via a wired or wireless transmission medium such as a local area network, the Internet, digital satellite broadcasting, or the like.

In the computer, the program can be installed in the recording unit 508 via the input/output interface 505 by attaching the removable recording medium 511 to the drive 510. Furthermore, the program can be received by the communication unit 509 via the wired or wireless transmission medium and installed in the recording unit 508. In addition, the program can be installed in the ROM 502 or the recording unit 508 in advance.

Note that the program executed by the computer may be a program in which the processing are performed in time series according to the order described in the present description, or may be a program in which the processing are performed in parallel or at necessary timings such as when a call is made.

Moreover, the embodiments of the present technology are not limited to the above embodiments, and various modifications can be made in a scope without departing from the gist of the present technology.

For example, the present technology can adopt a configuration of cloud computing in which one function is shared and collaboratively processed by a plurality of devices via a network.

Furthermore, each step described in the aforementioned flowcharts can be executed by one device or can also be shared and executed by a plurality of devices.

Further, in a case where a plurality of processing are included in one step, the plurality of processing included in that one step can be executed by one device or can also be shared and executed by a plurality of devices.

In addition, the effects described in the present description are merely examples and are not limited, and other effects may be provided.

Still further, the present technology can adopt the following configurations.

(1)

An audio processing device including:

a matrix generation unit which generates a vector for each time-frequency with a head-related transfer function obtained by spherical harmonic transform by spherical harmonics as an element by using only the element corresponding to a degree of the spherical harmonics determined for the time-frequency or on the basis of the element common to all users and the element dependent on an individual user; and a head-related transfer function synthesis unit which generates a headphone drive signal of a time-frequency domain by synthesizing an input signal of a spherical harmonic domain and the generated vector.

(2)

The audio processing device according to (1), in which the matrix generation unit generates the vector on the basis of the element common to all the users and the element dependent on the individual user, which are determined for each time-frequency.

(3)

The audio processing device according to (1) or (2), in which the matrix generation unit generates the vector including only the element corresponding to the degree determined for the time-frequency on the basis of the element common to all the users and the element dependent on the individual user.

(4)

The audio processing device according any one of (1) to (3), further including a head direction acquisition unit which acquires a head direction of a user who listens to sound, in which the matrix generation unit generates, as the vector, a row corresponding to the head direction in a head-related transfer function matrix including the head-related transfer function for each of a plurality of directions.

(5)

The audio processing device according to any one of (1) to (3), further including a head direction acquisition unit which acquires a head direction of a user who listens to sound, in which the head-related transfer function synthesis unit generates the headphone drive signal by synthesizing a rotation matrix determined by the head direction, the input signal, and the vector.

(6)

The audio processing device according to (5), in which the head-related transfer function synthesis unit generates the headphone drive signal by obtaining a product of the rotation matrix and the input signal and then obtaining a product of the product and the vector.

(7)

The audio processing device according to (5), in which the head-related transfer function synthesis unit generates the headphone drive signal by obtaining a product of the rotation matrix and the vector and then obtaining a product of the product and the input signal.

(8)

The audio processing device according to any one of (5) to (7), further including a rotation matrix generation unit which generates the rotation matrix on the basis of the head direction.

(9)

The audio processing device according to any one of (4) to (8), further including a head direction sensor unit which detects rotation of a head of the user, in which the head direction acquisition unit acquires the head direction of the user by acquiring a detection result by the head direction sensor unit.

(10)

The audio processing device according to any one of (1) to (9), further including a time-frequency inverse transform unit which performs time-frequency inverse transform on the headphone drive signal.

(11)

An audio processing method including steps of:

generating a vector for each time-frequency with a head-related transfer function obtained by spherical harmonic transform by spherical harmonics as an element by using only the element corresponding to a degree of the spherical harmonics determined for the time-frequency or on the basis of the element common to all users and the element dependent on an individual user; and generating a headphone drive signal of a time-frequency domain by synthesizing an input signal of a spherical harmonic domain and the generated vector.

(12)

A program which causes a computer to execute processing including steps of:

generating a vector for each time-frequency with a head-related transfer function obtained by spherical harmonics transform by spherical harmonics as an element by using only the element corresponding to a degree of the spherical harmonics determined for the time-frequency or on the basis of the element common to all users and the element dependent on an individual user; and generating a headphone drive signal of a time-frequency domain by synthesizing an input signal of a spherical harmonic domain and the generated vector.

REFERENCE SIGNS LIST

81 Audio processing device
91 Head direction sensor unit
92 Head direction selection unit
93 Head-related transfer function synthesis unit
34 Time-frequency inverse transform unit
131 Signal rotation unit
132 Head-related transfer function synthesis unit
171 Head-related transfer function rotation unit
172 Head-related transfer function synthesis unit
201 Matrix derivation unit
281 Time-frequency transform unit
311 Matrix generation unit

The invention claimed is:

1. An audio processing device, comprising:

a matrix generation unit configured to generate a vector for a time-frequency, wherein the vector includes a head-related transfer function obtained by spherical harmonic transform by spherical harmonics, the generation of the vector is based on one of:

a first element corresponding to a degree of the spherical harmonics associated with the time-frequency, or a second element common to a plurality of users and a third element dependent on each of the plurality of users, and the first element, the second element, and the third element correspond to the head-related transfer function;

a head direction acquisition unit configured to acquire a head direction of a user of the plurality of users, wherein the user is associated with the audio processing device; and a head-related transfer function synthesis unit configured to:

synthesize a rotation matrix, the generated vector, and an input signal of a spherical harmonic domain, wherein the rotation matrix is based on the head direction of the user; and generate a headphone drive signal of a time-frequency domain based on the synthesis.

2. The audio processing device according to claim 1, wherein the matrix generation unit is further configured to generate the vector based on the second element common to the plurality of users and the third element dependent on each of the plurality of users, and the second element and the third element are determined for each time-frequency.

3. The audio processing device according to claim 1, wherein the matrix generation unit is further configured to generate the vector including only the first element corresponding to the degree determined for the time-frequency, and the generation of the vector is based on the second element common to the plurality of users and the third element dependent on each of the plurality of users.

4. The audio processing device according to claim 1, wherein the matrix generation unit is further configured to generate, as the vector, a row corresponding to the head direction in a head-related transfer function matrix, and the head-related transfer function matrix includes the head-related transfer function for each of a plurality of directions.

5. The audio processing device according to claim 1, wherein the head-related transfer function synthesis unit is further configured to:

obtain a first result of a multiplication of the rotation matrix and the input signal;

obtain a second result of a multiplication of the first result and the generated vector; and generate the headphone drive signal based on the second result.

6. The audio processing device according to claim 1, wherein the head-related transfer function synthesis unit is further configured to:

obtain a first result of a multiplication of the rotation matrix and the generated vector;

obtain a second result of a multiplication of the first result and the input signal; and generate the headphone drive signal based on the second result.

7. The audio processing device according to claim 1, further comprising a rotation matrix generation unit configured to generate the rotation matrix based on the head direction.

8. The audio processing device according to claim 4, further comprising a head direction sensor unit configured to detect a rotation of a head of the user, wherein the head direction acquisition unit is further configured to acquire the head direction of the user based on a detection result of the head direction sensor unit.

9. The audio processing device according to claim 1, further comprising a time-frequency inverse transform unit configured to perform a time-frequency inverse transform on the headphone drive signal.

10. An audio processing method, comprising:

generating a vector for a time-frequency, wherein the vector includes a head-related transfer function obtained by spherical harmonic transform by spherical harmonics, the generation of the vector is based on one of:

a first element corresponding to a degree of the spherical harmonics associated with the time-frequency, or a second element common to a plurality of users and a third element dependent on each of the plurality of users, and the first element, the second element, and the third element correspond to the head-related transfer function;

acquiring a head direction of a user of the plurality of users;

synthesizing a rotation matrix, the generated vector, and an input signal of a spherical harmonic domain, wherein the rotation matrix is based on the head direction of the user; and generating a headphone drive signal of a time-frequency domain based on the synthesis.

11. A non-transitory computer-readable medium having stored thereon computer-executable instructions that, when executed by a processor, cause the processor to execute operations, the operations comprising:

generating a vector for a time-frequency, wherein the vector includes a head-related transfer function obtained by spherical harmonic transform by spherical harmonics, the generation of the vector is based on one of:

a first element corresponding to a degree of the spherical harmonics associated with the time-frequency, or a second element common to a plurality of users and a third element dependent on each of the plurality of users, and the first element, the second element, and the third element correspond to the head-related transfer function;

acquiring a head direction of a user of the plurality of users;

synthesizing a rotation matrix, the generated vector, and an input signal of a spherical harmonic domain, wherein the rotation matrix is based on the head direction of the user; and generating a headphone drive signal of a time-frequency domain based on the synthesis.

* * * * *